US009072948B2

(12) United States Patent
Franklin et al.

(10) Patent No.: US 9,072,948 B2
(45) Date of Patent: Jul. 7, 2015

(54) GOLF CLUB HEAD OR OTHER BALL STRIKING DEVICE UTILIZING ENERGY TRANSFER

(75) Inventors: David N. Franklin, Granbury, TX (US); John T. Stites, Weatherford, TX (US); Robert Boyd, Euless, TX (US); Jeremy N. Snyder, Benbrook, TX (US)

(73) Assignee: Nike, Inc., Beaverton, OR (US)

( * ) Notice: Subject to any disclaimer, the term of this patent is extended or adjusted under 35 U.S.C. 154(b) by 490 days.

(21) Appl. No.: 13/308,079

(22) Filed: Nov. 30, 2011

(65) Prior Publication Data

US 2013/0137533 A1 May 30, 2013

(51) Int. Cl.

| | |
|---|---|
| ***A63B 53/04*** | (2015.01) |
| ***A63B 53/06*** | (2015.01) |
| ***A63B 59/00*** | (2015.01) |
| *A63B 49/06* | (2006.01) |

(52) U.S. Cl.

CPC ..... *A63B 53/04* (2013.01); *A63B 59/0092* (2013.01); *A63B 49/06* (2013.01); *A63B 2053/0495* (2013.01); *A63B 53/0487* (2013.01); *A63B 2053/0425* (2013.01); *A63B 2209/00* (2013.01); *A63B 53/0466* (2013.01); *A63B 2053/0433* (2013.01); *A63B 53/047* (2013.01); *A63B 2053/045* (2013.01); *A63B 2053/0416* (2013.01); *A63B 2053/0491* (2013.01)

(58) Field of Classification Search

USPC ..... 473/324–350

See application file for complete search history.

(56) References Cited

U.S. PATENT DOCUMENTS

| | | | | |
|---|---|---|---|---|
| 1,222,770 A | | 4/1917 | Kaye | |
| 2,429,351 A | * | 10/1947 | Fetterolf | 473/329 |
| 2,520,702 A | | 8/1950 | Verderber | |
| 3,519,271 A | | 7/1970 | Smith | |
| 3,840,231 A | | 10/1974 | Moore | |
| 3,980,301 A | | 9/1976 | Smith | |

(Continued)

FOREIGN PATENT DOCUMENTS

| | | |
|---|---|---|
| FR | 2672226 | 8/1992 |
| GB | 2280380 A | 2/1995 |

(Continued)

OTHER PUBLICATIONS

ISR and WO dated Feb. 27, 2013 from PCT Application No. PCT/US2012/067050.

(Continued)

*Primary Examiner* — Alvin Hunter

(74) *Attorney, Agent, or Firm* — Banner & Witcoff, Ltd.

(57) ABSTRACT

A head for a ball striking device, such as a golf club head, includes a face member having a face with a striking surface configured for striking a ball and a rear surface opposite the striking surface, a weight member connected to the face member behind the rear surface of the face member, and a resilient member positioned between the weight member and the face member. The resilient member is connected to the rear surface of the face member to connect the weight member to the face member. The resilient member is compressible to permit energy and/or momentum to be transferred between the weight member and the face member through the resilient member during impact, including an off-center impact on the striking surface. Momentum transferred from the weight member to the face member during an off-center impact may reduce energy loss and twisting of the face on impact.

45 Claims, 23 Drawing Sheets

(56) References Cited

U.S. PATENT DOCUMENTS

| | | | | | |
|---|---|---|---|---|---|
| 4,534,558 | A | | 8/1985 | Yoneyama | |
| 4,582,321 | A | | 4/1986 | Yoneyama | |
| 4,630,827 | A | | 12/1986 | Yoneyama | |
| 4,635,941 | A | | 1/1987 | Yoneyama | |
| 4,664,383 | A | | 5/1987 | Aizawa | |
| 4,667,963 | A | | 5/1987 | Yoneyama | |
| 4,697,814 | A | | 10/1987 | Yamada | |
| 4,708,347 | A | | 11/1987 | Kobayashi | |
| 4,728,105 | A | | 3/1988 | Kobayashi | |
| 4,811,950 | A | * | 3/1989 | Kobayashi | 473/335 |
| 4,842,280 | A | * | 6/1989 | Hilton | 473/231 |
| 4,927,144 | A | | 5/1990 | Stormon | |
| 4,928,972 | A | * | 5/1990 | Nakanishi et al. | 473/332 |
| 5,004,242 | A | | 4/1991 | Iwanaga et al. | |
| 5,009,425 | A | | 4/1991 | Okumoto et al. | |
| 5,078,397 | A | | 1/1992 | Aizawa | |
| 5,133,553 | A | | 7/1992 | Divnick | |
| 5,228,694 | A | | 7/1993 | Okumoto et al. | |
| 5,269,517 | A | | 12/1993 | Petruccelli et al. | |
| 5,290,036 | A | * | 3/1994 | Fenton et al. | 473/332 |
| 5,326,106 | A | | 7/1994 | Meyer | |
| 5,333,871 | A | | 8/1994 | Wishon | |
| 5,413,337 | A | | 5/1995 | Goodman et al. | |
| 5,419,560 | A | | 5/1995 | Bamber | |
| 5,435,551 | A | | 7/1995 | Chen | |
| 5,447,307 | A | | 9/1995 | Antonious | |
| 5,518,243 | A | * | 5/1996 | Redman | 473/334 |
| 5,538,245 | A | | 7/1996 | Moore | |
| 5,601,498 | A | | 2/1997 | Antonious | |
| 5,692,972 | A | * | 12/1997 | Langslet | 473/332 |
| 5,695,409 | A | | 12/1997 | Jackson | |
| 5,772,525 | A | * | 6/1998 | Klein | 473/300 |
| 6,001,030 | A | * | 12/1999 | Delaney | 473/329 |
| 6,080,068 | A | | 6/2000 | Takeda | |
| 6,095,931 | A | * | 8/2000 | Hettinger et al. | 473/341 |
| 6,117,022 | A | | 9/2000 | Crawford et al. | |
| 6,159,109 | A | * | 12/2000 | Langslet | 473/332 |
| 6,176,791 | B1 | * | 1/2001 | Wright | 473/252 |
| 6,270,423 | B1 | * | 8/2001 | Webb | 473/226 |
| 6,299,546 | B1 | | 10/2001 | Wang | |
| 6,302,807 | B1 | * | 10/2001 | Rohrer | 473/329 |
| 6,386,987 | B1 | | 5/2002 | LeJeune, Jr. | |
| 6,428,423 | B1 | * | 8/2002 | Merko | 473/307 |
| 6,443,857 | B1 | * | 9/2002 | Chuang | 473/332 |
| 6,478,690 | B2 | * | 11/2002 | Helmstetter et al. | 473/324 |
| 6,514,154 | B1 | | 2/2003 | Finn | |
| 6,533,679 | B1 | * | 3/2003 | McCabe et al. | 473/335 |
| 6,743,112 | B2 | * | 6/2004 | Nelson | 473/251 |
| 6,811,496 | B2 | * | 11/2004 | Wahl et al. | 473/334 |
| 6,923,733 | B2 | | 8/2005 | Chen | |
| 7,025,692 | B2 | * | 4/2006 | Erickson et al. | 473/335 |
| 7,048,646 | B2 | * | 5/2006 | Yamanaka et al. | 473/332 |
| 7,090,590 | B2 | | 8/2006 | Chen | |
| 7,128,663 | B2 | | 10/2006 | Bamber | |
| 7,297,071 | B2 | | 11/2007 | Hyman | |
| 7,473,186 | B2 | * | 1/2009 | Best et al. | 473/329 |
| 7,540,810 | B2 | * | 6/2009 | Hettinger et al. | 473/331 |
| 7,575,523 | B2 | * | 8/2009 | Yokota | 473/332 |
| 7,641,569 | B2 | * | 1/2010 | Best et al. | 473/329 |
| 7,651,409 | B1 | * | 1/2010 | Mier | 473/330 |
| 7,938,739 | B2 | | 5/2011 | Cole et al. | |
| 7,997,999 | B2 | * | 8/2011 | Roach et al. | 473/332 |
| 8,070,622 | B2 | | 12/2011 | Schmidt | |
| 8,177,664 | B2 | * | 5/2012 | Horii et al. | 473/340 |
| 8,182,364 | B2 | | 5/2012 | Cole et al. | |
| 8,206,241 | B2 | * | 6/2012 | Boyd et al. | 473/332 |
| 8,382,604 | B2 | * | 2/2013 | Billings | 473/244 |
| 2002/0183134 | A1 | | 12/2002 | Allen et al. | |
| 2010/0261546 | A1 | | 10/2010 | Nicodem | |
| 2012/0077615 | A1 | | 3/2012 | Schmidt | |

FOREIGN PATENT DOCUMENTS

| | | | | | |
|---|---|---|---|---|---|
| JP | 09000666 | A | * | 1/1997 | A63B 53/04 |
| JP | 09276455 | A | * | 10/1997 | A63B 53/04 |
| JP | 11057082 | A | * | 3/1999 | A63B 53/04 |
| JP | 11169493 | A | * | 6/1999 | A63B 53/04 |
| JP | 11244431 | A | * | 9/1999 | A63B 53/04 |
| JP | 2005131280 | A | * | 5/2005 | A63B 53/04 |
| JP | 2005305178 | A | * | 11/2005 | A63B 53/04 |
| JP | 2006000435 | A | * | 1/2006 | |
| JP | 2010154887 | A | * | 7/2010 | |
| WO | WO 9920358 | A1 | * | 4/1999 | A63B 53/04 |

OTHER PUBLICATIONS

Feb. 27, 2013—(WO) International Search Report and Written Opinion—App PCT/US2012/067050.

Jul. 24, 2013—(WO) International Search Report and Written Opinion—App PCT/US2013/043613.

* cited by examiner

FIG. 20
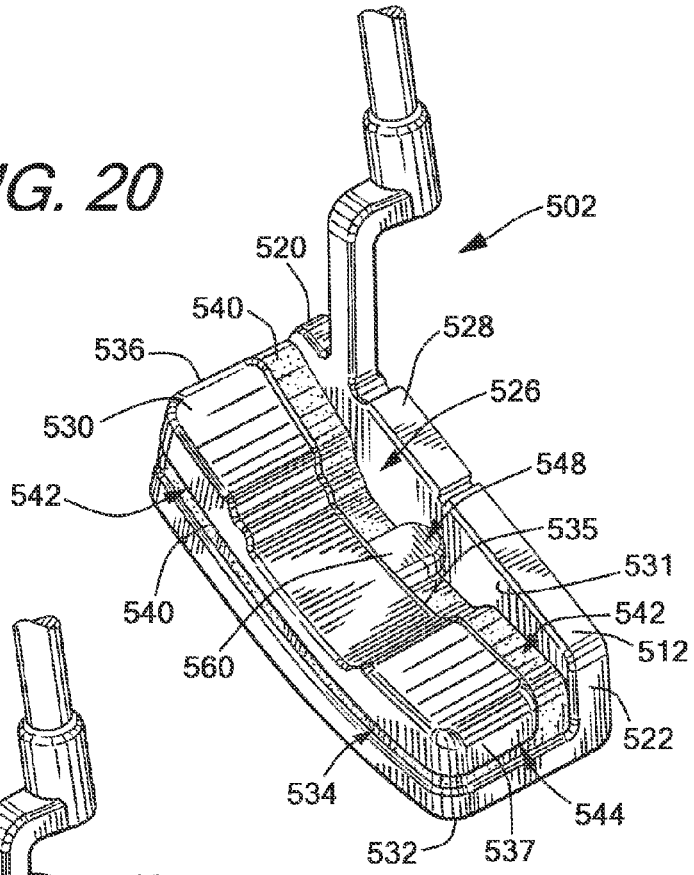
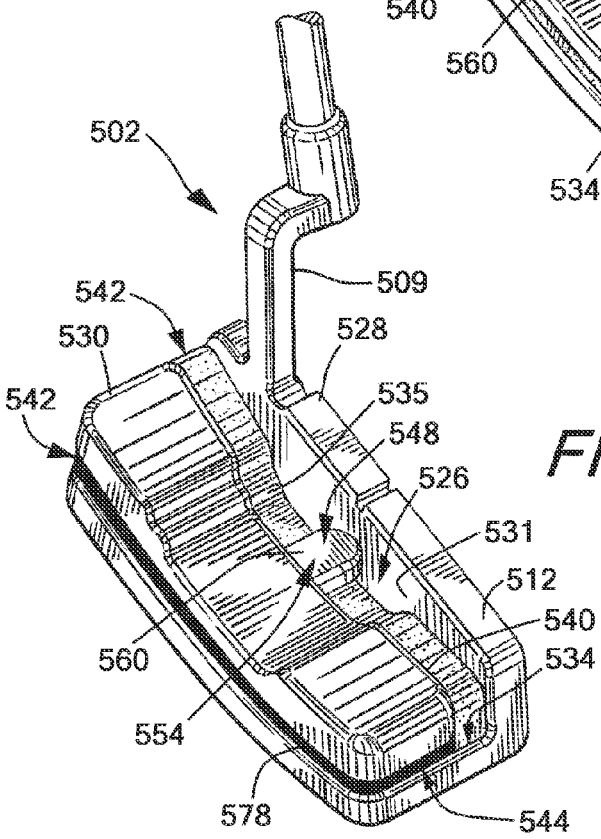
FIG. 20A

FIG. 26
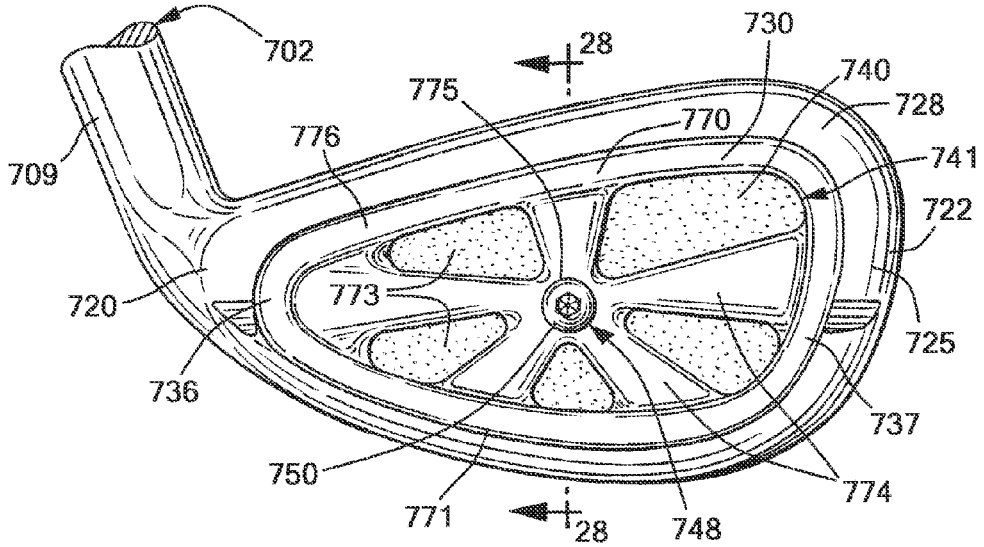
FIG. 26A
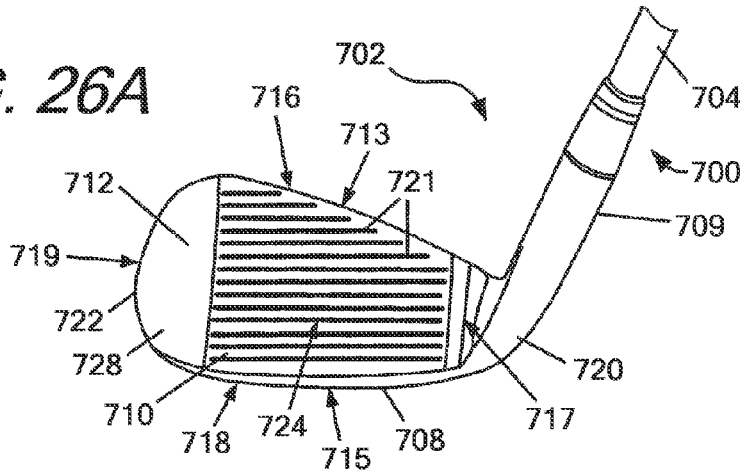
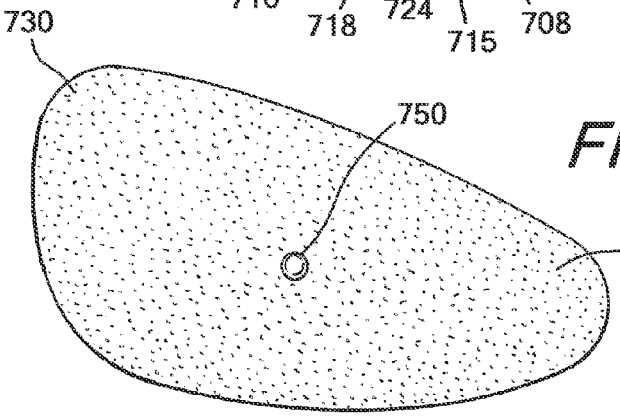
FIG. 27

GOLF CLUB HEAD OR OTHER BALL STRIKING DEVICE UTILIZING ENERGY TRANSFER

TECHNICAL FIELD

The invention relates generally to ball striking devices, such as golf clubs and golf club heads, utilizing features for transfer of energy and/or momentum. Certain aspects of this invention relate to golf club heads having a weight member configured to transfer energy and/or momentum to the face upon an impact on the face.

BACKGROUND

Golf clubs and many other ball striking devices can encounter undesirable effects when the ball being struck impacts the ball striking head away from the optimum location, which may be referred to as an "off-center impact." In a golf club head, this optimum location is, in many cases, aligned laterally and/or vertically with the center of gravity (CG) of the head. Even slightly off-center impacts can sometimes significantly affect the performance of the head, and can result in reduced velocity and/or energy transfer to the ball, inconsistent ball flight direction and/or spin caused by twisting of the head, increased vibration that can produce undesirable sound and/or feel, and other undesirable effects. Technologies that can reduce or eliminate some or all of these undesirable effects could have great usefulness in golf club heads and other ball striking devices.

The present devices and methods are provided to address at least some of the problems discussed above and other problems, and to provide advantages and aspects not provided by prior ball striking devices of this type. A full discussion of the features and advantages of the present invention is deferred to the following detailed description, which proceeds with reference to the accompanying drawings.

BRIEF SUMMARY

The following presents a general summary of aspects of the invention in order to provide a basic understanding of the invention. This summary is not an extensive overview of the invention. It is not intended to identify key or critical elements of the invention or to delineate the scope of the invention. The following summary merely presents some concepts of the invention in a general form as a prelude to the more detailed description provided below.

Aspects of the invention relate to ball striking devices, such as golf clubs, with a head that includes a face member having a face with a striking surface configured for striking a ball and a rear surface opposite the striking surface, a weight member connected to the face member behind the rear surface of the face member, and a resilient member comprising a resilient material positioned between the weight member and the face member. The resilient member is connected to the rear surface of the face member to connect the weight member to the face member. The resilient member is compressible to permit the weight member to transfer momentum to the face member through the resilient member upon an impact of the ball on the striking surface. The head may further include a hosel configured for connection of a shaft, the hosel being connected to the face member, rather than the weight member.

According to one aspect, the weight member is configured such that energy and/or momentum can be transferred between the weight member and the face member upon impact, including an off-center impact of the ball on the striking surface. The weight member may transfer momentum to the face member upon impact, and the amount of momentum transferred to the face member may increase incrementally with a lateral distance of a location of the impact away from a center of gravity of the face member.

According to another aspect, the striking surface has a heel side and a toe side positioned on opposed sides of a center of gravity of the face member, and the weight member has a heel edge and a toe edge positioned on opposed sides of a center of gravity of the weight member. The heel edge of the weight member is configured to transfer momentum to the face member upon an impact of the ball centered on the heel side of the striking surface, and the toe edge of the weight member is configured to transfer momentum to the face member upon an impact of the ball centered on the toe side of the striking surface.

According to another aspect, the face member has a heel edge and a toe edge positioned on opposed sides of the center of gravity of the face member and a width defined between the heel and toe edges thereof, and the weight member has a width defined between the heel and toe edges thereof. The width of the face member is approximately equal to the width of the weight member.

According to another aspect, the weight member has a cross-sectional area that is greater at the heel and toe edges thereof than at the center of gravity thereof.

According to another aspect, the face member has a sole member extending rearwardly from the face, the sole member having a sole surface configured to confront a playing surface and a top surface opposite the sole surface. The weight member is at least partially positioned above the top surface in this configuration. Additionally, the weight member has a bottom surface that is spaced from and in confronting relation to the top surface of the sole member, and the resilient member is connected to, and positioned between, the top surface of the sole member and the bottom surface of the weight member.

According to another aspect, spaces are defined between the weight member and the rear surface of the face member on opposed sides of a center of gravity of the face member, and the resilient member is positioned within the spaces on both sides of the center of gravity of the face member. The face member may also include a sole member as described above, with additional spaces defined between the weight member and the top surface of the sole member. The resilient member may further be positioned within the additional spaces on both sides of the center of gravity of the face member. The resilient member may fill the spaces and/or the additional spaces completely in one configuration.

According to a further aspect, the head may include a first connection member connected to at least one of the face member and the weight member. The first connection member forms a joint between the face member and the weight member that permits the weight member to transfer momentum to the face member.

According to another aspect, the first connection member may be a pin or a fastener extending through apertures in the face member and the weight member to define the joint.

According to another aspect, the first connection member is connected to the face member, and the head also includes a second connection member connected to the weight member, where the first and second connection members are connected to form the joint.

According to another aspect, one of the first and second connection members includes a pin and another of the first and second connection members includes a receiver, where the pin is received in the receiver to connect the face member and the weight member and to define the joint.

According to another aspect, the face member and the weight member each have heel and toe edges. The first connection member may be positioned between the face member heel and toe edges and proximate a lateral center of the face member, and the second connection member may be positioned between the weight member heel and toe edges and proximate a lateral center of the weight member.

According to another aspect, the face member heel edge is spaced from the weight member heel edge, and the face member toe edge is spaced from the weight member toe edge. The resilient member is positioned at least between the heel edges of the face member and the weight member and between the toe edges of the face member and the weight member.

According to another aspect, the face member has a cavity on the rear surface thereof, and the weight member is at least partially received within the cavity. The face member has a width defined between the heel and toe edges of the face member that may be greater than a width of the weight member defined between the heel and toe edges of the weight member, such that the heel and toe edges of the face member extend laterally beyond the heel and toe edges of the weight member.

Additional aspects of the invention relate to a ball striking device that includes a face member having a face with a striking surface configured for striking a ball and a rear side opposite the striking surface, a resilient member connected to the rear side of the face member, and a weight member that is connected to the resilient member and influences a center of gravity of the ball striking device. The weight member is suspended with respect to the face member by the resilient member, such that only the resilient member connects the weight member to the face member. Additionally, the weight member has at least a first surface that is engaged by the resilient member and at least a second surface that is exposed and not engaged by the resilient member. The weight member is configured such that energy and/or momentum can be transferred between the weight member and the face member through the resilient member during impact, including during an off-center impact of the ball on the striking surface. The various aspects and features described above can be similarly used in accordance with this configuration.

Further aspects of the invention relate to a ball striking device that includes a face member having a face with a striking surface configured for striking a ball and a rear side opposite the striking surface, a weight member joined to the rear side of the face member, and a first connection member connecting the rear side of the face member to the weight member. The face member has a heel edge and a toe edge, and the weight member also has a heel edge and a toe edge. The first connection member connects the face member and the weight member at a connection point located approximately equidistant from the heel edge and the toe edge of the face member and approximately equidistant from the heel edge and the toe edge of the weight member. The face member is spaced from the weight member between the first connection member and the heel edge of the face member and between the first connection member and the toe edge of the face member. The various aspects and features described above can be similarly used in accordance with this configuration.

Still further aspects of the invention relate to a ball striking device that includes a face member having a face with a striking surface configured for striking a ball and a rear side opposite the striking surface of the face, a weight member connected to the rear side of the face member at a connection point and influencing a center of gravity of the ball striking device, and a resilient member separating the weight member from the rear side of the face member on opposite sides of the connection point. The resilient member is configured to transfer momentum between the face member and the weight member. The various aspects and features described above can be similarly used in accordance with this configuration. For example, the connection point may include a joint that permits the weight member to deflect with respect to the face member.

Additional aspects of the invention relate to a ball striking device that includes a face member having a face with a striking surface configured for striking a ball and a rear side opposite the striking surface, a weight member joined to the rear side of the face member, a first connection member connecting the rear side of the face member and the weight member at a connection point, and a resilient member positioned between the weight member and the face member. The resilient member engages the rear surface of the face member and the weight member to space the weight member from the face member, such that the weight member has at least a first surface that is engaged by the resilient member and at least a second surface that is exposed and not engaged by the resilient member. The resilient member is compressible to permit the weight member to transfer momentum to the face member through the resilient member upon an impact of the ball on the striking surface. The first connection member forms a joint at the connection point, and the joint is configured to permit the weight member to transfer momentum to the face member through the resilient member. The various aspects and features described above can be similarly used in accordance with this configuration.

Other aspects of the invention relate to a ball striking device that includes a face member having a face with a striking surface configured for striking a ball and a rear surface opposite the striking surface, a weight member connected to the face member and having a front surface confronting the rear surface of the face member, and a resilient member connected to the rear surface of the face member and the front surface of the weight member. The face member has a heel edge and a toe edge and the striking surface has a heel side and a toe side positioned on opposed sides of a center of gravity of the face member. The face member may also have a hosel connected thereto, with the hosel being configured for connection of a shaft. The weight member also has a heel edge and a toe edge positioned on opposed sides of a center of gravity of the weight member. Only the resilient member connects the weight member to the face member, such that spaces are defined between the front surface of the weight member and the rear surface of the face member on opposed sides of the center of gravity of the face member, and the resilient member is positioned within the spaces on both sides of the center of gravity of the face member to space the weight member from the face member. The weight member has an exposed top surface and an exposed back surface that are not engaged by the resilient member. The resilient member is compressible to permit the weight member to transfer energy and/or momentum to the face member through the resilient member. The weight member is configured such that the heel edge of the weight member is configured to transfer momentum to the face member upon an impact of the ball centered on a heel side of the striking surface, and the toe edge of the weight member is configured to transfer momentum to the face member upon an impact of the ball centered on a toe side of the striking surface. The various aspects and features described above can be similarly used in accordance with this configuration.

Other aspects of the invention relate to a ball striking device that includes a face member having a face with a striking surface configured for striking a ball, a rear surface opposite the striking surface, and a sole member extending rearward from the face and having a sole surface configured to confront a playing surface and a top surface opposite the sole surface. The face member has a heel edge and a toe edge, and the striking surface has a heel side and a toe side positioned on opposed sides of a center of gravity of the face member. The face member may also have a hosel connected thereto, with the hosel being configured for connection of a shaft. The device further includes a weight member connected to the face member and having a front surface confronting the rear surface of the face member and a bottom surface confronting the top surface of the sole member, and a resilient member connected to the top surface of the sole member and the top surface of the weight member to connect the weight member to the face member. The weight member also has a heel edge and a toe edge positioned on opposed sides of a center of gravity of the weight member. Spaces are defined between the bottom surface of the weight member and the top surface of the sole member on opposed sides of the center of gravity of the face member, and the resilient member is positioned within the spaces on both sides of the center of gravity of the face member to space the weight member from the face member, such that only the resilient member connects the weight member to the face member. The weight member has an exposed top surface and an exposed back surface that are not engaged by the resilient member. The resilient member is compressible to permit the weight member to transfer momentum to the face member. The weight member is configured such that the heel edge of the weight member is configured to transfer momentum to the face member upon an impact of the ball centered on a heel side of the striking surface, and the toe edge of the weight member is configured to transfer momentum to the face member upon an impact of the ball centered on a toe side of the striking surface. The various aspects and features described above can be similarly used in accordance with this configuration.

Other aspects of the invention relate to a ball striking device that includes a face member having a face with a striking surface configured for striking a ball and a rear surface opposite the striking surface. The face member has a heel edge and a toe edge positioned on opposed sides of a center of gravity of the face member and a width defined between the heel and toe edges of the face member, and further has a cavity defined on the rear surface of the face member. The face member may also have a hosel connected thereto, with the hosel being configured for connection of a shaft. The device further includes a weight member connected to the rear surface of the face member and being at least partially received in the cavity, and a resilient member connected to the rear surface of the face member and the front surface of the weight member to connect the weight member to the face member. The weight member has a front surface confronting the rear surface of the face member, a heel edge and a toe edge positioned on opposed sides of a center of gravity of the weight member, and a width defined between the heel and toe edges of the weight member. The width of the weight member is smaller than the width of the face member such that the heel and toe edges of the face member extend laterally beyond the heel and toe edges of the weight member. Spaces are defined between the front surface of the weight member and the rear surface of the face member on opposed sides of the center of gravity of the face member, and the resilient member is positioned within the spaces on both sides of the center of gravity of the face member to space the weight member from the face member, such that only the resilient member connects the weight member to the face member. The resilient member is compressible to permit the weight member to transfer momentum to the face member. The weight member is configured such that the heel edge of the weight member is configured to transfer momentum to the face member upon an impact of the ball centered on a heel side of the striking surface, and the toe edge of the weight member is configured to transfer momentum to the face member upon an impact of the ball centered on a toe side of the striking surface. The various aspects and features described above can be similarly used in accordance with this configuration.

Other aspects of the invention relate to a ball striking device that includes a face member having a face with a striking surface configured for striking a ball and a rear surface opposite the striking surface. The face member has a heel edge and a toe edge positioned on opposed sides of a center of gravity of the face member and a width defined between the heel and toe edges of the face member. The face member further has a first cavity on the rear surface of the face member located on one lateral side of the center of gravity of the face member and proximate the heel edge of the face member and a second cavity on the rear surface of the face member located on an opposite lateral side of the center of gravity of the face member and proximate the toe edge of the face member. The face member may also have a hosel connected thereto, with the hosel being configured for connection of a shaft. The device further includes a resilient member filling at least a portion of the first cavity and the second cavity, a first weight member received in the first cavity and suspended within the resilient member within the first cavity, such that the resilient member separates the first weight member from inner surfaces defining the first cavity, and a second weight member received in the second cavity and suspended within the resilient member within the second cavity, such that the resilient member separates the second weight member from inner surfaces defining the second cavity. The resilient member is compressible to permit the first and second weight members to transfer momentum to the face member. The first weight member is configured to transfer momentum to the face member upon an impact of the ball centered on a heel side of the striking surface, and the second weight member is configured to transfer momentum to the face member upon an impact of the ball centered on a toe side of the striking surface. The device may further include a plurality of first weight members received within the first cavity and suspended within the resilient member within the first cavity, and a plurality of second weight members received within the second cavity and suspended within the resilient member within the second cavity. The various aspects and features described above can be similarly used in accordance with this configuration.

Other aspects of the invention relate to a ball striking device that includes a face member having a face with a striking surface configured for striking a ball and a rear surface opposite the striking surface and a weight member connected to the rear surface of the face member. The face member has a heel edge, a toe edge, and a first connection member connected to the rear surface at a location approximately equidistant from the heel edge and the toe edge and laterally aligned approximately with a center of gravity of the face member. The face member may also have a hosel connected thereto, with the hosel being configured for connection of a shaft. The weight member has a heel edge, a toe edge, and a second connection member connected thereto at a location approximately equidistant from the heel edge and the toe edge. The first connection member is connected to the second connection member to connect the face member and the weight member. One of the first and second connection members includes a pin and another of the first and second connection members includes a receiver, and the pin is received in the receiver to form a joint, such that the joint permits the weight member to transfer momentum to the face member. The face member is spaced from the weight member between the first connection member and the heel edge of the face member and between the first connection member and the toe edge of the face member. The weight member is configured such that the heel edge of the weight member is configured to transfer momentum to the face member upon an impact of the ball centered on a heel side of the striking surface, and the toe edge of the weight member is configured to transfer momentum to the face member upon an impact of the ball centered on a toe side of the striking surface. The various aspects and features described above can be similarly used in accordance with this configuration.

Other aspects of the invention relate to a ball striking device that includes a face member having a face with a striking surface configured for striking a ball and a rear surface opposite the striking surface, the face member having a heel edge, a toe edge, a cavity defined on the rear surface, a weight member connected to the rear surface of the face member, and a first connection member connecting the rear surface of the face member to the weight member to form a connection point located within the cavity. The face member may also have a hosel connected thereto, with the hosel being configured for connection of a shaft. The weight member has a heel edge, a toe edge as well, and the connection point is aligned approximately with a location of a center of gravity of the face member and approximately equidistant from the heel edge and the toe edge of the weight member. The first connection member connects the weight member to the face member such that the weight member is at least partially received within the cavity, and such that the weight member is configured to transfer momentum to the face member upon an off-center impact of the ball on the striking surface. The face member is spaced from the weight member between the first connection member and the heel edge of the weight member and between the first connection member and the toe edge of the weight member. The various aspects and features described above can be similarly used in accordance with this configuration.

Other aspects of the invention relate to a ball striking device that includes a face member having a face with a striking surface configured for striking a ball, a rear surface opposite the striking surface and a sole member extending rearward from the face and having a sole surface configured to confront a playing surface and a top surface opposite the sole surface. The face member has a heel edge, a toe edge, and a first connection member connected to at least one of the rear surface of the face member and the top surface of the sole member at a location approximately equidistant from the heel edge and the toe edge and laterally aligned approximately with a center of gravity of the face member. The face member may also have a hosel connected thereto, with the hosel being configured for connection of a shaft. The device further includes a weight member connected to the face member and located behind the rear surface of the face member and above the top surface of the sole member, the weight member having a heel edge, a toe edge, and a second connection member connected thereto at a location approximately equidistant from the heel edge and the toe edge. The first connection member is connected to the second connection member to connect the face member and the weight member, such that one of the first and second connection members includes a pin and another of the first and second connection members includes a receiver. The pin is received in the receiver to form a joint, such that the joint permits the weight member to transfer momentum to the face member. The face member is spaced from the weight member between the first connection member and the heel edge of the face member and between the first connection member and the toe edge of the face member. The weight member is configured such that the heel edge of the weight member is configured to transfer momentum to the face member upon an impact of the ball centered on a heel side of the striking surface, and the toe edge of the weight member is configured to transfer momentum to the face member upon an impact of the ball centered on a toe side of the striking surface. The various aspects and features described above can be similarly used in accordance with this configuration.

Additional aspects of the invention relate to a golf club or other ball striking device including a head or other ball striking device as described above and a shaft connected to the head/device and configured for gripping by a user. The shaft may be connected to the face member of the head. Aspects of the invention relate to a set of golf clubs including at least one golf club as described above. Yet additional aspects of the invention relate to a method for manufacturing a ball striking device as described above, including connecting a weight member and/or a resilient member to a face member as described above.

Other features and advantages of the invention will be apparent from the following description taken in conjunction with the attached drawings.

BRIEF DESCRIPTION OF THE DRAWINGS

To allow for a more full understanding of the present invention, it will now be described by way of example, with reference to the accompanying drawings in which:

FIG. 20 is a rear perspective view of the device of FIG. 19, with a resilient member contained between a face member and a weight member of the device, in one configuration;

FIG. 20A is a rear perspective view of an alternate embodiment of the ball striking device as shown in FIG. 20;

FIG. 26 is a rear view of another embodiment of a ball striking device according to aspects of the present invention, in the form of a golf iron;

FIG. 26A is a front view of the ball striking device of FIG. 26;

FIG. 27 is a front view of a weight member, a resilient member, and a connection member of the device of FIG. 26;

DETAILED DESCRIPTION

Figure 1:
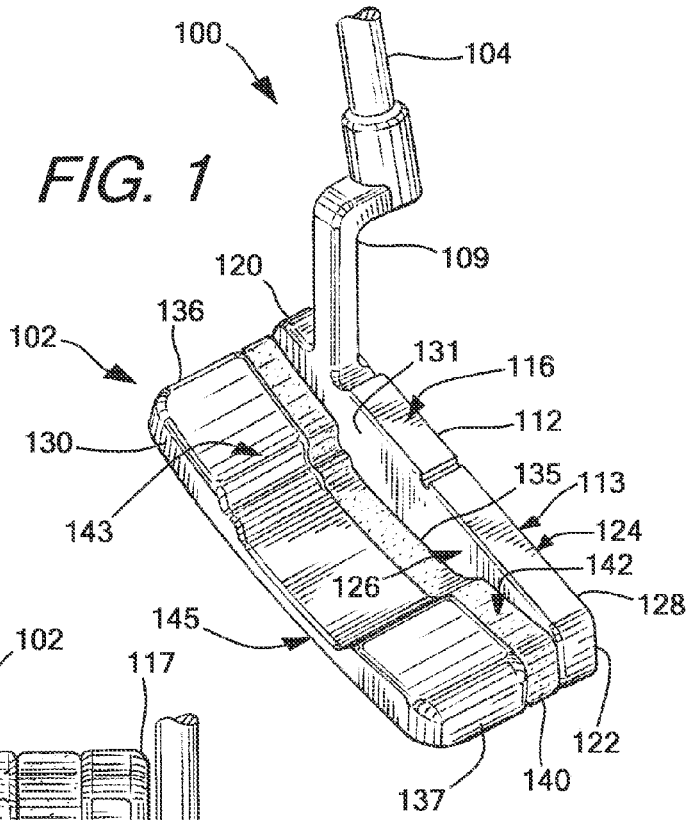
FIG. 1 is a rear perspective view of one embodiment of a ball striking device according to aspects of the present invention, in the form of a golf putter.

In the following description of various example structures according to the invention, reference is made to the accompanying drawings, which form a part hereof, and in which are shown by way of illustration various example devices, systems, and environments in which aspects of the invention may be practiced. It is to be understood that other specific arrangements of parts, example devices, systems, and environments may be utilized and structural and functional modifications may be made without departing from the scope of the present invention. Also, while the terms "top," "bottom," "front," "back," "side," "rear," "primary," "secondary," and the like may be used in this specification to describe various example features and elements of the invention, these terms are used herein as a matter of convenience, e.g., based on the example orientations shown in the figures or the orientation during typical use. Additionally, the term "plurality," as used herein, indicates any number greater than one, either disjunctively or conjunctively, as necessary, up to an infinite number. Nothing in this specification should be construed as requiring a specific three dimensional orientation of structures in order to fall within the scope of this invention. Also, the reader is advised that the attached drawings are not necessarily drawn to scale.

The following terms are used in this specification, and unless otherwise noted or clear from the context, these terms have the meanings provided below.

"Ball striking device" means any device constructed and designed to strike a ball or other similar objects (such as a hockey puck). In addition to generically encompassing "ball striking heads," which are described in more detail below, examples of "ball striking devices" include, but are not limited to: golf clubs, putters, croquet mallets, polo mallets, baseball or softball bats, cricket bats, tennis rackets, badminton rackets, field hockey sticks, ice hockey sticks, and the like.

"Ball striking head" means the portion of a "ball striking device" that includes and is located immediately adjacent (optionally surrounding) the portion of the ball striking device designed to contact the ball (or other object) in use. In some examples, such as many golf clubs and putters, the ball striking head may be a separate and independent entity from any shaft or handle member, and it may be attached to the shaft or handle in some manner.

The term "shaft" includes the portion of a ball striking device (if any) that the user holds during a swing of a ball striking device.

"Integral joining technique" means a technique for joining two pieces so that the two pieces effectively become a single, integral piece, including, but not limited to, irreversible joining techniques, such as adhesively joining, cementing, welding, brazing, soldering, or the like. In many bonds made by "integral joining techniques," separation of the joined pieces cannot be accomplished without structural damage thereto.

"Approximately" or "about" means within a range of +/−10% of the nominal value modified by such term.

In general, aspects of this invention relate to ball striking devices, such as golf club heads, golf clubs, putter heads, putters, and the like. Such ball striking devices, according to at least some examples of the invention, may include a ball striking head and a ball striking surface. In the case of a golf club, the ball striking surface may constitute a substantially flat surface on one face of the ball striking head, although some curvature may be provided (e.g., "bulge" or "roll" characteristics). Some more specific aspects of this invention relate to putters, and other aspects of the invention relate to wood-type golf clubs and golf club heads, including drivers, fairway woods, hybrid-type clubs, iron-type golf clubs, and the like, although aspects of this invention also may be practiced on other types of golf clubs or other ball striking devices, if desired.

According to various aspects of this invention, the ball striking device may be formed of one or more of a variety of materials, such as metals (including metal alloys), ceramics, polymers, composites, fiber-reinforced composites, and wood, and the devices may be formed in one of a variety of configurations, without departing from the scope of the invention. In one embodiment, some or all components of the head, including the face and at least a portion of the body of the head, are made of metal materials. It is understood that the head also may contain components made of several different materials. Additionally, the components may be formed by various forming methods. For example, metal components (such as titanium, aluminum, titanium alloys, aluminum alloys, steels (such as stainless steels), and the like) may be formed by forging, molding, casting, stamping, machining, and/or other known techniques. In another example, composite components, such as carbon fiber-polymer composites, can be manufactured by a variety of composite processing techniques, such as prepreg processing, powder-based techniques, mold infiltration, and/or other known techniques.

The various figures in this application illustrate examples of ball striking devices and portions thereof according to this invention. When the same reference number appears in more than one drawing, that reference number is used consistently in this specification and the drawings to refer to the same or similar parts throughout.

At least some examples of ball striking devices according to this invention relate to golf club head structures, including heads for putter-type golf clubs. Such devices may include a one-piece construction or a multiple-piece construction. An example structure of ball striking devices according to this invention will be described in detail below in conjunction with FIGS. 1-3, and will be referred to generally using reference numeral "100."

Figure 2:
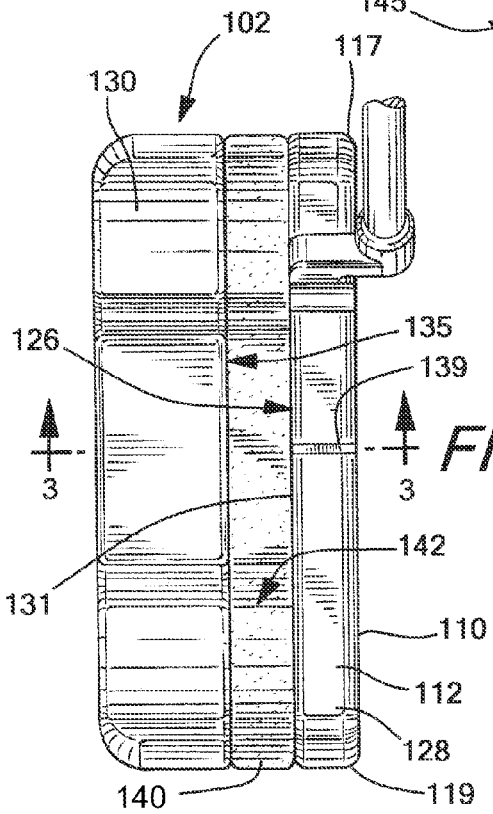
FIG. 2 is a top view of the device of FIG. 1.
Figure 3:
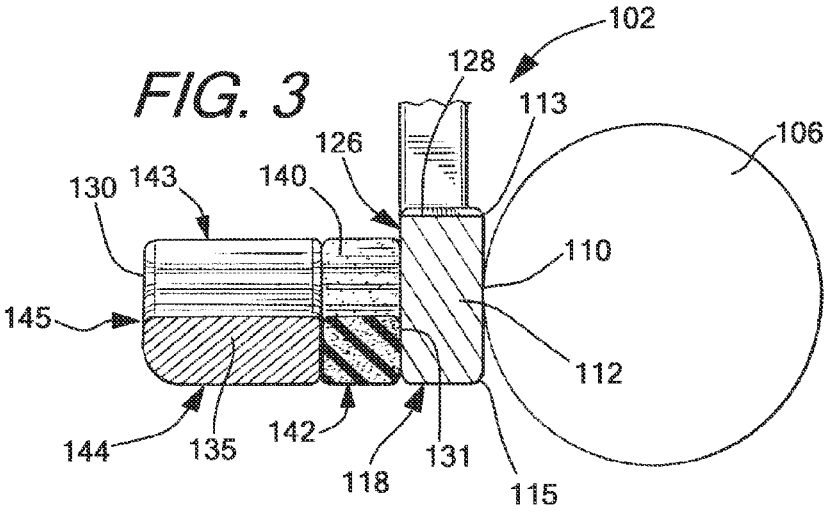
FIG. 3 is a cross-section view taken along lines 3-3 of FIG. 2.

FIGS. 1-3 illustrate an example of a ball striking device 100 in the form of a golf putter, in accordance with at least some examples of this invention. The ball striking device 100 includes a ball striking head 102 and a shaft 104 connected to the ball striking head 102 and extending therefrom. The ball striking head 102 of the ball striking device 100 of FIGS. 1-3 has a face member 128 that includes a face 112 and a hosel 109 extending therefrom. The face member 128 may include one or more structures connected to and/or located behind the face 112 that may be referred to as a "body," such as the sole member 232 in FIGS. 5-7. The ball striking head 102 also has a weight member 130 connected to the face member 128. The shaft 104 may be connected to the head 102 at the hosel 109, as shown in FIG. 1. Any desired hosel and/or head/shaft interconnection structure may be used without departing from this invention, including conventional hosel or other head/shaft interconnection structures as are known and used in the art, or an adjustable, releasable, and/or interchangeable hosel or other head/shaft interconnection structure such as those shown and described in U.S. Pat. No. 6,890,269 dated May 10, 2005, in the name of Bruce D. Burrows, U.S. Published Patent Application No. 2009/0011848, filed on Jul. 6, 2007, in the name of John Thomas Stites, et al., U.S. Published Patent Application No. 2009/0011849, filed on Jul. 6, 2007, in the name of John Thomas Stites, et al., U.S. Published Patent Application No. 2009/0011850, filed on Jul. 6, 2007, in the name of John Thomas Stites, et al., and U.S. Published Patent Application No. 2009/0062029, filed on Aug. 28, 2007, in the name of John Thomas Stites, et al., all of which are incorporated herein by reference in their entireties and made parts hereof.

For reference, the face member 128 generally has a top 116, a bottom or sole 118, a heel 120 (also called a heel side or heel edge) proximate the hosel 109, a toe 122 (also called a toe side or toe edge) distal from the hosel 109, a front side 124, and a back or rear side 126. The shape and design of the head 102 may be partially dictated by the intended use of the device 100. In the club 100 shown in FIGS. 1-3, the head 102 has a wide, narrow or short face 112, as the club 100 is designed for use as a putter, intended to hit the ball short distances in a rolling manner. It is understood that the head 102 may be configured as a different type of ball striking device in other embodiments, including other types of putters or similar devices. In other applications, such as for a different type of golf club, the head may be designed to have different dimensions and configurations. If, for example, the head 102 is configured as a driver, the club head may have a volume of at least 400 cc, and in some structures, at least 450 cc, or even at least 460 cc. When configured as a fairway wood head, the club head may have a volume of at least 120-230 cc, and when configured as a hybrid club head, the club head may have a volume of at least 85-140 cc. Other appropriate sizes for other club heads may be readily determined by those skilled in the art.

The face 112 is located at the front 124 of the face member 128, and has a striking surface or ball striking surface 110 located thereon. The ball striking surface 110 is configured to face a ball 106 in use (see FIG. 3), and is adapted to strike the ball 106 when the device 100 is set in motion, such as by swinging. As shown, the ball striking surface 110 occupies most of the face 112. The face 112 may include some curvature in the top to bottom and/or heel to toe directions (e.g., bulge and roll characteristics), and may also include functional face grooves, as is known and is conventional in the art. In other embodiments, the surface 110 may occupy a different proportion of the face 112, or the face member 128 may have multiple ball striking surfaces 110 thereon. In the embodiment shown in FIGS. 1-3, the ball striking surface 110 has little to no incline or loft angle, to cause the ball to roll when struck. In other embodiments, the ball striking surface 110 may have an incline or loft angle, to launch the ball on a trajectory, such as for a wood-type or iron-type club head. Additionally, the face 112 may have one or more internal or external inserts in some embodiments.

It is understood that the face member 128 and/or the hosel 109 can be formed as a single piece or as separate pieces that are joined together. In the embodiment shown in FIGS. 1-3, as well as the embodiments shown in FIGS. 4-25, the face member 128, including the face 112 and potentially the hosel 109, are formed of a single, integral piece. In other embodiments, the face member 128 may be formed of multiple pieces, such as by using an insert to form all or part of the face 112, or a separate body member or members connected behind the face 112. Such multiple pieces may be joined using an integral joining technique, such as welding, cementing, or adhesively joining, or other known techniques, including many mechanical joining techniques, such as releasable mechanical engagement techniques. Further, the hosel 109 may also be formed as a separate piece, which may be joined using these or other techniques, or may be connected to the weight member 130. In an exemplary embodiment, the face 112 may include a face insert that forms the ball striking surface 110 or a portion thereof, including inserts as described in U.S. Patent Application Publication 2010/0234127, which is incorporated by reference herein in its entirety and made part hereof. FIGS. 4A and 4B illustrate another example golf club head 1700 for use with a golf club, such as a putter, that includes a face insert 1707. The golf club head 1700 includes a front face 1704 including a ball striking surface 1706. In the arrangement of FIGS. 4A and 4B, at least a portion of the ball striking surface 1706 may be formed separately from the remainder of the front face 1704 and may comprise an insert 1707 configured to be received in a recess, such as recess 1709 shown in FIG. 4B, formed in the front face 1704 of the golf club head 1700.

In at least some examples, the insert 1707 may include a plate, such as a front plate portion 1720, into which grooves of various sizes, configurations, shapes, etc. may be machined or otherwise formed. In some examples, the plate 1720 may be between 1 mm and 4 mm thick and, in some examples, may be approximately 2 or 3 mm thick. As mentioned, the plate 1720 may include grooves 1715 formed therein. The grooves 1715 may, in some arrangements, extend completely through the plate 1720 (i.e., forming a through hole in the plate) or may extend partially through the plate 1720. Additionally or alternatively, the grooves 1715 may have a constant depth, width, height, etc. across the plate 1720. However, in some examples, the depth, width, height, etc. of one or more grooves 1715 may vary along the length of the groove 1715, along the plate 1720, and the like. Additionally or alternatively, the grooves 1715, or a portion thereof, may be arranged generally horizontally across the face of the golf club head 1700 when the club is in a ball address position. In other arrangements, the grooves 1715 may extend in a non-horizontal linear, circular, semi-circular, or other curved pattern on the face.

The plate 1720 may be formed of any suitable material, including metals such as aluminum, steel (e.g., stainless steel), titanium, nickel, beryllium, copper, combinations or alloys including these metals; polymers; and the like. Once the grooves 1715 are formed in the plate 1720, the plate 1720 may be pressed together ("co-molded") with a moldable, polymer material backing 1730, such as thermoplastic polyurethane or a thermoset material. In some examples, the polymer material 1730 in the final putter structure (once cured) may have a hardness range between 25 and 85 Shore D. In some specific examples, the polymer material backing 1730 may have a hardness range between 35 and 45 Shore D, 50 and 60 Shore D or 60 and 70 Shore D. Forcing the polymer material 1730 together with the front plate 1720 (for example, as indicated by arrows 1725) forms the insert 1707 (as shown in FIG. 4B) having polymer material filling the grooves 1715 formed in the plate 1720 to provide a ball striking surface having both metal and polymer contacting the ball. The surface of the polymer backing material 1730 may be pre-formed with projections 1732 to fit into grooves 1715, and/or the polymer material 1730 may be forced into the grooves 1715 during the pressing operation. If necessary or desired, the plate 1720 and polymer material 1730 may be held together using an adhesive or cement (e.g., double sided tape), mechanical connectors, fusing techniques (e.g., welding, soldering, or brazing), etc. This combination of metal and polymer materials on the ball striking face may provide improved performance of the golf club including softer feel, increased spin rate, more true roll, a more metallic ball striking sound, etc.

In some examples, during the pressing or co-molding process, the front surface of the plate 1720 (which will correspond to the face plate of the putter) may be held against a mold surface so that scorelines may be formed in the polymer material. Optionally, if desired, some portion of the scorelines may be cut into the metal portion of the grooves either before or after the co-molding or pressing process. Alternatively, if desired, the score lines may be cut into the polymer and/or metal of the plate after the insert 1707 has been made.

The insert 1707 may be engaged with a recess 1709 formed in the front face 1704 of the golf club head 1700 (as indicated by arrow 1740) in any desired manner. For instance, the recess 1709 may be milled or otherwise machined into the front face 1704 during manufacture, or it may simply be formed into the desired shape, e.g., during a molding, casting, forging, or other fabrication operation. The insert 1707 may be shaped to correspond to the shape of the recess 1709 and may be configured to be received in the recess 1709. The insert 1707 may be engaged with or connected to the recess 1709 and/or the golf club head 1700 in any desired manner, such as via adhesives and cements (e.g., double sided adhesive tape); via fusing techniques (e.g., welding, soldering, brazing, etc.); via mechanical fasteners or connectors (including releasable mechanical connectors); and the like. If desired, the insert 1707 may rest on a ledge or other structure defined in the recess 1709 (e.g., along the side, top, and/or bottom edges of the recess 1709).

In some examples, the insert 1707 may be removable to allow for customization and/or personalization of the insert 1707 and/or golf club head 1700. For instance, the insert 1707 may be releasably connected to the golf club head 1700 using mechanical connectors to secure the insert 1707 in the recess 1709 (e.g., screws, bolts or other connectors may extend from a rear side of the golf club head toward a front region of the golf club head to engage threaded regions provided on the insert 1707, it may be engaged from the bottom surface of the putter upward, it may be engaged from the top surface of the putter downward, etc.). Personalization and customization features may include various characteristics such as polymer and/or metal color (e.g., team colors, color associated with a cause or promotion, player preference, etc.); polymer and/or metal hardness (e.g., harder or softer for different play conditions or swing types); graphics on the polymer and/or metal (e.g., logos, etc.); etc.

In some arrangements, the metal plate 1720 may be replaced by a plate formed of a polymer of a different hardness from the backing material polymer 1730, thereby forming an insert 1707 of all polymer. For instance, the metal plate 1720 may be replaced with a plate formed of a polymer material having a higher Shore D hardness value than the polymer 1730 filling the grooves 1715 of the insert 1707. This all polymer insert may aid in further reducing weight associated with the golf club head 1700. Additionally or alternatively, the polymer material 1730 may be replaced with a metal of a different hardness from the original metal, thereby forming an insert of all metal.

If desired, the rear surface of recess 1709 may be formed to include a polymer or other material to provide a consistent backing or base against which insert 1707 is mounted. As another alternative, if desired, the material of the polymer backing layer 1730 may be included in the recess 1709 and the club head may be formed by pressing plate 1720 against the polymer backing material 1730 in the recess 1709 to force the polymer material 1730 into the grooves of the plate 1720. If necessary, one or more overflow holes may be provided to allow any excess polymer material 1730 to escape from the club head during the pressing operation.

In some examples, the polymer included in the recess 1709 may be a material different from the polymer material filling the grooves 1715 of the insert 1707. For instance, polymers of different Shore hardness values may be used for the polymer in the recess 1709 and the polymer filling the grooves 1715. In some examples, the polymer filling the grooves 1715 may have a higher Shore hardness than the polymer in the recess 1709. The harder polymer in the grooves 1715 may aid in creating top spin on the ball while the softer polymer in the recess may aid in providing a soft "feel" for the putter.

The ball striking device 100 may include a shaft 104 connected to or otherwise engaged with the ball striking head 102, as shown in FIG. 1. The shaft 104 is adapted to be gripped by a user to swing the ball striking device 100 to strike the ball. The shaft 104 can be formed as a separate piece connected to the head 102, such as by connecting to the hosel 109, as described above. In other embodiments, at least a portion of the shaft 104 may be an integral piece with the head 102, and/or the head 102 may not contain a hosel 109 or may contain an internal hosel structure. Still further embodiments are contemplated without departing from the scope of the invention. The shaft 104 may be constructed from one or more of a variety of materials, including metals, ceramics, polymers, composites, or wood. In some exemplary embodiments, the shaft 104, or at least portions thereof, may be constructed of a metal, such as stainless steel, or a composite, such as a carbon/graphite fiber-polymer composite. However, it is contemplated that the shaft 104 may be constructed of different materials without departing from the scope of the invention, including conventional materials that are known and used in the art.

In general, the head 102 of the ball striking device 100 has a weight member 130 connected to the face member 128 at the rear side 126 of the face member 128. In the embodiment shown in FIGS. 1-3, the rear side 126 of the face member 128 has a rear surface 131 opposite the striking surface 110, and the weight member 130 has a front surface 135 that faces and confronts the rear surface 131 of the face member 128. In general, the weight member 130 is configured to transfer energy and/or momentum to the face member 128 upon impact of the ball on the striking surface 110, including an off-center impact. The weight member 130 may be connected to the face member 128 in a number of different configurations that permit energy and/or momentum transfer between the weight member 130 and the face member 128, several of which are described below and shown in the FIGS. In other embodiments, the weight member 130 may be differently configured, and/or the head 102 may contain multiple weight members 130. For example, the weight member 130 as shown in FIGS. 1-3 may be divided into two, three, or more separate weight members 130 in another embodiment, which may be connected to the face member 128 in similar or different configurations. It is understood that the weight member 130 in all embodiments may affect or influence the center of gravity of the head 102. Additionally, the weight member 130 (and other weight members described herein) may be made of any of a variety of different materials, which may be selected based on their weight or density. For example, the weight member 130 may be made from a metallic material such as stainless steel and/or tungsten, or may be made from other materials, for example polymers that may be doped with a heavier material (e.g. tungsten). The weight member 130 may also include portions that may be more heavily weighted than others, and may include weighted inserts or other inserts.

In the embodiment of FIGS. 1-3, the weight member 130 is connected to the face member 128 by a resilient member 140 at least partially formed of a resilient material. In this embodiment, the resilient member 140 forms the only connection between the weight member 130 and the face member 128, and the weight member 130 may be considered to be suspended with respect to the face member 128 by the resilient member 140 in this configuration. It is understood that an adhesive or other bonding material may be utilized to connect the resilient member 140 to the face member 128 and/or the weight member 130, and that other connection techniques may be used in other embodiments, such as mechanical fasteners, interlocking designs (e.g. dovetail, tab and slot, etc.) and others. The resilient material of the resilient member 140 may be a natural or synthetic rubber material, a polyurethane-based elastomer, or other elastomeric material in one embodiment, but may be a different type of resilient material in another embodiment, including various types of resilient polymers, such as foam materials or other rubber-like materials. Additionally, the resilient member 140 may have at least some degree of resiliency, such that the resilient member 140 exerts a response force when compressed, and can return to its previous state following compression. The resilient member 140 may have a strength or hardness that is lower than, and may be significantly lower than, the strength/hardness of the material of the face member 128 and/or the weight member 130. In one embodiment, the resilient member 140 may have a hardness of from 30-90 Shore A or approximately 30-90 Shore A. In another embodiment, the resilient member 140 may have a hardness of approximately 60-70 Shore A. The hardness may be determined, for example, by using ASTM D-2240 or another applicable test with a Shore durometer. In an example embodiment, the resilient member 140 may be formed of a polyurethane-based elastomer with a hardness of approximately 65 Shore A. Further, in one embodiment, the resilient material may have compression properties (based on a 0.56 shape factor and determined using ASTM D-575) as follows: 30 psi for 5% deflection, 70 psi for 10% deflection, 110 psi for 15% deflection, 160 psi for 20% deflection, and 220 psi for 25% deflection.

The properties of the resilient material, such as hardness and/or resiliency, may be designed for use in a specific configuration. For example, the hardness and/or resiliency of the resilient member 140 may be designed to ensure that an appropriate rebound or reaction force is transferred to the face, which may be influenced by parameters such as material thickness, mass of various components (including the weight member 130 and/or the face member 128), intended use of the head 102, and others. The hardness and resiliency may be through techniques such as material selection and any of a variety of treatments performed on the material that can affect the hardness or resiliency of the resilient material, as discussed elsewhere herein. The hardness and thickness of the resilient material may be tuned to the weight of a particular weight member 130. For example, heavier weights may require harder resilient materials, and lighter weights may require softer resilient materials. Using a thinner resilient member 140 may also necessitate the use of a softer resilient material, and thicker resilient members 140 may be usable with harder resilient materials. In a configuration where the resilient material is a polyurethane-based material having a hardness of approximately 65 Shore A, the resilient member 140 may have a thickness between the weight member 130 and the rear surface 131 of the face member 128 of approximately 5 mm in one embodiment, or approximately 3 mm in another embodiment.

In the embodiment shown in FIGS. 1-3, the resilient member 140 may be formed as a single, integral piece; however the resilient member 140 may be formed of separate pieces in various embodiments. The resilient member 140 may be formed of multiple components as well, including components having different hardness in different regions of the resilient member 140, including different hardness distributions. For example, the resilient member 140 may be formed of an exterior shell that has a different (higher or lower) hardness than the interior of the resilient member 140, such as through being made of a different material (e.g. through co-molding) and/or being treated using a technique to achieve a different hardness. Examples of techniques for achieving a shell with a different hardness include plasma or corona treatment, adhesively bonding a film to the exterior, coating the exterior (such as by spraying or dipping). In the case of a cast or other polyurethane-based resilient material, the resilient material may have a thermoplastic polyurethane (TPU) film bonded to the exterior, a higher or lower hardness polyurethane coating applied by spraying or dipping, or another polymer coating (e.g. a thermoset polymer), which may be applied, for example, by dipping the resilient material into an appropriate polymer solution with an appropriate solvent. Additionally, the resilient member 140 may have different hardness or compressibility in different lateral or vertical portions of the resilient member 140, which can create different energy and/or momentum transfer effects in different locations. For example, the resilient member 140 may have a higher or lower hardness in proximate the heel 120 and/or the toe 122 of the face member 128, which may be achieved by techniques described herein, such as treatments or use of different materials and/or separate pieces. In this configuration, the hardness of the resilient member 140 may be customized for use by a particular golfer or a particular golfer's hitting pattern. Similarly, an asymmetrical resilient member 140 may also be used to create different energy and/or momentum transfer effects, by providing a larger or smaller amount of material at specific portions of the face member 128. Such an asymmetrical resilient member 140 may also be used to provide customizability. A variable-hardness or asymmetrical resilient member 140 may also be used in conjunction with an offset connection point, as discussed below, for further customizability. Other embodiments described herein may also employ a resilient member that has a variable hardness or asymmetrical features. A single-component or multi-component resilient member 140 may be manufactured by co-molding, and may be co-molded in connection with the face member 128 and/or the weight member 130.

As seen in FIGS. 1-3, the resilient member 140 is connected between the weight member 130 and the face member 128. In one embodiment, the weight member 130 has at least one surface that is engaged by the resilient member 140 and at least one other surface that is exposed and not engaged by the resilient member 140. In the embodiment of FIGS. 1-3, the front surface 135 of the weight member 130 is engaged by the resilient member 140, and the top side 143, the bottom side 144, and rear side 145 of the weight member 130 are exposed and not engaged by the resilient member 140. As shown in FIG. 3, the resilient member 140 connects the rear surface 131 on the rear side 126 of the face member 128 and the front surface 135 of the weight member 130. The weight member 130 is spaced from the face member 128, and the resilient member 140 at least partially fills the spaces 142 between the front surface 135 of the weight member 130 and the rear side 126 of the face member 128. The resilient member 140 may be positioned on both opposite lateral sides of the center of gravity (CG) of the face member 128. In one embodiment, as shown in FIG. 2, the resilient member 140 completely or substantially completely fills the spaces 142 between the weight member 130 and the face member 128. In another embodiment, the resilient member 140 may be positioned at least between the heel edges 120, 136 and between the toe edges 122, 137 of the face member 128 and the weight member 130. In a further embodiment, the head 102 of FIGS. 1-3 may have a resilient member 140 that partially fills the spaces 142 between the face member 128 and the weight member 130, such as in the configuration shown in FIG. 11.

The weight member 130 may have various different dimensions and structural properties in various embodiments. In the embodiment shown in FIGS. 1-3, the weight member 130 has a heel edge 136 and a toe edge 137, with a lateral width defined between the heel and toe edges 136, 137. The lateral width of the weight member 130 is the same or approximately the same as the lateral width of the face member 128, measured between the heel 120 and toe 122 of the face member 128. Additionally, the weight member 130 has its mass distributed proportionally more toward the heel and toe edges 136, 137, and has a thickness and a cross-sectional area that are greater at or around the heel and toe edges 136, 137 than at the CG of the weight member 130. Further, the weight member 130 may be positioned so that the CG of the weight member 130 is substantially aligned with the CG of the face member 128. In one embodiment, the CGs of the weight member 130 and the face member 128 are laterally aligned, and these respective CGs may additionally or alternately be vertically aligned in another embodiment. In the embodiment shown in FIGS. 1-3, the face member 128 has alignment indicia 139 that may be aligned with the CG of the face member 128 and/or the CG of the weight member 130, however this indicia 139 may be absent or differently located in other embodiments.

The weight member 130 may have varying sizes in different embodiments. For example, in one embodiment, the weight member 130 may make up about 25% or more of the total weight of the head 102. In an example embodiment, the total weight of the head 102 may be about 340 g, with the weight member having a weight of about 100 g. In additional example embodiment, the total weight of the head 102 may be about 290-390 g, or may be about 170-510 g, with the weight member 130 having a weight of 50-150 g in these embodiments.

The weight member 130 may be configured such that energy and/or momentum can be transferred between the weight member 130 and the face member 128 during impact, including an off-center impact on the striking surface 110. The resilient member 140 can serve to transfer energy and/or momentum between the weight member 130 and the face member 128 during impact. Additionally, the weight member 130 may also be configured to resist deflection of the face member 128 upon impact of the ball on the striking surface 110. The resiliency and compression of the resilient member 140 permits this transfer of energy and/or momentum from the weight member 130 to the face member 128. As described above, the momentum of the weight member 130 compresses the resilient member 140, and causes the resilient member 140 to exert a response force on the face member 128 to achieve this transfer of momentum. The resilient member 140 may exert at least a portion of the response force on the face member 128 through expansion after the compression. The weight member 130 may deflect slightly toward the impact point to compress the resilient member 140 in the process of this momentum transfer. The actions achieving the transfer of momentum occur between the beginning and the end of the impact, which in one embodiment of a golf putter may be between 4-5 ms. In the embodiment as shown in FIGS. 1-3, the weight member 130 may transfer a greater or smaller amount of energy and/or momentum depending on the location of the impact on the striking surface 110. For example, in this embodiment, upon an off-center impact of the ball centered on the heel side (i.e. toward the heel edge 117) of the face 112, the heel 120 of the face member 128 tends to deflect rearwardly. As another example, upon an off-center impact of the ball centered on the toe side (i.e. toward the toe edge 119) of the face 112, the toe 122 of the face member 128 tends to deflect rearwardly. As the heel 120 or toe 122 of the face member 128 begins to deflect rearwardly, at least some of the forward momentum of the weight member 130 is transferred to the face member 128 during impact to resist this deflection. In the embodiment of FIGS. 1-3, on a heel-side impact, at least some of the momentum transferred to the face member 128 may be transferred from the heel edge 136 of the weight member 130 during impact. Likewise, on a toe-side impact, at least some of the momentum transferred to the face member 128 may be transferred from the toe edge 137 of the weight member 130 during impact. Generally, at least some of the momentum is transferred toward the impact point on the face 112.

The resilient member 140 can function to transfer the energy and/or momentum of the weight member 130 to the heel 120 or toe 122 of the face member 128. In the process of transferring energy and/or momentum during impact, the resilient member 140 may be compressed by the momentum of the weight member 130 and expand to exert a response force on the face member 128, which resists deflection of the face member 128 as described above. It is understood that the degree of potential moment causing deflection of the face member 128 may increase as the impact location diverges from the center of gravity of the face member 128. In one embodiment, the energy and/or momentum transfer from the weight member 130 to the face member 128 may also increase as the impact location diverges from the center of gravity of the face member 128, to provide increased resistance to such deflection of the face member 128. In other words, the energy and/or momentum transferred from the weight member 130 to the face member 128, and the force exerted on the face member 128 by the weight member 130, through the resilient member 140, may be incremental and directly relative/proportional to the distance the impact is made from the optimal impact point (e.g. the lateral centerpoint of the striking surface 110 and/or the CG of the face member 128, in exemplary embodiments). Thus, the head 102 will transfer the energy and/or momentum of the weight member 130 incrementally in the direction in which the ball makes contact away from the center of gravity of the head 102, via the weight member 130 suspended by the resilient member 140. The transfer of energy and/or momentum between the weight member 130 and the face member 128 can reduce the degree of twisting of the face 112 and keep the face 112 more square upon impacts, including off-center impacts. Additionally, the transfer of energy and/or momentum between the weight member 130 and the face member 128 can minimize energy loss on off-center impacts, resulting in more consistent ball distance on impacts anywhere on the face 112. The resilient member 140 may have some elasticity or response force that assists in transferring energy and/or momentum between the weight member 130 and the face member 128. In other embodiments, as described below with respect to FIGS. 26-29, the weight member 130 may additionally or alternately be configured to transfer energy and/or momentum to the face member 128 as a result of impacts that are higher or lower than the center of the face 112 and/or the CG of the face member 128.

Figure 4:
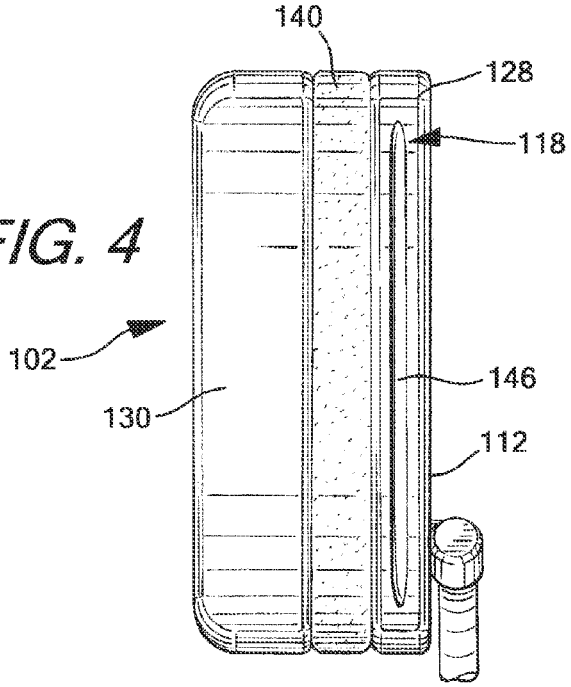
FIG. 4 is a bottom view of an alternate embodiment of the device of FIG. 1.
Figures 4A, 4B:
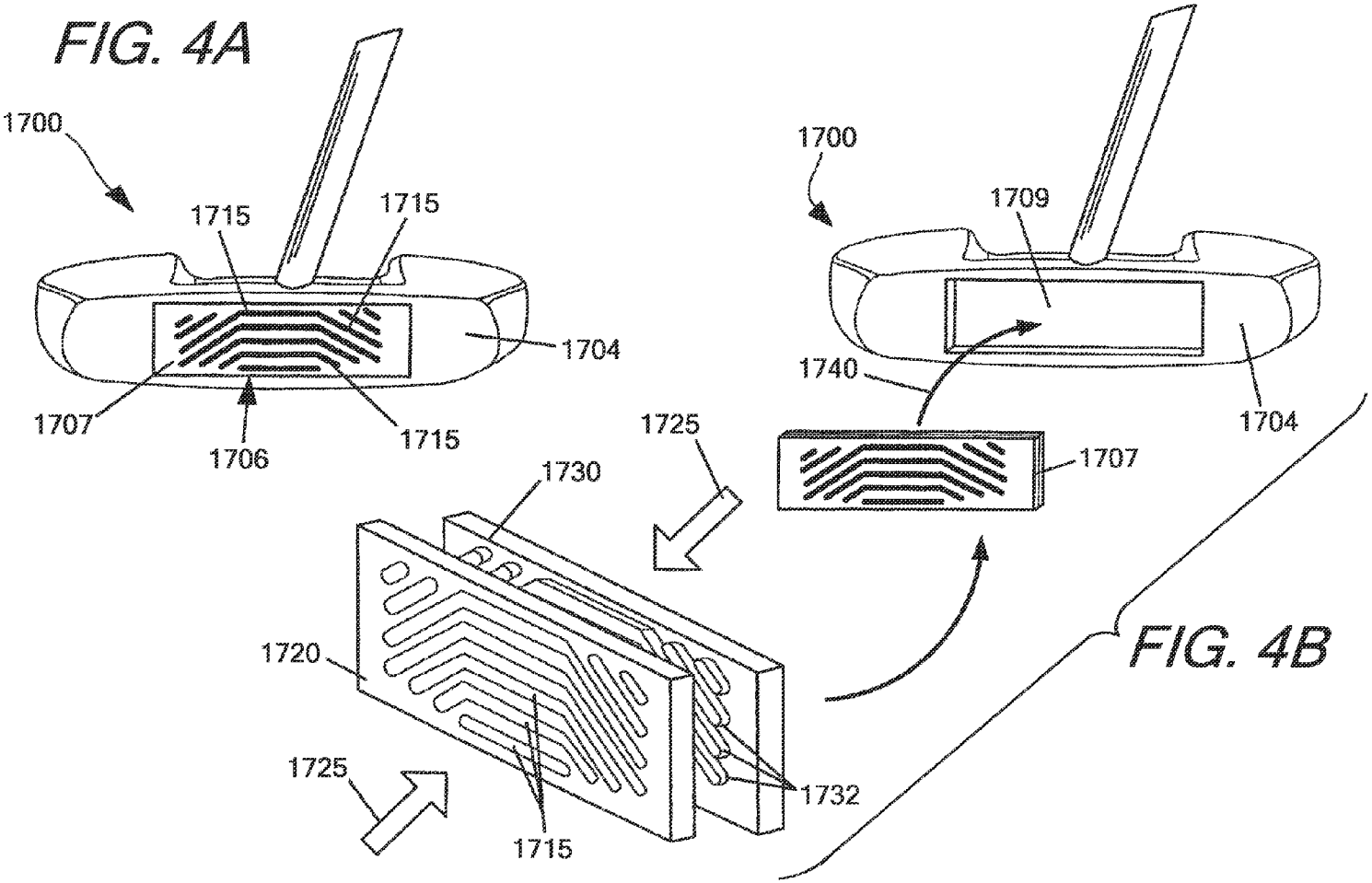
FIGS. 4A and 4B illustrate an alternate arrangement of a ball striking device as shown in FIGS. 1-3, having a ball striking face insert formed at least partially from a polymer material.

The face member 128 of FIGS. 1-3 may include a channel 146 on the sole 118 in another embodiment, as shown in FIG. 4. In this embodiment, the channel 146 is recessed inwardly into the face member 128, and extends laterally along the sole 118 in the heel-to-toe direction. Additionally, the channel 146 is parallel or substantially parallel to the bottom edge 115 of the face 112. The channel 146 may improve energy and velocity transfer to the ball on off-center impacts, as well as other benefits, as described in U.S. patent application Ser. No. 13/015,264, filed Jan. 27, 2011; U.S. patent application Ser. No. 13/015,412, filed Jan. 27, 2011; and U.S. patent application Ser. No. 12/842,650, filed Jul. 23, 2010, which are incorporated by reference herein in their entireties and made parts hereof. In another embodiment, the channel 146 may have a different configuration.

Figure 5:
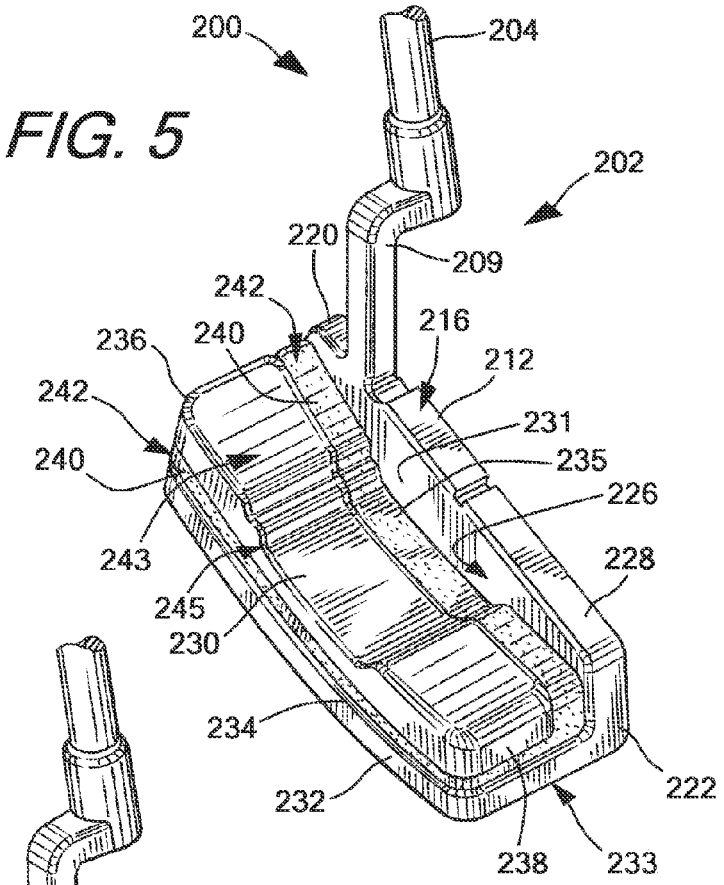
FIG. 5 is a rear perspective view of another embodiment of a ball striking device according to aspects of the present invention, in the form of a golf putter.
Figure 6:
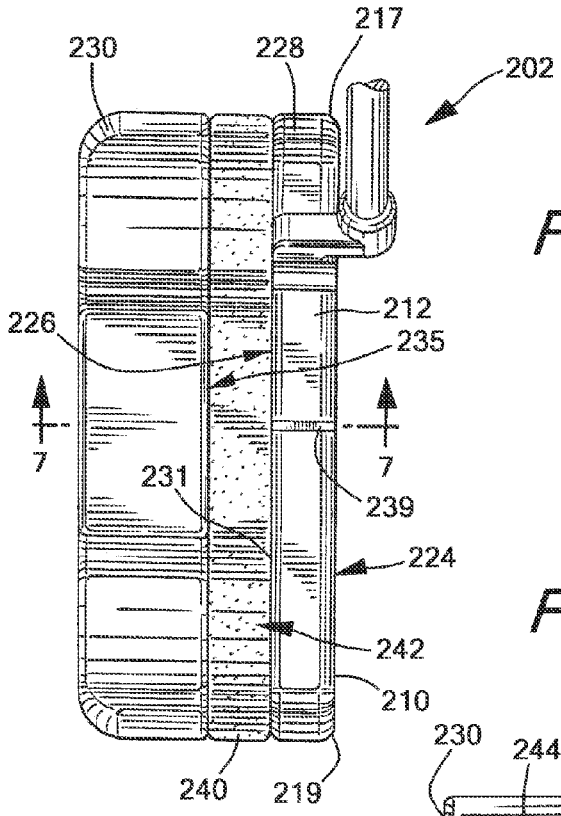
FIG. 6 is a top view of the device of FIG. 5.
Figure 7A:
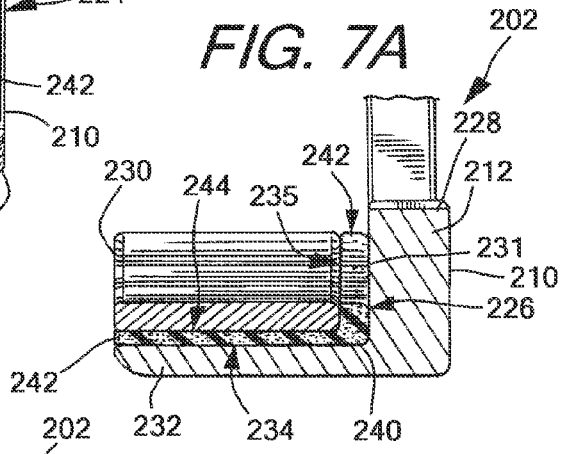
FIG. 7A is a cross-section view of an alternate embodiment of the ball striking device as shown in FIG. 7.
Figure 7:
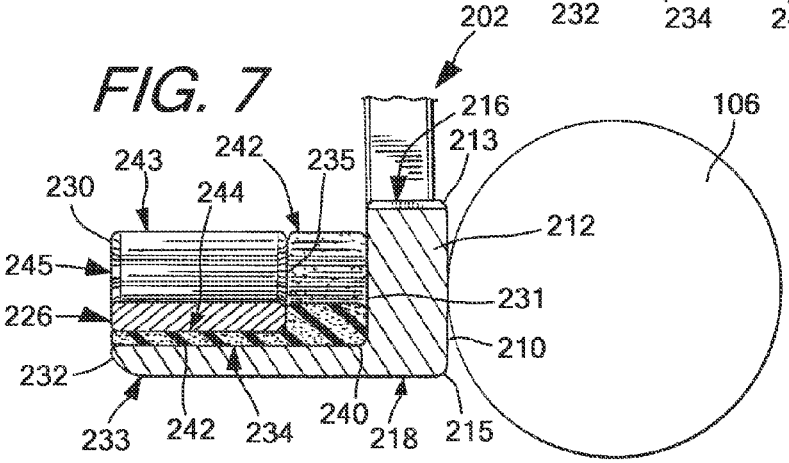
FIG. 7 is a cross-section view taken along lines 7-7 of FIG. 6.
Figure 8:
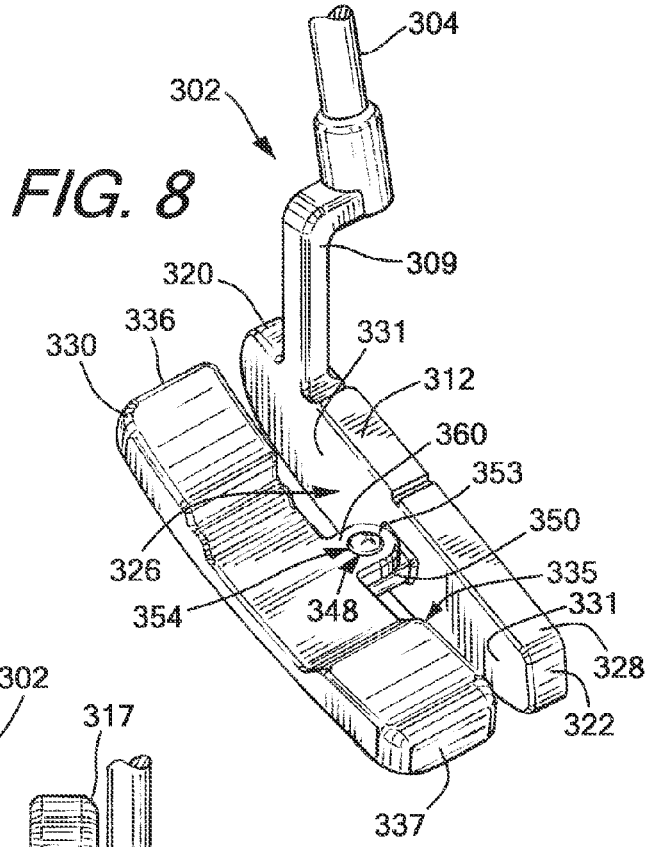
FIG. 8 is a rear perspective view of another embodiment of a ball striking device according to aspects of the present invention, in the form of a golf putter.
Figure 9:
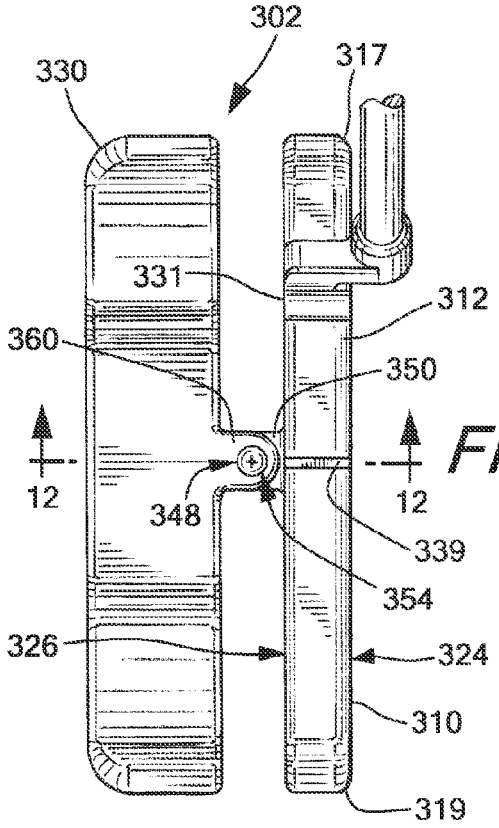
FIG. 9 is a top view of the device of FIG. 8.

FIGS. 5-7 illustrate another embodiment of a ball striking head 202, which contains many components and features that are similar to the features described above with respect to the head 102 of FIGS. 1-3. Such similar components of the head 202 are referred to by similar reference numbers in the description below, using the "2xx" series of reference numbers. Description of some such components that have already been described above may be simplified or eliminated for the sake of brevity in the description below.

In the embodiment shown in FIGS. 5-7, the rear side 226 of the face member 228 has a rear surface 231 opposite the striking surface 210 and a sole member 232 extending rearwardly from the face 212, to form a substantially L-shaped structure. The sole member 232 has a bottom or sole surface 233 that is configured to confront a playing surface in use and a top surface 234 opposite the sole surface 233. The weight member 230 has a front surface 235 that faces and confronts the rear surface 231 of the face member 228 and a bottom surface 244 that faces and confronts the top surface 234 of the sole member 232. In general, the weight member 230 is configured to transfer energy and/or momentum to the face member 228 upon impact of the ball on the striking surface 210, to resist deflection of the face member 228, as similarly described above with respect to the head 102 of FIGS. 1-3. The weight member 230 may be connected to the face member 228 in a number of different configurations that permit energy and/or momentum transfer between the weight member 230 and the face member 228. The face member 228 may include a channel similar to the channel 146 on the face member 128 shown in FIG. 4.

In the embodiment of FIGS. 5-7, the weight member 230 is connected to the face member 228 by a resilient member 240 at least partially formed of a resilient material, as described above with respect to the resilient member 140 of the head 102 of FIGS. 1-3. Like the head 102 of FIGS. 1-3, in this embodiment, the resilient member 240 forms the only connection between the weight member 230 and the face member 228, and the weight member 230 may be considered to be suspended with respect to the face member 228 by the resilient member 240 in this configuration. It is understood that any connection techniques mentioned above, including an adhesive or other bonding material or mechanical connection, may be utilized to connect the resilient member 240 to the face member 228 and/or the weight member 230.

Figure 5A:
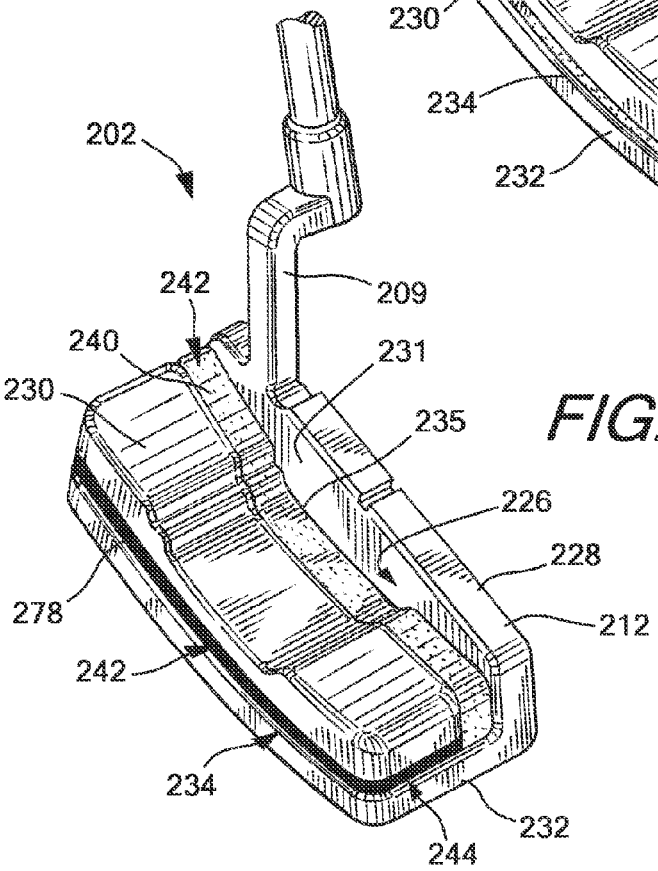
FIG. 5A is a rear perspective view of an alternate embodiment of the ball striking device as shown in FIG. 5.

As seen in FIG. 7, the resilient member 240 is connected between the weight member 230 and the face member 128. In this embodiment, the front surface 235 and the bottom surface 244 of the weight member 230 are engaged by the resilient member 240, and the top side 243 and rear side 245 of the weight member 230 are exposed and not engaged by the resilient member 240. As shown in FIG. 7, the resilient member 240 connects the front surface 235 of the weight member 230 with the rear surface 231 on the rear side 226 of the face member 228, and also connects the bottom surface 244 of the weight member with the top surface 234 of the sole member 232 on the rear side 226 of the face member 228. The weight member 230 is spaced from the face member 228, and the resilient member 240 at least partially fills the spaces 242 between the front surface 235 and the bottom surface 244 of the weight member 230 and the rear side 226 of the face member 228, as described above. Portions of the resilient member 240 supporting the bottom surface 244 of the weight member 230 may be considered supporting pad members. The resilient member 240 may be positioned on both opposite lateral sides of the center of gravity (CG) of the face member 228. In one embodiment, as shown in FIG. 5, the resilient member 240 completely or substantially completely fills the spaces 242 between the weight member 230 and the face member 228. In another embodiment, the head 202 of FIGS. 5-7 may have a resilient member 240 that partially fills the spaces 242 between the face member 228 and the weight member 230, such as in the configuration shown in FIG. 21. In a further embodiment, the resilient member 240 may be positioned only between the bottom surface 244 of the weight member 230 and the top surface 234 of the sole member 232, or only between the front surface 235 of the weight member 230 and the rear surface 232 of the face member 228. In one embodiment, illustrated in FIG. 5A, the resilient member 240 is positioned between the front surface 235 of the weight member 230 and the rear surface 232 of the face member 228. In this embodiment, a low-friction material 278, such as a Teflon tape, a hard polymer material or other low-friction member, may be positioned between the bottom surface 244 of the weight member 230 and the top surface 234 of the sole member 232, as shown in FIG. 5A. This low-friction material may be connected to the bottom surface 244 of the weight member 230 or the top surface 234 of the sole member 232, and may be applied as a coating and/or using an adhesive or other bonding material. Alternately, some or all of the space 242 between the bottom surface 244 of the weight member 230 and the top surface 234 of the sole member 232 may be empty.

The weight member 230 may have various different dimensions and structural properties in various embodiments. In the embodiment shown in FIGS. 5-7, the lateral width of the weight member 230 (between the heel and toe edges 236, 237) is the same or approximately the same as the lateral width of the face member 228. Additionally, the weight member 230 has its mass distributed proportionally more toward the heel and toe edges 236, 237, and has a thickness and a cross-sectional area that are greater at or around the heel and toe edges 236, 237 than at the CG of the weight member 230. Further, the weight member 230 may be positioned so that the CG of the weight member 230 is substantially aligned with the CG of the face member 228. In one embodiment, the CGs of the weight member 230 and the face member 228 are laterally aligned, and these respective CGs may additionally or alternately be vertically aligned in another embodiment. The face member 228 may include alignment indicia 239 that may be aligned with the CG of the face member 228 and/or the CG of the weight member 230. In an additional embodiment, the weight member 230 may have a total weight or a weight relative to the total weight of the head 202 as described above with respect to the head 102 of FIGS. 1-3.

As similarly described above with respect to the head 102 of FIGS. 1-3, the weight member 230 may be configured to absorb at least some of the energy created by an impact on the striking surface 210, including an off-center impact on the striking surface 210. The resilient member 240 can serve to transfer energy and/or momentum between the weight member 230 and the face member 228, as described above. The resiliency and/or compression of the resilient member 240 assists with this energy and/or momentum transfer, as described above.

FIG. 7A illustrates an alternate embodiment of the head 202 as shown in FIGS. 5-7. In the embodiment of FIG. 7A, the portion of the resilient member 240 between the rear surface 231 of the face member 228 and the front surface 235 of the weight member 230 is thinner, providing less space between the weight member 230 and the face member 228. The thinner resilient member 240 may be usable with resilient members 240 that have different degrees of hardness than the resilient members 140, 240 as described above. This embodiment may also reduce the visibility of the resilient member 240 from the perspective of the user swinging the head 202, which may be desirable for some users, particularly if the resilient member 240 has a color contrast from the other portions of the head 202. In a further embodiment the face member 228 may have an arm, flange, or other covering that extends toward the weight member 230 to at least partially conceal the resilient member 240 and achieve the function of concealment. The weight member 230 may additionally or alternately contain a flange or similar structure to provide the same function in another embodiment. It is understood that in these embodiments, because the dimensions of the resilient member 240 are different, the hardness of the resilient member 240 may be adjusted to provide the desired energy and/or momentum transfer effects. The principles of FIG. 7A may be applied to other embodiments herein as well.

FIGS. 8-22 illustrate additional embodiments of ball striking heads 302, 402, 502 that are similar to the heads 102, 202 described above and further include connection members 350, 360, 450, 460, 550, 560 connecting the face member 328, 428, 528 to the weight member 330, 430, 530. The embodiments in FIGS. 8-22 contain many components and features that are similar to the features described above with respect to the heads 102, 202 of FIGS. 1-3 and 5-7. Such similar components of the heads 302, 402, 502 are referred to by similar reference numbers in the description below, using the "3xx," "4xx," and "5xx" series of reference numbers, respectively. Description of some such components that have already been described above may be simplified or eliminated for the sake of brevity in the description below. Various connection configurations between the face members 328, 428, 528 and the weight members 330, 430, 530 are shown in FIGS. 8-22. It is understood that in other embodiments, different types of connections between the face members 328, 428, 528 and the weight members 330, 430, 530 may be used, including any of the connection configurations shown in FIGS. 26-41.

FIGS. 8-12 illustrate an embodiment of a ball striking head 302 that has a structure similar to the head 102 described above and shown in FIGS. 1-3. In the embodiment of FIGS. 8-12, the face member 328 and the weight member 330 are connected by a connection or connection point 348 formed by connection members 350, 360 connected to the face member 328 and the weight member 330, respectively. The structures of the face member 328 and the weight member 330 are otherwise substantially the same as the structures of the face member 128 and the weight member 130 of the head 102 of FIGS. 1-3, and such structures are not described again herein for the sake of brevity.

In the embodiment of FIGS. 8-12, the face member 328 includes a connection member 350 that is formed by an arm 351 extending rearward from the rear side 326 or rear surface 331 of the face member 328, with a pin 352 extending upward from the arm 351. The weight member 330 has another connection member 360 that is formed by an arm 361 extending forward from the front surface 335 of the weight member, with a receiver 362 formed in the arm 361. The receiver 362 is configured to receive the pin 352 therein to connect the connection members 350, 360 together to form the connection point 348. In this embodiment, a fastener (such as a screw) 353 is also used to secure the connection between the connection members 350, 360. In another embodiment, a different type of fastener may be used, or no fastener may be used. Additionally, in other embodiments, the arrangement of the pin 352 and the receiver 362 may be transposed, such that the connection member 350 of the face member 328 has the receiver 362, and the connection member 360 of the weight member 330 has the pin 352. In other words, one of the connection members 350, 360 includes the pin 352 and the other of the connection members 350, 360 includes the receiver 362, in one embodiment. Other connection configurations may also be used, including the connections illustrated in FIGS. 14-22 and 26-41. The connection members 350, 360 in this embodiment form a joint 354 at the connection point 348. This joint 354 permits, or at least does not inhibit, transfer of energy and/or momentum between the weight member 330 and the face member 328, as described above with respect to the heads 102, 202 of FIGS. 1-3 and 5-7. It is understood that the joint 354 may include a washer or tensioning member that can be used to control or adjust the tension of the joint 354, to affect the degree of energy and/or momentum transfer upon impact. The connection members 350, 360 can serve to transfer momentum, including angular momentum, of the weight member 330 to the face member 328 in this embodiment.

In this embodiment, the CG of the weight member 330 and the CG of the face member 328 may be aligned vertically, laterally, or both. In one embodiment, the connection members 350, 360 may be directly aligned with the CG of the weight member 330 and/or the CG of the face member 328. In another embodiment, the connection members 350, 360 may be aligned with the vertical or lateral plane of the CG of the weight member 330 and/or the CG of the face member 328. Additionally, the first and second connection members 350, 360 in this embodiment are located approximately equidistant from the heel and toe edges 320, 322 of the face member 328 and approximately equidistant from the heel and toe edges 336, 337 of the weight member 330. The face member 328 may include alignment indicia 339 that may be aligned with the CG of the face member 328, the CG of the weight member 330, and/or one or both of the connection members 350, 360. In an additional embodiment, the weight member 330 may have a total weight or a weight relative to the total weight of the head 302 as described above with respect to the head 102 of FIGS. 1-3.

In another embodiment, the head 302 of FIGS. 8-12 may have the first and second connection members 350, 360 and the connection point 348 offset from the CG of the face member 328. For example, the connection point 348 may be laterally offset toward the heel 320 or the toe 322 of the face member 328 in one embodiment. This offset may create different energy and/or momentum transfer effects on different impact locations on the face 312. Additionally, the offset may be utilized to customize the performance of the head 302 for a particular user, by providing energy and/or momentum transfer effects that correspond to the particular user's hitting pattern. As described above, a resilient member 340 that has a variable hardness or an asymmetrical configuration may be used to provide further customizability in connection with an offset connection point 348. Other embodiments described herein may similarly utilize an offset connection point 348.

Figure 10:
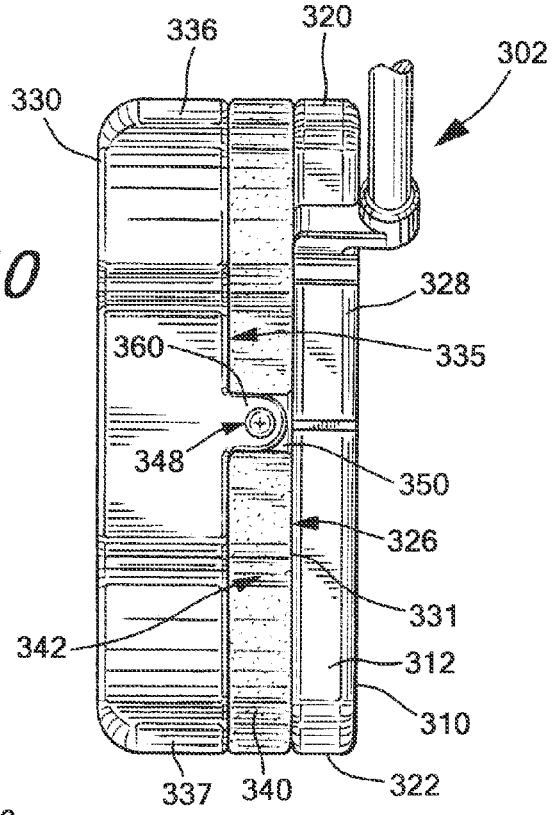
FIG. 10 is a top view of the device of FIG. 8, with a resilient member contained between a face member and a weight member of the device, in one configuration.
Figure 11:
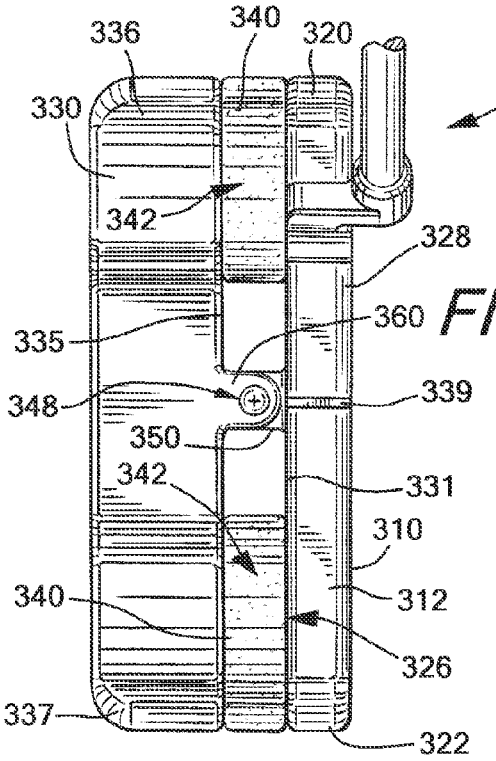
FIG. 11 is a top view of the device of FIG. 8, with a resilient member contained between the face member and the weight member of the device, in another configuration.
Figure 12:
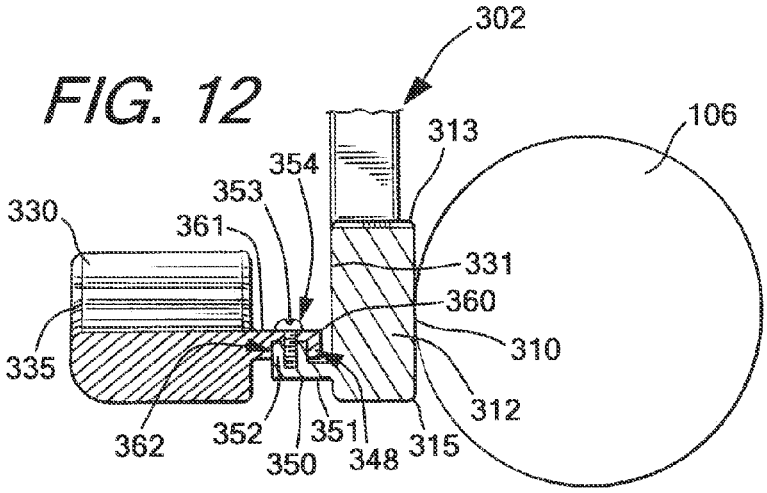
FIG. 12 is a cross-section view taken along lines 11-11 of FIG. 9.

The head 302 of FIGS. 8-12 may also include a resilient member 340 formed at least partially of a resilient material, as illustrated in FIGS. 10-11, with any configurations or properties of the resilient members 140, 240, as described above. As shown in FIGS. 8-12, in these embodiments, the weight member 330 is spaced from the face member 328 between the first and second connection members 350, 360 and the heel and toe edges 320, 322 of the face member 328 and between the first and second connection members 350, 360 and the heel and toe edges 336, 337 of the weight member 330, forming spaces 342. In these embodiments, the resilient member 340 at least partially fills the spaces 342 between the weight member 330 and the face member 328, and at least part of the resilient member 340 is included on both sides of the CG of the face member 328 and/or the CG of the weight member 330. FIG. 10 illustrates one embodiment, where the resilient member 340 completely fills the spaces 342 between the front surface 335 of the weight member 330 and the rear side 326 of the face member 328. FIG. 11 illustrates another embodiment, where the resilient member 340 partially fills the spaces 342 between the front surface 335 of the weight member 330 and the rear side 326 of the face member 328. Further configurations are contemplated.

In the embodiments of FIGS. 10-11, the connection members 350, 360 may serve to provide structural stability in the connection between the weight member 330 and the face member 328. As one example, the connection members 350, 360 may serve a connection and/or registration/location function for the face member 328 and the weight member 330 during manufacturing and assembly, to allow the resilient member 330 to be formed in place with the face member 328 and the weight member 330 in their proper locations (see, e.g., FIGS. 22C-D). The resilient member 330 may be formed between the face member 328 and the weight member 330 using methods such as molding, injection, etc. In one embodiment, the material of the resilient member 330 is inserted between the face member 328 and the weight member 330 in liquid form and subsequently forms a solid, such as through solidification, polymerization, or other mechanism. In this embodiment, the connection members 350, 360 may or may not serve a structural function after complete assembly, and in one embodiment, the connection members 350, 360 may combine with the resilient member 340 to provide structural stability to the head 302 after assembly.

Figure 13:
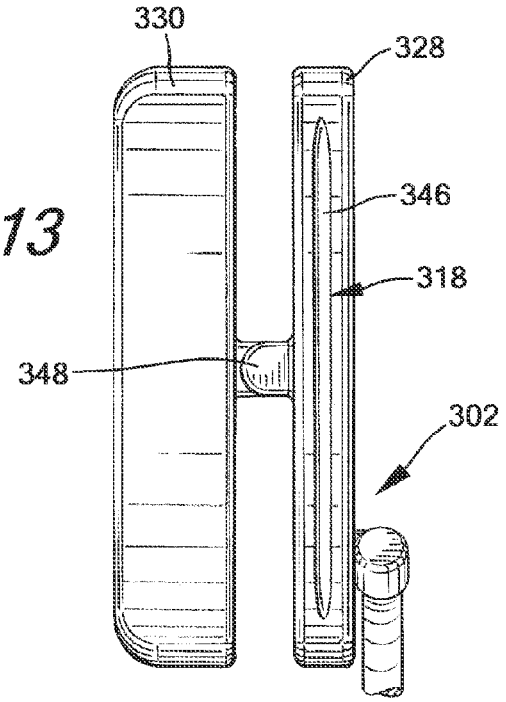
FIG. 13 is a bottom view of an alternate embodiment of the device of FIG. 8.
Figure 14:
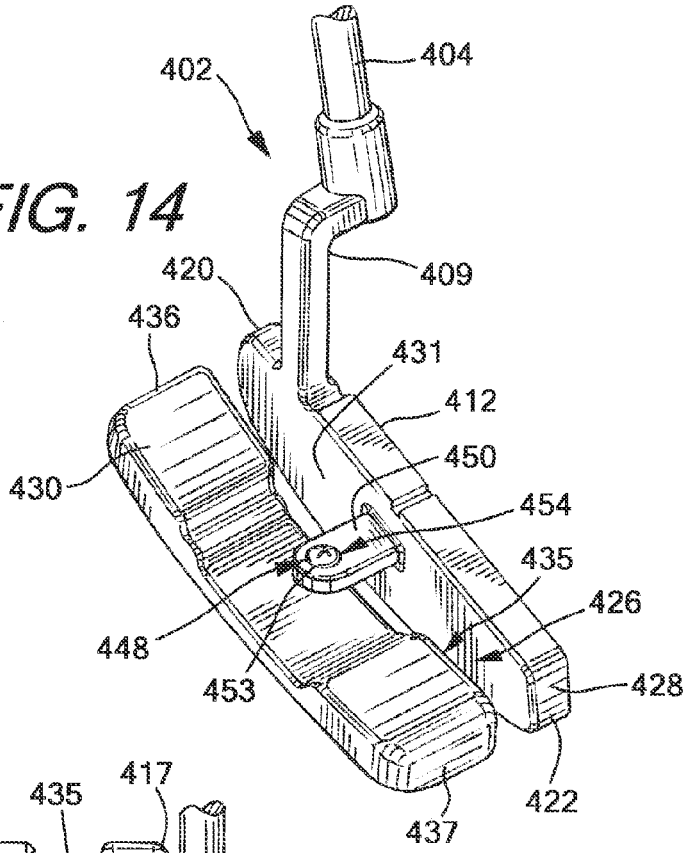
FIG. 14 is a rear perspective view of another embodiment of a ball striking device according to aspects of the present invention, in the form of a golf putter.
Figure 15:
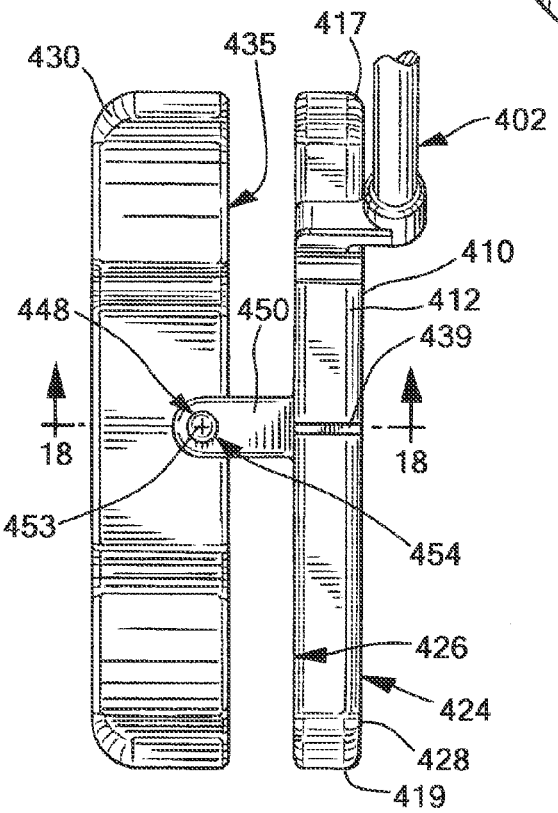
FIG. 15 is a top view of the device of FIG. 14.

FIG. 13 illustrates an alternate embodiment of the ball striking head 302 of FIGS. 8-12, in which the face member 328 includes a channel 346 as described above with respect to the head 102 as shown in FIG. 4. It is understood that a channel 346 such as depicted in FIG. 13 may be used in connection with any other embodiment described herein.

FIGS. 14-18 illustrate an embodiment of a ball striking head 402 that has a structure similar to the head 102 described above and shown in FIGS. 1-3. In the embodiment of FIGS. 14-18, the face member 428 and the weight member 430 are connected by a connection or connection point 448 formed by connection members 450, 460 connected to the face member 428 and the weight member 430, respectively. The structures of the face member 428 and the weight member 430 are otherwise substantially the same as the structures of the face member 128 and the weight member 130 of the head 102 of FIGS. 1-3, and such structures are not described again herein for the sake of brevity. The connection members 450, 460 can serve to transfer momentum, including angular momentum, of the weight member 430 to the face member 428 in this embodiment.

In the embodiment of FIGS. 14-18, the face member 428 includes a connection member 450 that is formed by an arm 451 extending rearward from the rear side 426 or rear surface 431 of the face member 428, with an aperture 452 extending through the arm 451. The weight member 430 has another connection member 460 that is formed by an aperture 461 in the weight member 430. In this embodiment, a fastener (such as a screw) 453 is received in the apertures 452, 461 to secure the connection between the connection members 450, 460. In another embodiment, a different type of fastener may be used, or no fastener may be used. Additionally, in other embodiments, the arrangement of the arm 451 may be transposed, such that at least one of the connection members 450, 460 includes an arm 451 extending therefrom, in one embodiment. Other connection configurations may also be used, including the connections illustrated in FIGS. 8-12, 19-22, and 26-41. The connection members 450, 460 in this embodiment form a joint 454 at the connection point 448. This joint 454 permits, or at least does not inhibit, transfer of energy and/or momentum between the weight member 430 and the face member 428, as described above with respect to the heads 102, 202 of FIGS. 1-3 and 5-7. The connection members 450, 460 in this embodiment can serve any or all of the functions described above with respect to the connection members 350, 360 of FIGS. 8-12.

In this embodiment, the CG of the weight member 430 and the CG of the face member 428 may be aligned vertically, laterally, or both. In one embodiment, the connection members 450, 460 may be directly aligned with the CG of the weight member 430 and/or the CG of the face member 428. In another embodiment, the connection members 450, 460 may be aligned with the vertical or lateral plane of the CG of the weight member 430 and/or the CG of the face member 428. Additionally, the first and second connection members 450, 460 in this embodiment are located approximately equidistant from the heel and toe edges 420, 422 of the face member 428 and approximately equidistant from the heel and toe edges 436, 437 of the weight member 430. The face member 428 may include alignment indicia 439 that may be aligned with the CG of the face member 428, the CG of the weight member 430, and/or one or both of the connection members 450, 460. In an additional embodiment, the weight member 330 may have a total weight or a weight relative to the total weight of the head 302 as described above with respect to the head 102 of FIGS. 1-3.

Figure 16:
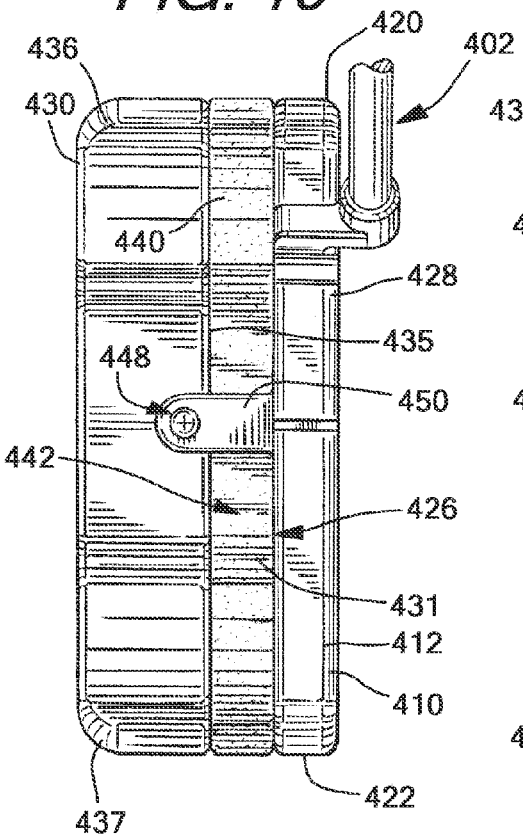
FIG. 16 is a top view of the device of FIG. 14, with a resilient member contained between a face member and a weight member of the device, in one configuration.
Figure 17:
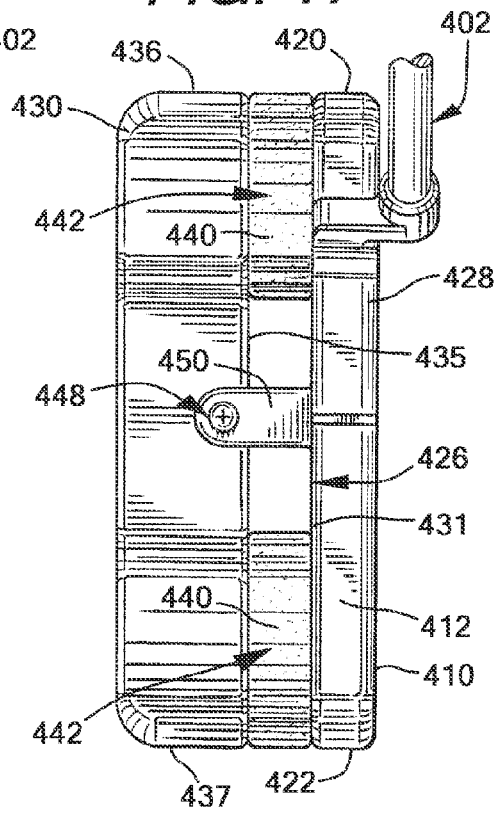
FIG. 17 is a top view of the device of FIG. 14, with a resilient member contained between the face member and the weight member of the device, in another configuration.
Figure 18:
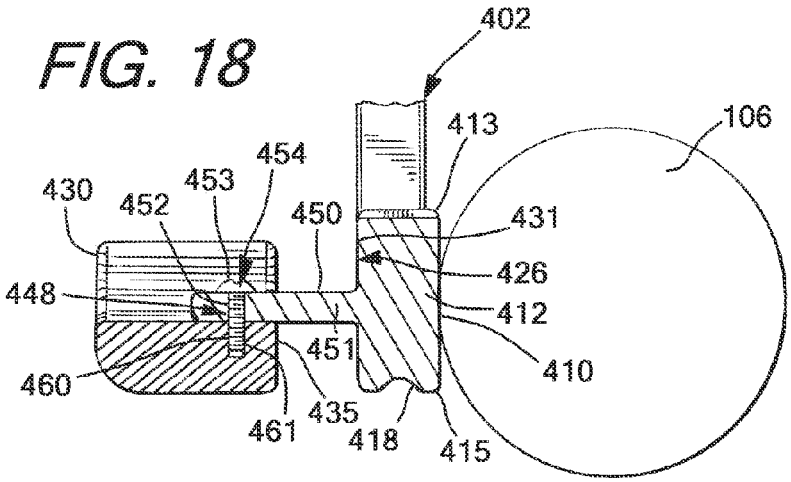
FIG. 18 is a cross-section view taken along lines 18-18 of FIG. 15.

The head 402 of FIGS. 14-18 may also include a resilient member 440 formed at least partially of a resilient material, as illustrated in FIGS. 16-17, with any configurations or properties of the resilient members 140, 240, as described above. In these embodiments, the resilient member 440 at least partially fills the spaces 442 between the weight member 430 and the face member 428, and at least part of the resilient member 440 is included on both sides of the CG of the face member 428 and/or the CG of the weight member 430. FIG. 16 illustrates one embodiment, where the resilient member 440 completely fills the spaces 442 between the front surface 435 of the weight member 430 and the rear side 426 of the face member 428. FIG. 17 illustrates another embodiment, where the resilient member 440 partially fills the spaces 442 between the front surface 435 of the weight member 430 and the rear side 426 of the face member 428. Further configurations are contemplated. The head 402 having the resilient member 440 may be manufactured in any manner described above, and may include the connection members 450, 460 serving a registration/location function during assembly, as described above.

In an alternate embodiment (not shown), the face member 428 and the weight member 430 of the head 402 of FIGS. 14-18 may be connected as a single piece, such as by integral forming or by welding, brazing, bonding, or otherwise integrally joining the connection member 450 to the weight member 430. In this configuration, the connection member 450 may be formed of a resilient and relatively flexible metal (e.g. aluminum or various steel alloys) to permit energy and/or momentum transfer to be accomplished through the resilient connection member 450. At least a portion of the connection member 450 may be thinner than illustrated in FIGS. 14-18 in one embodiment, to increase flexibility of the connection member 450.

FIGS. 19-22 illustrate an embodiment of a ball striking head 502 that has a structure similar to the head 202 described above and shown in FIGS. 5-7. In the embodiment of FIGS. 19-22, the face member 528 and the weight member 530 are connected by a connection or connection point 548 formed by connection members 550, 560 connected to the face member 528 and the weight member 530, respectively. The structures of the face member 528 and the weight member 530 are otherwise substantially the same as the structures of the face member 228 and the weight member 230 of the head 202 of FIGS. 5-7, and such structures are not described again herein for the sake of brevity. The connection members 550, 560 can serve to transfer momentum, including angular momentum, of the weight member 530 to the face member 528 in this embodiment.

In the embodiment of FIGS. 19-22, the weight member 530 includes a connection member 560 that is formed by an arm 561 extending from the front surface 535 of the weight member 530, with a receiver 562 on the underside of the arm 561. The face member 528 has another connection member 550 that is formed by a pin 551 extending upward from the top surface 534 of the sole member 532 that extends rearwardly on the rear side 526 of the face member 528. The receiver 562 is configured to receive the pin 551 therein to connect the connection members 550, 560 together to form the connection point 548. In this embodiment, the pin 551 and the receiver 562 include complementary retaining structure, such as a tab/slot configuration, to connect the connection members 550, 560 together. A fastener may be additionally or alternately used in another embodiment. Additionally, in other embodiments, the arrangement of the pin 551 and the receiver 562 may be transposed, such that the connection member 550 of the face member 528 has the receiver 562, and the connection member 560 of the weight member 530 has the pin 551. In other words, one of the connection members 550, 560 includes the pin 551 and the other of the connection members 550, 560 includes the receiver 562, in one embodiment. Other connection configurations may also be used, including the connections illustrated in FIGS. 8-18 and 26-41. In one example, a connection member may be connected to the rear surface 531 of the face 512, rather than to the sole member 532. In another example, the arm 561 forming the connection member 560 may extend from the rear side 545 of the weight member 530, as shown in FIG. 22A. The location of the pin 551 may be changed accordingly in this embodiment. In a further example, a connection member 550 may be connected to the bottom surface 544 of the weight member 530, such as a pin 551 that extends between the bottom surface 544 of the weight member and the top surface 534 of the sole member 532, as shown in FIG. 22B. Such a pin may be imbedded in the resilient member 540 (described below), if present. Both of the embodiments of FIGS. 22A and 22B are shown with a resilient member 540 as described below, however the head 502 may not include the resilient member 540 in other embodiments. The connection members 550, 560 in the embodiments of FIGS. 19-22D form a joint 554 at the connection point 548. This joint 554 permits, or at least does not inhibit, transfer of energy and/or momentum between the weight member 530 and the face member 528, as described above with respect to the heads 102, 202 of FIGS. 1-3 and 5-7. The connection members 550, 560 in this embodiment can serve any or all of the functions described above with respect to the connection members 350, 360 of FIGS. 8-12.

In this embodiment, the CG of the weight member 530 and the CG of the face member 528 may be aligned vertically, laterally, or both. In one embodiment, the connection members 550, 560 may be directly aligned with the CG of the weight member 530 and/or the CG of the face member 528. In another embodiment, the connection members 550, 560 may be aligned with the vertical or lateral plane of the CG of the weight member 530 and/or the CG of the face member 528. Additionally, the first and second connection members 550, 560 in this embodiment are located approximately equidistant from the heel and toe edges 520, 522 of the face member 528 and approximately equidistant from the heel and toe edges 536, 537 of the weight member 530. The face member 528 may include alignment indicia 539 that may be aligned with the CG of the face member 528, the CG of the weight member 530, and/or one or both of the connection members 550, 560. In an additional embodiment, the weight member 530 may have a total weight or a weight relative to the total weight of the head 502 as described above with respect to the head 102 of FIGS. 1-3.

Figure 21:
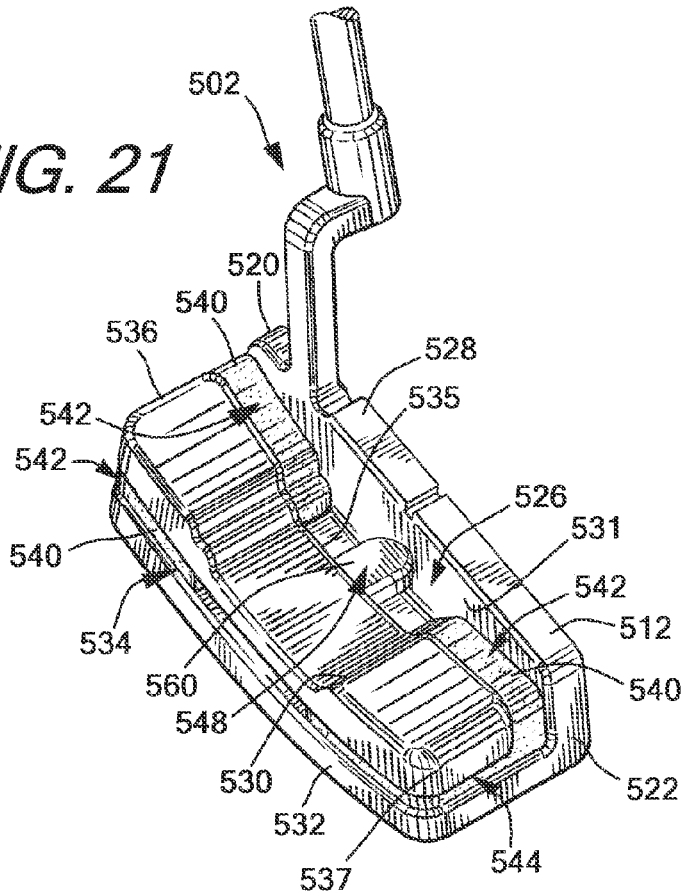
FIG. 21 is a rear perspective view of the device of FIG. 19, with a resilient member contained between the face member and the weight member of the device, in another configuration.
Figure 22:
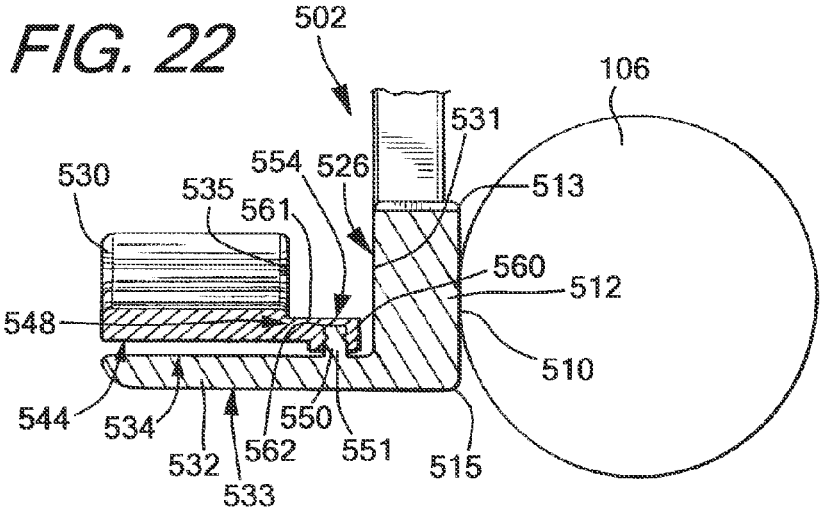
FIG. 22 is a cross-section view taken along lines 22-22 of FIG. 19.
Figure 22A:
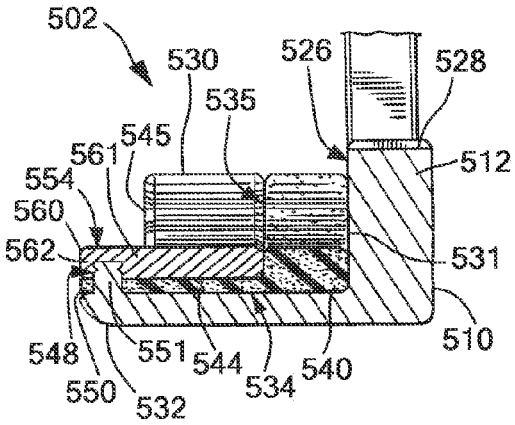
FIG. 22A is a cross-section view of an alternate embodiment of the ball striking device of FIG. 20.
Figure 22B:
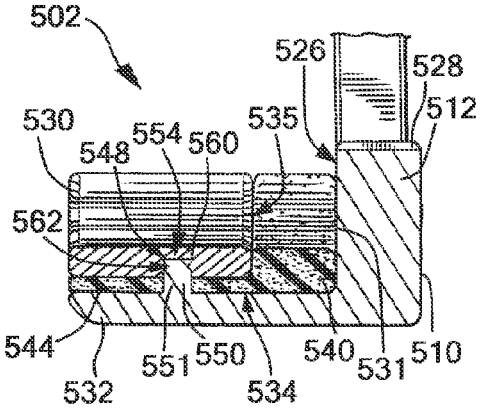
FIG. 22B is a cross-section view of another alternate embodiment of the ball striking device of FIG. 20.

The head 502 of FIGS. 19-22 may also include a resilient member 540, as illustrated in FIGS. 20-21, with any configurations or properties of the resilient members 140, 240, as described above. In these embodiments, the resilient member 540 at least partially fills the spaces 542 between the weight member 530 and the face member 528, and at least part of the resilient member 540 is included on both sides of the CG of the face member 528 and/or the CG of the weight member 530. FIG. 20 illustrates one embodiment, where the resilient member 540 completely fills the spaces 542 between the front surface 535 of the weight member 530 and the rear surface 531 of the face member 528, and between the bottom surface 544 of the weight member 530 and the top surface 534 of the sole member 532. FIG. 21 illustrates another embodiment, where the resilient member 540 partially fills the spaces 542 between the front surface 535 of the weight member 530 and the rear surface 531 of the face member 528, and between the bottom surface 544 of the weight member 530 and the top surface 534 of the sole member 532. Further configurations are contemplated. The head 502 having the resilient member 540 may be manufactured in any manner described above, and may include the connection members 550, 560 serving a registration/location function during assembly, as described above.

Figure 19:
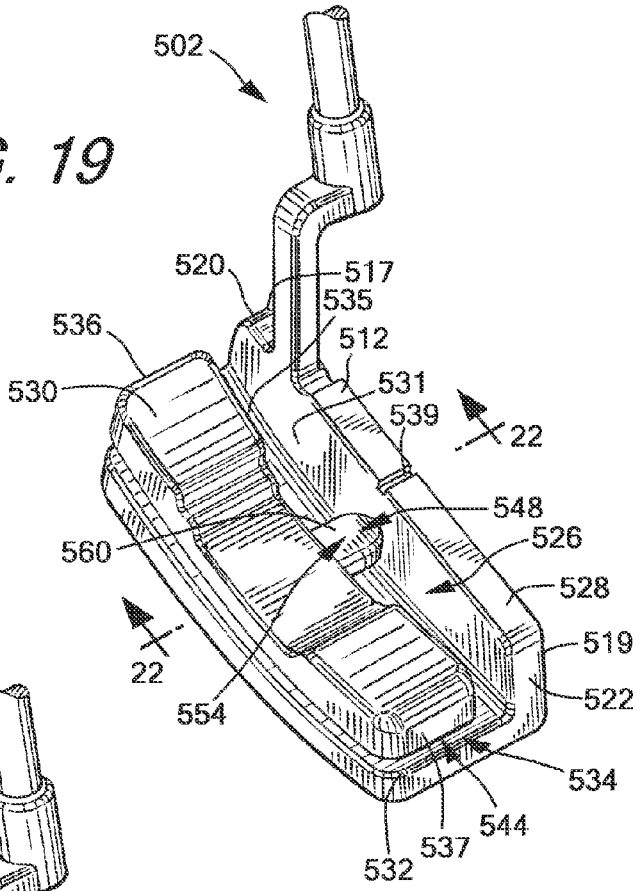
FIG. 19 is a rear perspective view of another embodiment of a ball striking device according to aspects of the present invention, in the form of a golf putter.
Figure 19A:
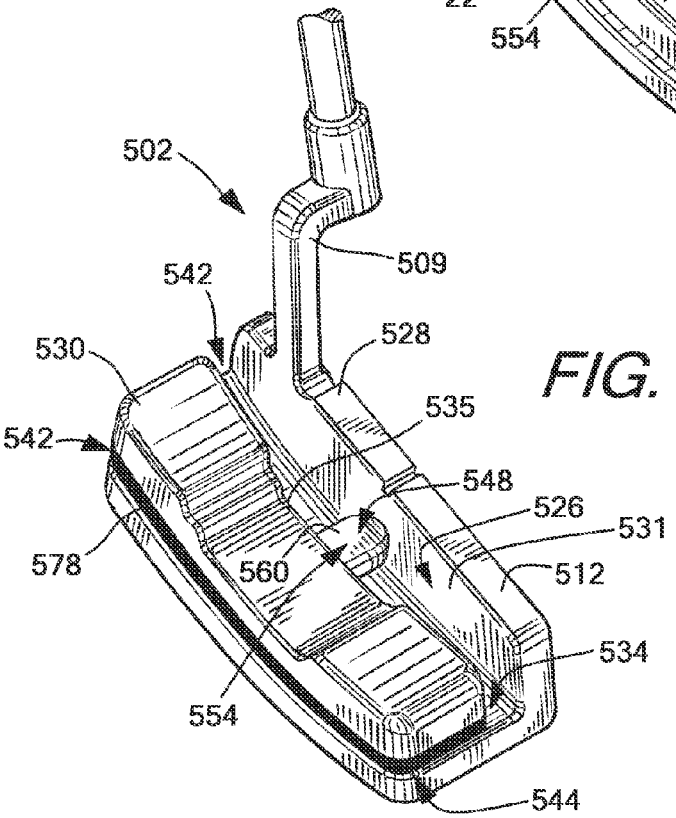
FIG. 19A is a rear perspective view of an alternate embodiment of the ball striking device as shown in FIG. 19.

In another embodiment, the resilient member 540 may be positioned only between the bottom surface 544 of the weight member 530 and the top surface 234 of the sole member 532, or only between the front surface 535 of the weight member 530 and the rear surface 532 of the face member 528, as similarly described above. In one embodiment, illustrated in FIG. 20A, the resilient member 540 is positioned only between the front surface 535 of the weight member 530 and the rear surface 532 of the face member 528. In this embodiment, a low-friction material 578, such as a Teflon tape, a hard polymer material or other low-friction member, may be positioned between the bottom surface 544 of the weight member 530 and the top surface 534 of the sole member 532, as shown in FIG. 20A. This low-friction material may be connected to the bottom surface 544 of the weight member 530 or the top surface 534 of the sole member 532, and may be applied as a coating and/or using an adhesive or other bonding material. Alternately, some or all of the space 542 between the bottom surface 544 of the weight member 530 and the top surface 534 of the sole member 532 may be empty. FIG. 19A illustrates a further embodiment, in which the head 502 does not include the resilient member 540, and includes the low-friction material 578 as described above positioned between the bottom surface 544 of the weight member 530 and the top surface 534 of the sole member 532.

Figure 22C:
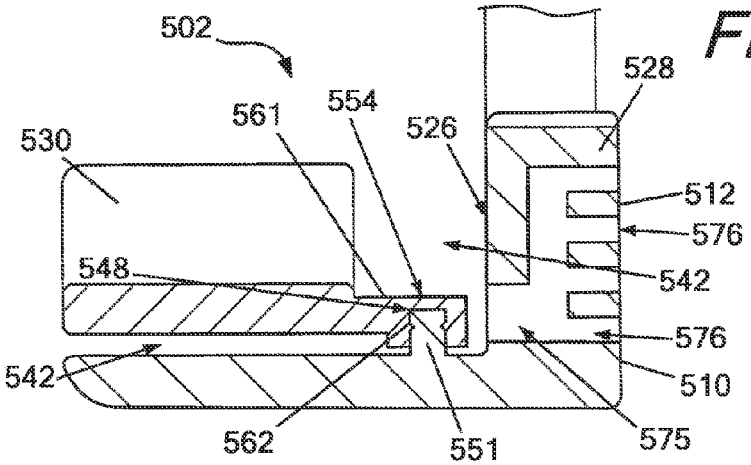
FIG. 22C is a cross-section view of another alternate embodiment of the ball striking device of FIG. 20, shown before connection of a resilient member.
Figure 22D:
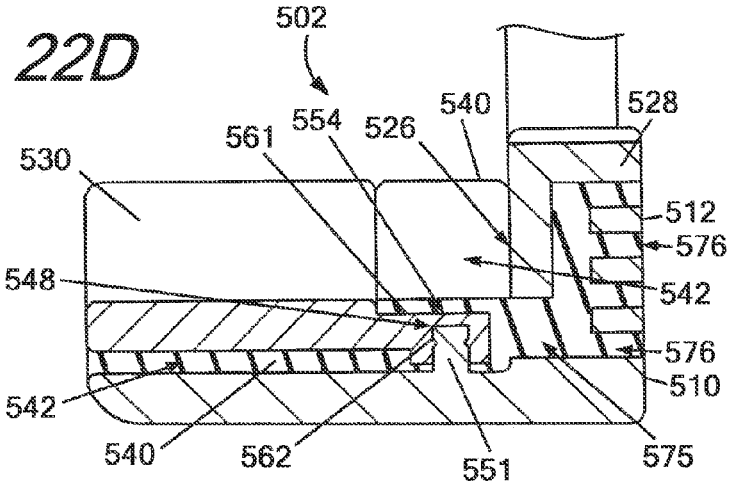
FIG. 22D is a cross-section view of the device of FIG. 22C, shown after connection of the resilient member.

FIGS. 22C-D illustrate an alternate configuration of the head 502 of FIGS. 19-22, along with a method for manufacturing the head 502 by connection of the resilient member to the head 502. In this embodiment, the face member 528 includes an internal cavity 575 in communication with the spaces 542 between the weight member 530 and the face member 528. The face member 528 also includes grooves 576 in the face 512, similar to the grooves 1715 of the embodiment in FIGS. 4A-B, and the grooves 576 are in communication with the internal cavity 575. The face member 528 can be manufactured in this configuration by precision milling or other applicable technique. During manufacturing, the head 502 as shown in FIG. 22C can be placed in a mold, and a resilient material can be injected to fill the spaces 542 between the face member 528 and the weight member 530 and solidifies (such as through freezing or curing) form the resilient member 540. The resilient material also fills the internal cavity 575 and the face grooves 576 to create a face 512 that is similar to the face 1704 as shown in FIGS. 4A-B, with the resilient material forming part of the striking surface 510. A co-molding process can also be used in connection with this processing method in one embodiment, as described above. The completed head 502 is illustrated in FIG. 22D. Other embodiments as described herein may utilize similar configurations and methods of manufacture.

Figure 23:
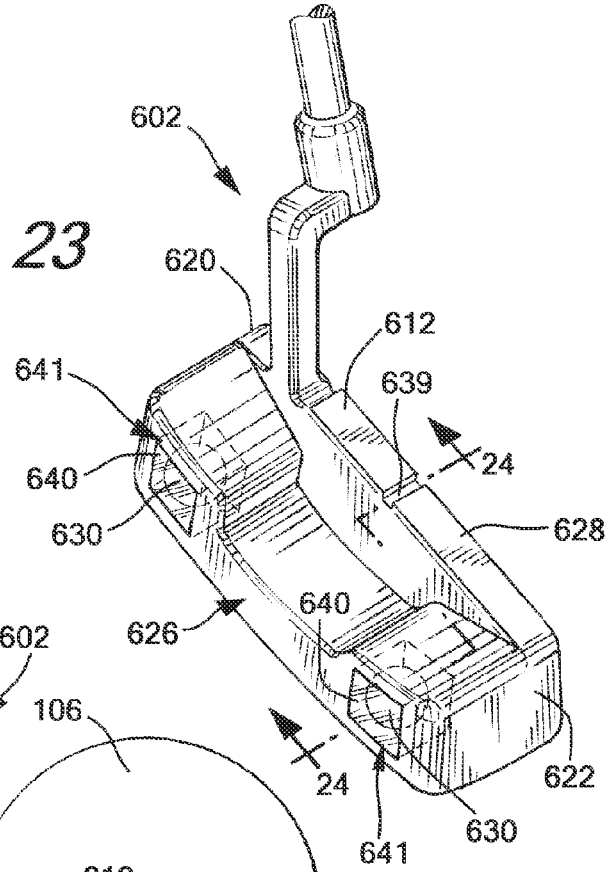
FIG. 23 is a rear perspective view of another embodiment of a ball striking device according to aspects of the present invention, in the form of a golf putter.
Figure 24:
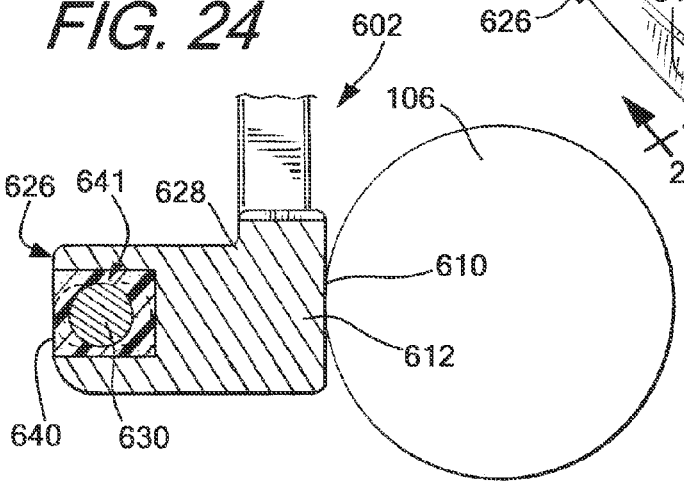
FIG. 24 is a cross-section view taken along lines 24-24 of FIG. 23.
Figure 25:
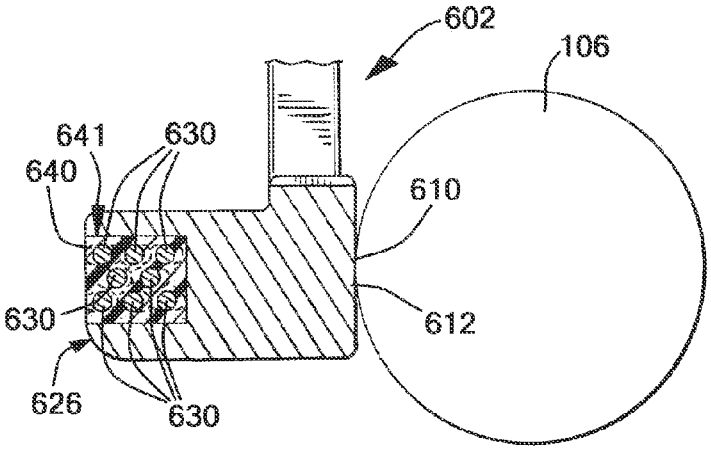
FIG. 25 is a cross-section view of an alternate embodiment of the device of FIG. 23.

FIGS. 23-25 illustrate additional embodiments of a ball striking head 602 that contains many components and features that are similar to the features described above with respect to the heads 102, 202 of FIGS. 1-3 and 5-7. Such similar components of the head 602 are referred to by similar reference numbers in the description below, using the "6xx" series of reference numbers. Description of some such components that have already been described above may be simplified or eliminated for the sake of brevity in the description below. In the embodiments of FIGS. 23-25, the head 602 has a face member 628 having a plurality of weight members 630 that are connected to the face member 628 and at least partially received within cavities 641 on the rear side 626 of the face member 628. In the configurations shown in FIGS. 23-25, the head 602 has cavities 641 on both sides of the CG of the face member 628, proximate the heel 620 and toe 622 of the face member 628. The cavities 641 each have a resilient member 640 formed at least partially of a resilient material received in the cavities 641, at least partially filling the cavities 641, and supporting the weight members 630 within the cavities 641. In one embodiment, the resilient members 640 of both cavities 641 contain the same resilient material, however the cavities 641 may contain different resilient materials in other embodiments. The resilient member(s) 640 in these embodiments may have any configurations or properties of the resilient members 140, 240 described above. Additionally, in these embodiments, the weight members 630 may be formed of a material selected for its weight/density, and may be made from a highly dense material such as tungsten, bismuth, lead, or another heavy metal. In one embodiment of the configurations shown in FIGS. 23-25, the weight members 630 constitute about 25% or more of the total weight of the head 602, and may have a total weight or a weight relative to the total weight of the head 602 as described above with respect to the head 102 of FIGS. 1-3. Further, the face member 628 may include alignment indicia 639 that may be aligned with the CG of the face member 628.

In the embodiment illustrated in FIGS. 23-24, each cavity 641 has a single weight member 630 that is received therein. The weight members 630 are shown as spherical bodies in FIGS. 23-24, but may have a different shape in another embodiment. Each weight member 630 is supported and suspended by the resilient member 640 in this embodiment, and the resilient member 640 completely spaces the weight members 630 from the face member 628. Additionally, the weight members 630 are completely contained within the resilient member 640 in this embodiment. In the embodiment illustrated in FIG. 25, each cavity 641 has a plurality of smaller weight members 630 received therein. The weight members 630 are shown as spherical bodies in FIG. 25, but may have a different shape in another embodiment. Each weight member 630 is supported and suspended by the resilient member 640 in the embodiment of FIG. 25, and the resilient member 640 completely spaces the weight members 630 from the face member 628 and from each other. Additionally, the weight members 630 are completely contained within the resilient member 640 in the embodiment of FIG. 25. As shown by the broken lines in FIGS. 24-25, the resilient member 640 is resilient and/or compressible to permit the weight members 630 to transfer energy and/or momentum to the face member 628 in response to an impact of a ball on the striking surface 610 of the head 602. Other weighting configurations are contemplated in other embodiments, including the use of cavities 641 and/or weight members 630 that are different in number, location, and/or structure.

FIGS. 26-35 illustrate examples of a ball striking device 700 in the form of a golf iron, in accordance with at least some examples of this invention. The ball striking device 700 includes a ball striking head 702 and a shaft 704 connected to the ball striking head 702 and extending therefrom. The ball striking head 702 of FIGS. 26-35 has a face member 728 that includes a face 712, a body 708 behind the face 712, and a hosel 709 extending therefrom. The ball striking head 702 also has a weight member 730 connected to the face member 728, as described further below. The shaft 704 may be connected to the hosel 709, and may utilize any shaft configuration and any desired hosel and/or head/shaft interconnection structure, including those described above.

For reference, the face member 728 generally has a top 716, a bottom or sole 718, a heel 720 proximate the hosel 709, a toe 722 distal from the hosel 709, a front side 724, and a back or rear side 726. The shape and design of the head 702 may be partially dictated by the intended use of the device 700. In the club 700 shown in FIGS. 26-35, the head 702 has a face 712 with an appreciable degree of incline, as the club 700 is designed for use as an iron-type club, intended to hit the ball short to long distances, with some degree of lift and arcing trajectory, depending on the club type. It is understood that the head 702 may be configured as a different type of ball striking device in other embodiments, including other types of irons, hybrid clubs, chippers, etc. In other applications, such as for a different type of golf club, the head may be designed to have different dimensions and configurations.

The face 712 is located at the front 724 of the face member 728, and has a striking surface or ball striking surface 710 located thereon, with peripheral edges 713, 715, 717, 719. The ball striking surface 710 is configured to face a ball in use, and is adapted to strike the ball when the device 700 is set in motion, such as by swinging. As shown, the ball striking surface 710 occupies most of the face 712. The face 712 may include some curvature in the top to bottom and/or heel to toe directions (e.g., bulge and roll characteristics), and may also include functional face grooves 721, as is known and is conventional in the art. In other embodiments, the surface 710 may occupy a different proportion of the face 712, or the body 708 may have multiple ball striking surfaces 710 thereon. Additionally, the face 712 may have one or more internal or external inserts in some embodiments.

It is understood that the face 712, the body 708, and/or the hosel 709 can be formed as a single piece or as separate pieces that are joined together. In the embodiments shown in FIGS. 26-35, the face member 728, including the face 712, the body 708, and the hosel 709, are formed of a single, integral piece. In other embodiments, the face member 728 may be formed of multiple pieces, such as by using an insert to form all or part of the face 712, or a separate body member or members connected behind the face 712. Such multiple pieces may be joined using an integral joining technique, such as welding, cementing, or adhesively joining, or other known techniques, including many mechanical joining techniques, such as releasable mechanical engagement techniques. Further, the hosel 709 may also be formed as a separate piece, which may be joined using these or other techniques.

FIGS. 26-35 illustrate embodiments of a ball striking head 702 that includes the face member 728 and a weight member 730 connected to the face member 728. In each of these embodiments, the weight member 730 is configured to transfer energy and/or momentum to the face member 728 upon impact of the ball on the striking surface 710, as described above. The weight member 730 may be connected to the face member 728 in a number of different configurations that permit this energy and/or momentum transfer between the weight member 730 and the face member 728, as described above. Several such configurations are described below and shown in FIGS. 26-35. In each of the embodiments of FIGS. 26-35, the face member 728 has a cavity 741 on the rear side 726, and the cavity 741 is defined by the rear surface 731 of the face 712 and walls 725 extending rearwardly from the face 712. The weight member 730 is at least partially received in the cavity 741 in each of the embodiments illustrated in FIGS. 26-35. In other embodiments, the head 702 may not contain a cavity 741 and/or no portion of the weight member 730 may be received in a cavity 741. Further, the head 702 may contain multiple cavities and multiple weight members 730 in further embodiments. The embodiments of FIGS. 26-33 contain connection members 750, 754, 755, 758 connecting the weight member 730 and the face member 728, and the connection members 750, 754, 755, 758 in these embodiments can serve any or all of the functions described above with respect to the connection members 350, 360 of FIGS. 8-12. Additionally, at least some of the embodiments in FIGS. 26-33 may have a resilient member 740 at least partially formed of a resilient material, and in such embodiments, the resilient members 740 may be manufactured in any manner described above. These embodiments may also utilize the connection members 750, 754, 755, 758 to serve a registration/location function during assembly, as described above. Further, the connection members 750, 754, 755, 758 in these embodiments can serve to transfer momentum, including angular momentum, of the weight member 730 to the face member 728.

FIGS. 26-29 illustrate a head 702 that has a weight member 730 connected to the face member 728 by a connection or connection point 748 formed by one or more connection members 750 connected to the face member 728 and/or the weight member 730. In the embodiment of FIGS. 26-29, the head 702 includes a connection member 750 in the form of a fastener, such as a screw, bolt, etc., that extends through apertures 751, 752 in the weight member 730 and the face member 728 to connect the weight member 730 to the face member 728. The face member 728 includes a raised connection point 753 for connection to the connection member 750, which can avoid the need for the aperture 752 to penetrate too close to the striking surface 710, although this feature may be absent in another embodiment. In a further embodiment, the connection member 750 may be permanently and/or integrally connected to the face member 728 or the weight member 730. In the embodiment of FIGS. 26-29, the weight member 730 is configured to be completely or substantially completely received within the cavity 741, and the outer edges of the weight member 730 (including the top edge 770, bottom edge 771, heel edge 736, and toe edge 737) are contoured similarly to the boundaries of the cavity 741. Additionally, the weight member 730 has a lateral width and a vertical height that are smaller than the width and height of the face member 728, which allows the weight member 730 to be received in the cavity 741. In this embodiment, the weight member has a plurality of voids or gaps 773 in the center, which define a plurality of spokes 774 radiating from an inner hub 775 to a ring-like outer boundary 776. This configuration can be used to control weighting, such as by distributing the weight of the weight member 730 more toward the edges of the head 702 and/or decreasing the weight of the weight member 730. The CG of the weight member 730 may be located at the hub 775. It is understood that the apertures 751, 752 may also be considered to be connection members, as defined herein.

The CG of the weight member 730 and the CG of the face member 728 may be aligned vertically, laterally, or both. In one embodiment, the connection member 750 may be directly aligned with the CG of the weight member 730 and/or the CG of the face member 728. In another embodiment, the connection member 750 may be aligned with the vertical or lateral plane of the CG of the weight member 730 and/or the CG of the face member 728. Further, the weight member 730 may be parallel or substantially parallel to the striking surface 710 of the face 712. In this configuration, where the connection member 750 is aligned with the CGs of the face member 728 and the weight member 730, the weight member 730 may be configured to transfer incrementally more energy and/or momentum upon off-center impacts on the striking surface 710, increasing based on the distance of the impact away from the center or optimal impact point. Additionally, the connection member 750 in this embodiment is located approximately equidistant from the heel and toe edges 720, 722 of the face member 728 and approximately equidistant from the heel and toe edges 736, 737 of the weight member 730. The same is true for the connection members 754, 755, 758 of the heads 702 in FIGS. 31-33. In an additional embodiment, the weight member 730 may have a total weight or a weight relative to the total weight of the head 702 as described above with respect to the head 102 of FIGS. 1-3.

The weight member 730 may be configured to transfer energy and/or momentum to the face member 728 upon an impact on the face 712, including an off-center impact, as similarly described above. As described above, the momentum of the weight member 730 compresses the resilient member 740, and causes the resilient member 740 to exert a response force on the face member 728 to achieve this transfer of momentum. The resilient member 740 may exert at least a portion of the response force on the face member 728 through expansion after the compression. The weight member 730 may deflect slightly toward the impact point to compress the resilient member 740 in the process of this momentum transfer. In this embodiment, upon an off-center impact of the ball centered on the heel side (i.e. toward the heel edge 717) of the face 712, the heel 720 of the face member 728 tends to deflect rearwardly. As another example, upon an off-center impact of the ball centered on the toe side (i.e. toward the toe edge 719) of the face 712, the toe 722 of the face member 728 tends to deflect rearwardly. As the heel 720 or toe 722 of the face member 728 begins to deflect rearwardly, at least some of the forward momentum of the weight member 730 is transferred to the face member 728 to resist this deflection. Additionally, the weight member 730 may be configured to deflect as a result of impacts higher or lower than the CG of the face member 728. For example, upon an off-center impact of the ball centered toward the top edge 713 of the face 712, the top of the face member 728 tends to deflect rearwardly. As another example, upon an off-center impact of the ball centered toward the bottom edge 715 of the face 712, the bottom of the face member 728 tends to deflect rearwardly. As the top or bottom of the face member 728 begins to deflect rearwardly, at least some of the forward momentum of the weight member 730 is transferred to the face member 728 to resist this deflection. The connection between the face member 728 and the weight member 730 permits, or at least does not inhibit, this transfer of energy and/or momentum between the weight member 730 and the face member 728, as described above with respect to the heads 102, 202 of FIGS. 1-3 and 5-7.

Figure 28:
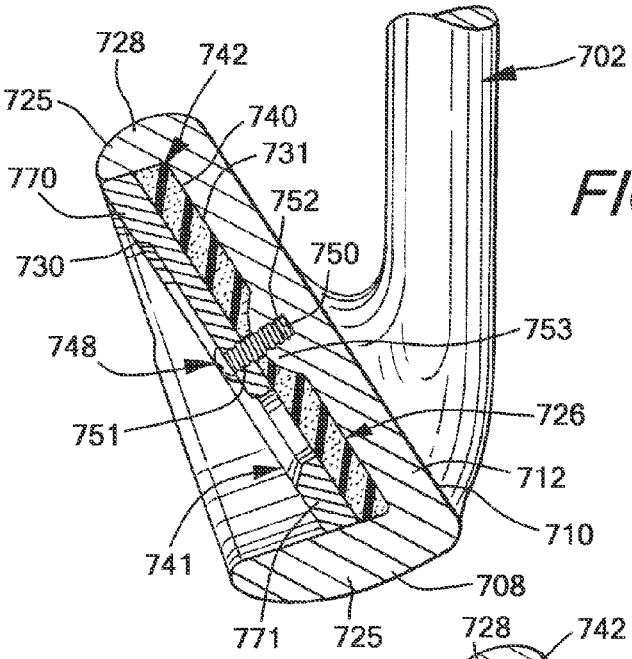
FIG. 28 is a cross-section view taken along lines 28-28 of FIG. 26.
Figure 29:
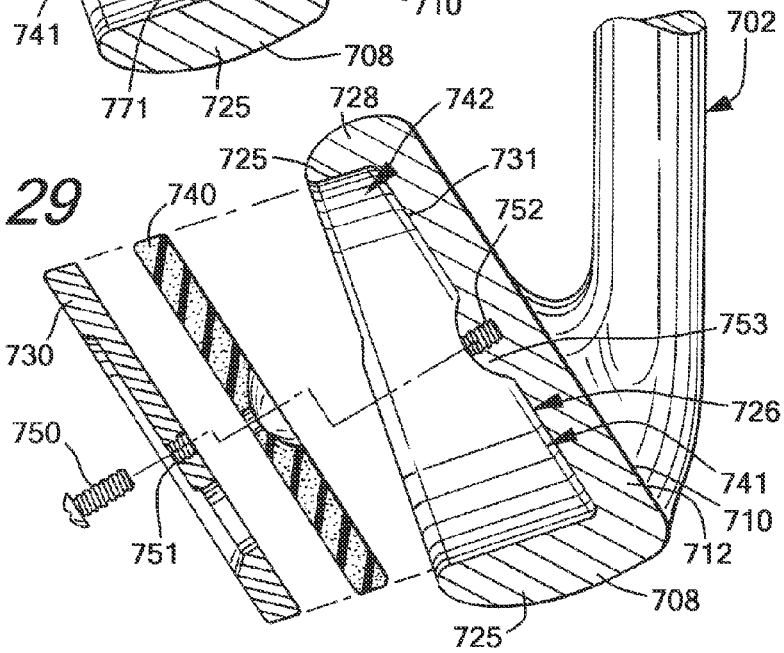
FIG. 29 is an exploded cross section view of the device of FIG. 28.

The head 702 of FIGS. 26-29 may also include a resilient member 740, with any configurations or properties of the resilient members 140, 240, as described above. In one embodiment, the resilient member 740 at least partially fills the spaces 742 between the weight member 730 and the face member 728, and at least part of the resilient member 740 is included on both lateral sides of the CG of the face member 728 and/or the CG of the weight member 730. At least part of the resilient member 740 may also be included on both vertical sides of the CG of the face member 728 and/or the CG of the weight member 730. As shown in FIGS. 28-29, in this embodiment, the resilient member 740 completely fills the spaces 742 between the weight member 730 and the rear surface 731 of the face member 728. In another embodiment, the resilient member 740 may partially fill the spaces 742. The resilient member 740 may serve to transfer energy and/or momentum between the weight member 730 and the face member 728 during impact, such as in the manner described above.

Figure 30:
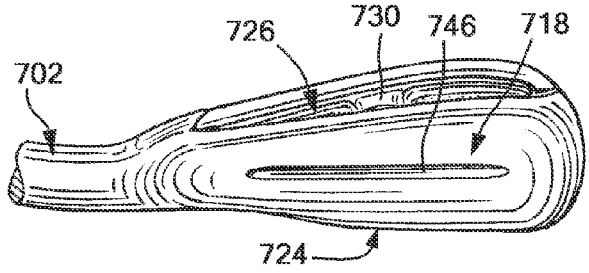
FIG. 30 is a bottom view of an alternate embodiment of the device of FIG. 26.

FIG. 30 illustrates an alternate embodiment of the ball striking head 702 of FIGS. 26-29, in which the face member 728 includes a channel 746 as described above with respect to the head 102 as shown in FIG. 4. It is understood that a channel 746 such as depicted in FIG. 30 may be used in connection with any other embodiment described herein, including the embodiments in FIGS. 31-35.

Figure 31:
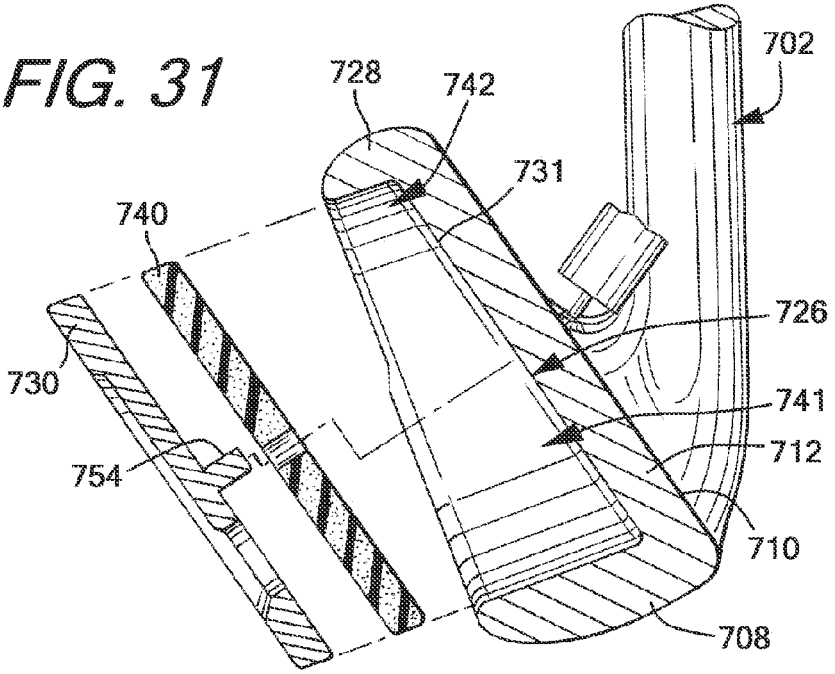
FIG. 31 is an exploded cross-section view of an alternate embodiment the device of FIGS. 26-29.

FIG. 31 illustrates another embodiment of an iron-type ball striking head 702 as described above with respect to the embodiment in FIGS. 26-29. In the embodiment of FIG. 31, the weight member 730 includes a connection member 754 in the form of a post that is configured to be connected to the rear surface 731 of the face member 728, such as by welding as shown in FIG. 31, to connect the weight member 730 to the face member 728. Other techniques, including integral joining techniques such as brazing or soldering, as well as adhesive or other bonding techniques, mechanical joining techniques, etc., may alternately be used to connect the connection member 754 to the face member 728. In other respects, the components, features, structures, and functioning of the head 702 in FIG. 31 are similar to those described above with respect to FIGS. 26-29.

Figure 32:
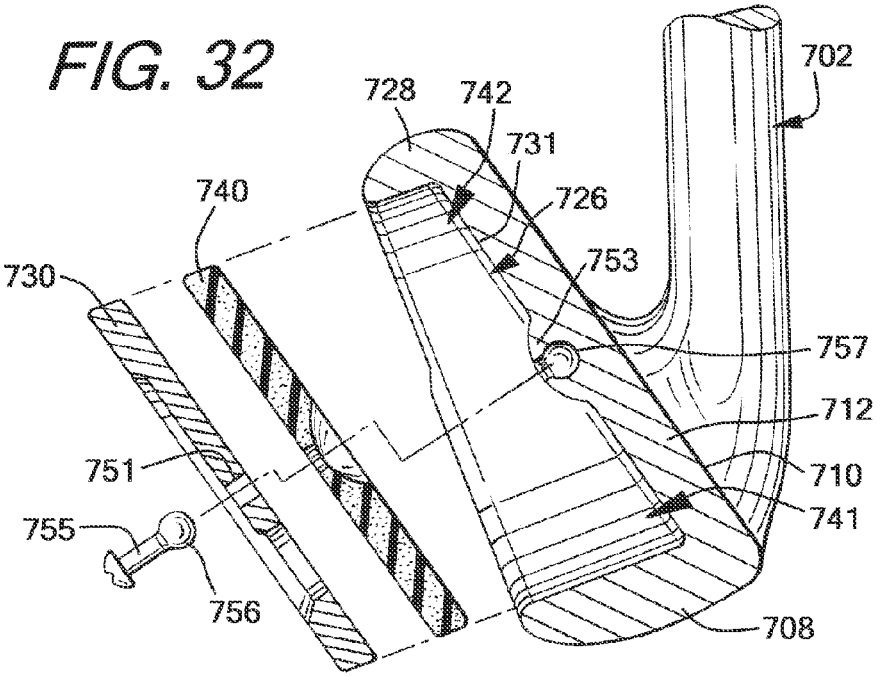
FIG. 32 is an exploded cross-section view of another alternate embodiment the device of FIGS. 26-29.

FIG. 32 illustrates another embodiment of an iron-type ball striking head 702 as described above with respect to the embodiment in FIGS. 26-29. In the embodiment of FIG. 32, the weight member 730 includes a connection member 755 in the form of a pin with a ball end 756 that is configured to be connected to and received in a socket 757 on the rear surface 731 of the face member 728, to connect the weight member 730 to the face member 728. In other respects, the components, features, structures, and functioning of the head 702 in FIG. 31 are similar to those described above with respect to FIGS. 26-29. It is understood that the socket 757 and the aperture 751 may also be considered to be connection members, as defined herein.

Figure 33:
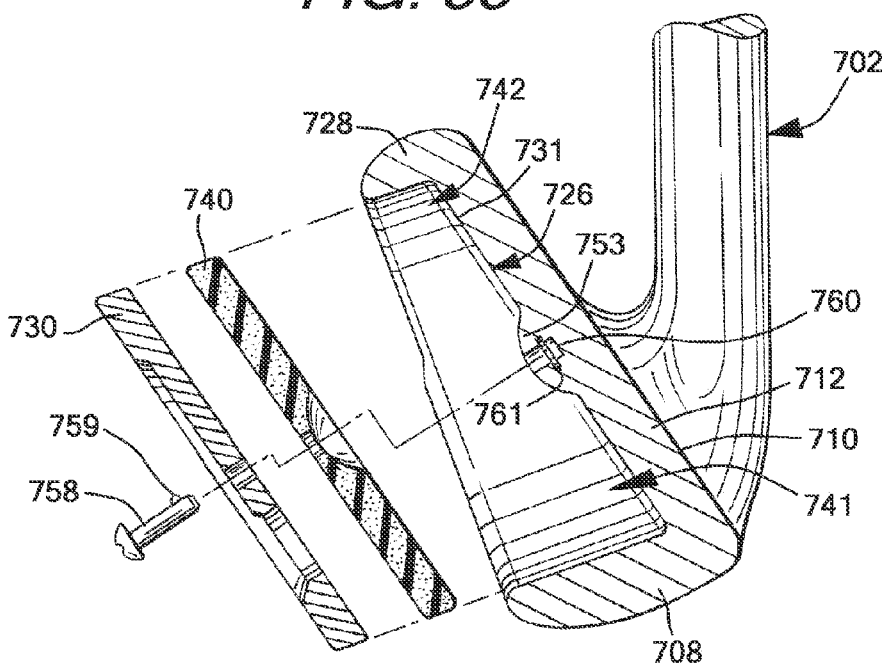
FIG. 33 is an exploded cross-section view of another alternate embodiment the device of FIGS. 26-29.

FIG. 33 illustrates another embodiment of an iron-type ball striking head 702 as described above with respect to the embodiment in FIGS. 26-29. In the embodiment of FIG. 33, the weight member 730 includes a connection member 758 in the form of a pin with a tab 759 proximate the end that is configured to be connected to and received in a receiver 760 on the rear surface 731 of the face member 728, to connect the weight member 730 to the face member 728. In this embodiment, the receiver 760 includes a slot 761, which may be a right-angled slot 761, to permit the pin 758 to be inserted into the receiver 760 and turned to lock the tab 759 in the slot 761. In other respects, the components, features, structures, and functioning of the head 702 in FIG. 33 are similar to those described above with respect to FIGS. 26-29. It is understood that the receiver 760 and the aperture 751 may also be considered to be connection members, as defined herein.

Figure 34:
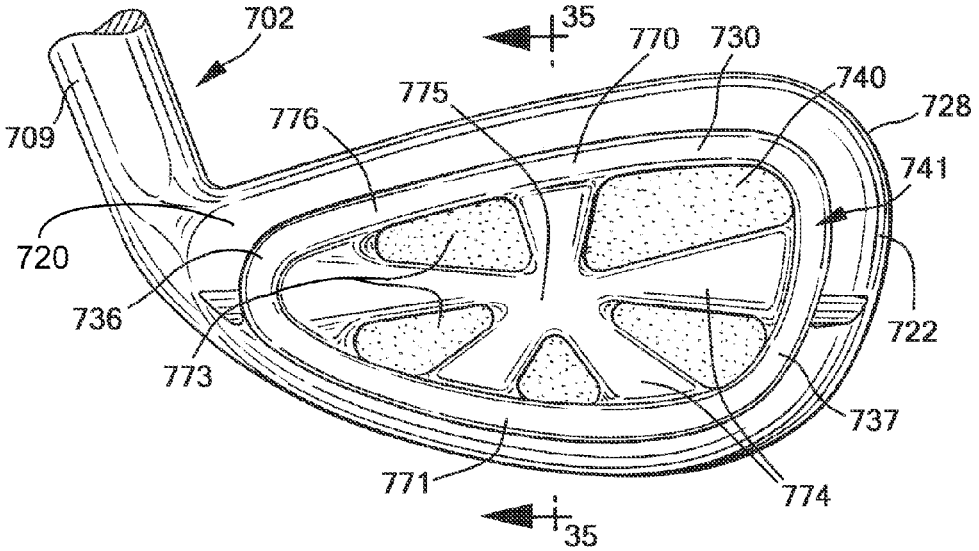
FIG. 34 is a rear view of another embodiment of a ball striking device according to aspects of the present invention, in the form of a golf iron.
Figure 35:
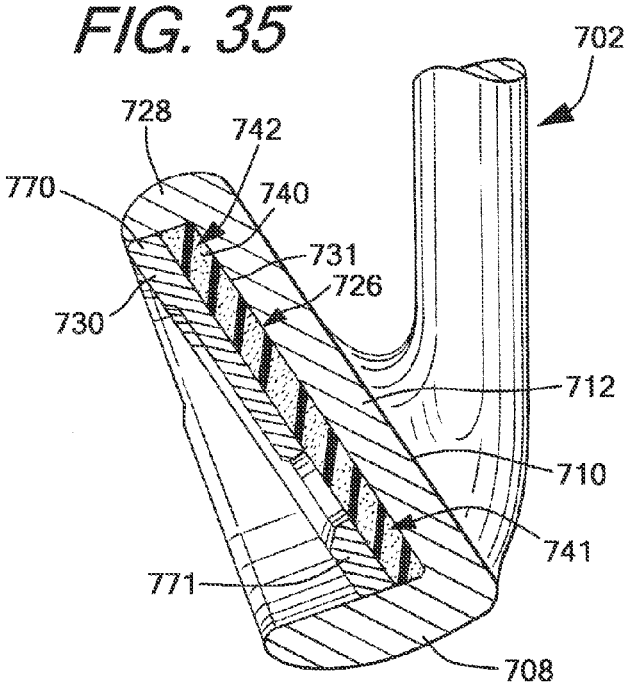
FIG. 35 is a cross-section view taken along lines 35-35 of FIG. 34.
Figure 36:
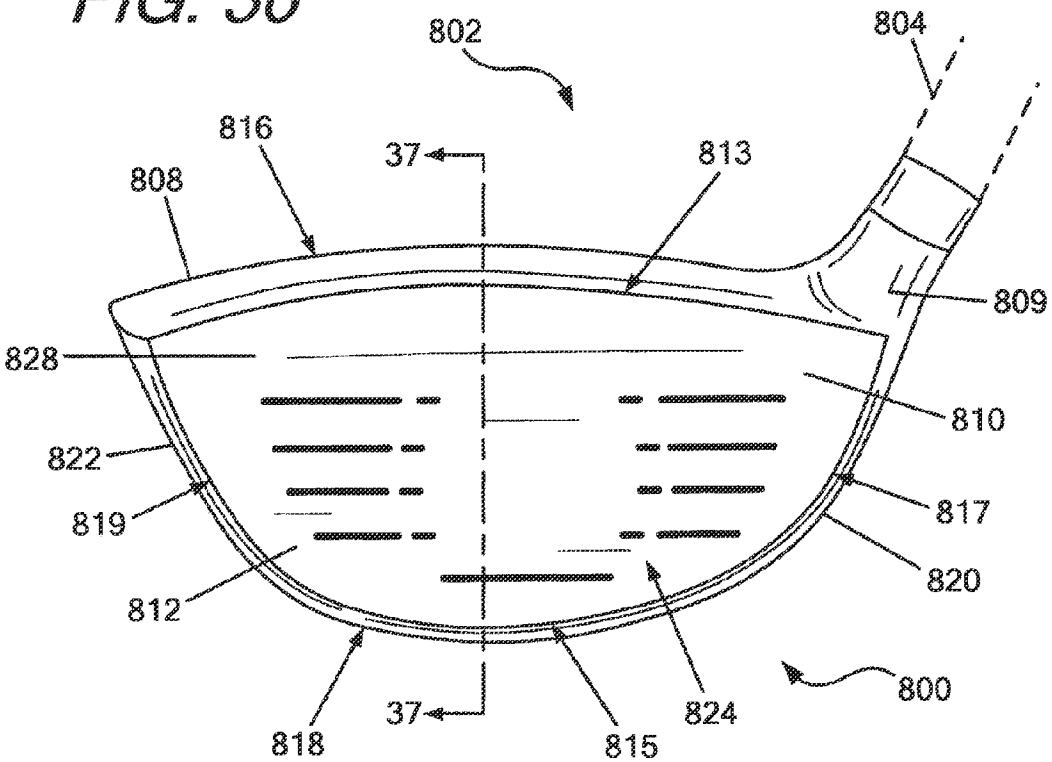
FIG. 36 is a front view of another embodiment of a ball striking device according to aspects of the present invention, in the form of a golf driver.

FIGS. 34-35 illustrate another embodiment of an iron-type ball striking head 702 as described above with respect to the embodiment in FIGS. 26-29. In the embodiment of FIGS. 34-35, the weight member 730 is connected to the rear surface 731 of the face member 728 by the resilient member 740, as similarly described above and shown in FIGS. 1-3. As described above, adhesive or other bonding material may be used to connect the resilient member 740 to the face member 728 and/or the weight member 730. Mechanical joining techniques, integral joining techniques, or other joining techniques may additionally or alternately be used to connect the resilient member 740 to the face member 728 and/or the weight member 730. In other respects, the components, features, structures, and functioning of the head 702 in FIGS. 34-35 are similar to those described above with respect to FIGS. 26-29.

FIGS. 36-41 illustrate examples of a ball striking device 800 in the form of a golf driver, in accordance with at least some examples of this invention. The ball striking device 800 includes a ball striking head 802 and a shaft 804 connected to the ball striking head 802 and extending therefrom. The ball striking head 802 of FIGS. 36-41 has a face member 828 that includes a face 812 having a striking surface or ball striking surface 810 located thereon and a rear surface 831 opposite the striking surface. The head 802 further includes a body 808 connected to the face 812 and extending rearwardly from the face 812, and a hosel 809 extending from the head 802. The body 808 and the face 812 combine to define an internal cavity 811, which may be empty or at least partially filled with a material, such as foam or another material. The ball striking head 802 also has a weight member 830 connected to the face member 828, as described further below. The shaft may be connected to the hosel 809, and may utilize any shaft configuration and any desired hosel and/or head/shaft interconnection structure, including those described above.

For reference, the head 802 generally has a top 816, a bottom or sole 818, a heel 820 proximate the hosel 809, a toe 822 distal from the hosel 809, a front side 824, and a back or rear side 826. The shape and design of the head 802 may be partially dictated by the intended use of the device 800. In the club 800 shown in FIGS. 36-41, the head 802 has a face 812 with some degree of incline, as the club 800 is designed for use as an wood-type club, intended to hit the ball medium to long distances, with some degree of lift and arcing trajectory, depending on the club type. It is understood that the head 802 may be configured as a different type of ball striking device in other embodiments, including other types of woods, including fairway woods, hybrid clubs, etc. In other applications, such as for a different type of golf club, the head may be designed to have different dimensions and configurations.

The face 812 is located at the front 824 of the head 802, and has a striking surface or ball striking surface 810 located thereon, with peripheral edges 813, 815, 817, 819. The ball striking surface 810 is configured to face a ball 106 in use, and is adapted to strike the ball 106 when the device 800 is set in motion, such as by swinging. As shown, the ball striking surface 810 occupies most of the face 812. The face 812 may include some curvature in the top to bottom and/or heel to toe directions (e.g., bulge and roll characteristics), as is known and is conventional in the art. In other embodiments, the surface 810 may occupy a different proportion of the face 812, or the body 808 may have multiple ball striking surfaces 810 thereon. Additionally, the face 812 may have one or more internal or external inserts in some embodiments.

It is understood that the face 812, the body 808, and/or the hosel 809 can be formed as a single piece or as separate pieces that are joined together. In the embodiments shown in FIGS. 36-41, the face member 828 is formed as a cup-face structure, with the face 812 and walls 825 extending rearwardly from the face 812 to connect to the body 808. The face 812 and walls 825 in this embodiment may be considered to define a cavity 841 behind the face 812. In other embodiments, the face member 828 and/or the body 808 may be formed of multiple pieces, such as by using an insert to form all or part of the face 812, or multiple body members connected behind the face 812. Such multiple pieces may be joined using an integral joining technique, such as welding, cementing, or adhesively joining, or other known techniques, including many mechanical joining techniques, such as releasable mechanical engagement techniques. In another embodiment, the face member 828 may be a plate-like member. Further, the hosel 809 may also be formed as a separate piece, which may be joined using these or other techniques.

Figure 37:
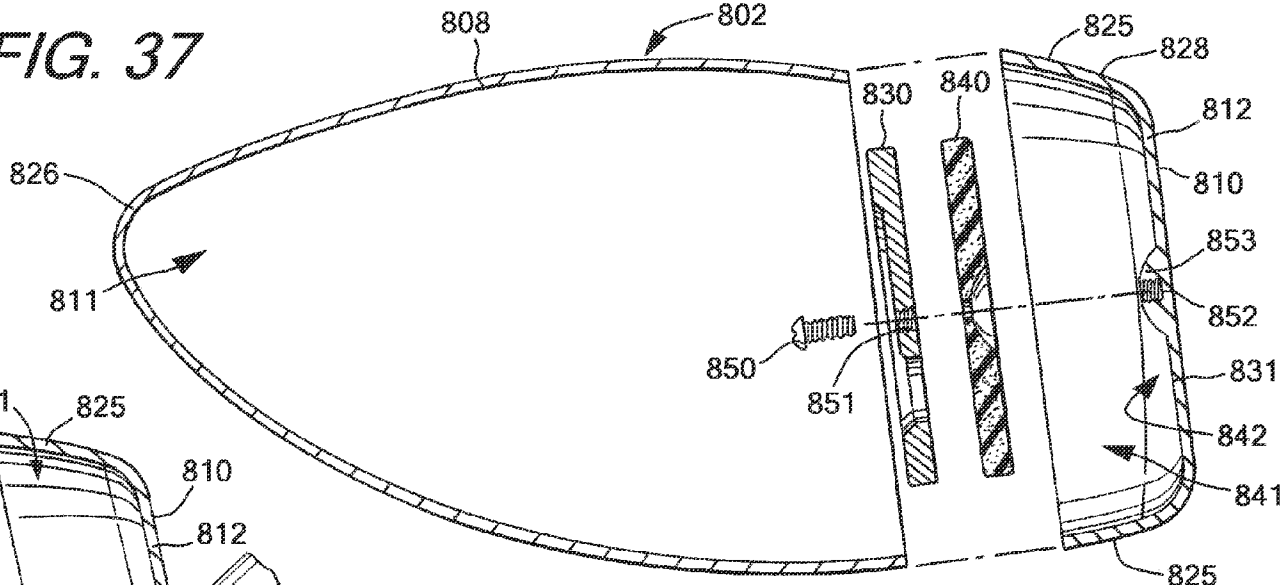
FIG. 37 is an exploded cross-section view taken along lines 37-37 of FIG. 36.

FIG. 37 illustrates a head 802 that has a weight member 830 connected to the face member 828 by a connection or connection point 848 formed by one or more connection members 850 connected to the face member 828 and/or the weight member 830. In the embodiment of FIG. 37, the head 802 includes a connection member 850 in the form of a fastener, such as a screw, bolt, etc., that extends through apertures 851, 852 in the weight member 830 and the face member 828 to connect the weight member 830 to the face member 828. The face member 828 includes a raised connection point 853 for connection to the connection member 850, which can avoid the need for the aperture 852 to penetrate too close to the striking surface 810, although this feature may be absent in another embodiment. In a further embodiment, the connection member 850 may be permanently and/or integrally connected to the face member 828 or the weight member 830. In the embodiment of FIG. 37, the weight member 830 may be configured similarly to the weight member 730 of FIGS. 26-29, with spokes and gaps (not shown) being defined therein. The CG of the weight member 830 may be located at the hub 875. It is understood that the apertures 851, 852 may also be considered to be connection members, as defined herein.

As similarly described above with respect to the head 702 of FIGS. 26-29, the CG of the weight member 830 and the CG of the face member 828 may be aligned vertically, laterally, or both. In one embodiment, the connection member 850 may be directly aligned with the CG of the weight member 830 and/or the CG of the face member 828. In another embodiment, the connection member 850 may be aligned with the vertical or lateral plane of the CG of the weight member 830 and/or the CG of the face member 828. Further, the weight member 830 may be parallel or substantially parallel to the striking surface 810 of the face 812. Additionally, the connection member 850 in this embodiment is located approximately equidistant from the heel and toe edges 820, 822 of the face member 828 and approximately equidistant from the heel and toe edges (not shown) of the weight member 830. The same is true for the connection members 854, 855, 858 of the heads 802 in FIGS. 38-40. In an additional embodiment, the weight member 830 may have a total weight or a weight relative to the total weight of the head 802 as described above with respect to the head 102 of FIGS. 1-3.

The weight member 830 may be configured to transfer energy and/or momentum to the face member 828 upon an impact on the face 812, including an off-center impact, as similarly described above with respect to the weight member 730 of FIGS. 26-29. Additionally, the connection between the face member 828 and the weight member 830 permits, or at least does not inhibit, this transfer of energy and/or momentum between the weight member 830 and the face member 828, as described above with respect to the heads 102, 202 of FIGS. 1-3 and 5-7.

The head 802 of FIG. 37 may also include a resilient member 840 formed at least partially of a resilient material, with any configurations or properties of the resilient members 140, 240, as described above. In one embodiment, the resilient member 840 at least partially fills the spaces 842 between the weight member 830 and the face member 828, and at least part of the resilient member 840 is included on both lateral sides of the CG of the face member 828 and/or the CG of the weight member 830. At least part of the resilient member 840 may also be included on both vertical sides of the CG of the face member 828 and/or the CG of the weight member 830. As shown in FIG. 37, in this embodiment, the resilient member 840 completely fills the spaces 842 between the weight member 830 and the rear surface 831 of the face member 828. In another embodiment, the resilient member 840 may partially fill the spaces 842. The resilient member 840 may serve to transfer energy and/or momentum between the weight member 830 and the face member 828 during impact, as described above.

Figure 38:
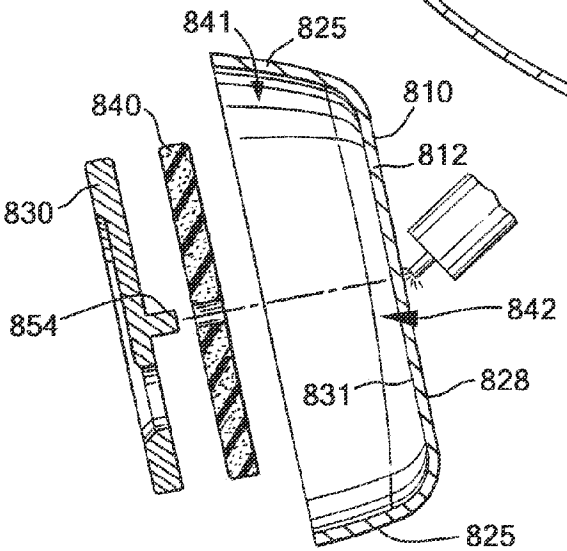
FIG. 38 is an exploded partial cross-section view of an alternate embodiment the device of FIGS. 36-37.

FIG. 38 illustrates another embodiment of a wood-type ball striking head 802 as described above with respect to the embodiment in FIGS. 36-37. In the embodiment of FIG. 38, the weight member 830 includes a connection member 854 in the form of a post that is configured to be connected to the rear surface 831 of the face member 828, such as by welding as shown in FIG. 38, to connect the weight member 830 to the face member 828. Other techniques, including integral joining techniques such as brazing or soldering, as well as adhesive or other bonding techniques, mechanical joining techniques, etc., may alternately be used to connect the connection member 854 to the face member 828. In other respects, the components, features, structures, and functioning of the head 802 in FIG. 38 are similar to those described above with respect to FIGS. 36-37.

Figure 39:
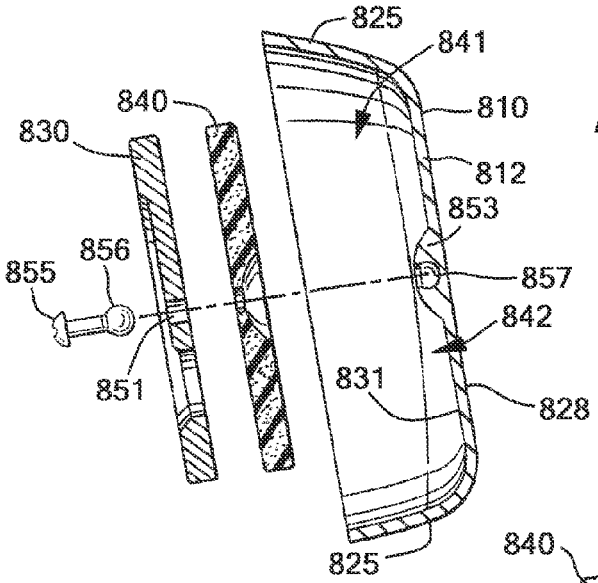
FIG. 39 is an exploded partial cross-section view of another alternate embodiment the device of FIGS. 36-37.

FIG. 39 illustrates another embodiment of a wood-type ball striking head 802 as described above with respect to the embodiment in FIGS. 36-37. In the embodiment of FIG. 39, the weight member 830 includes a connection member 855 in the form of a pin with a ball end 856 that is configured to be connected to and received in a socket 857 on the rear surface 831 of the face member 828, to connect the weight member 830 to the face member 828. In other respects, the components, features, structures, and functioning of the head 802 in FIG. 39 are similar to those described above with respect to FIGS. 36-37. It is understood that the socket 857 and the aperture 851 may also be considered to be connection members, as defined herein.

Figure 40:
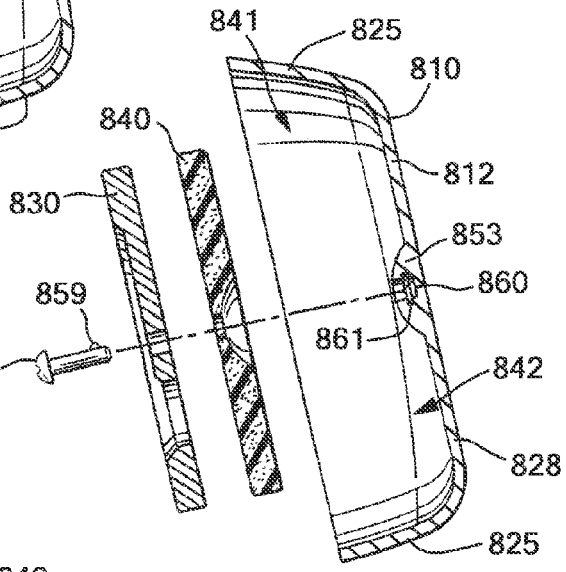
FIG. 40 is an exploded partial cross-section view of another alternate embodiment the device of FIGS. 36-37.

FIG. 40 illustrates another embodiment of a wood-type ball striking head 802 as described above with respect to the embodiment in FIGS. 36-37. In the embodiment of FIG. 40, the weight member 830 includes a connection member 858 in the form of a pin with a tab 859 proximate the end that is configured to be connected to and received in a receiver 860 on the rear surface 831 of the face member 828, to connect the weight member 830 to the face member 828. In this embodiment, the receiver 860 includes a slot 861, which may be a right-angled slot 861, to permit the pin 858 to be inserted into the receiver 860 and turned to lock the tab 859 in the slot 861. In other respects, the components, features, structures, and functioning of the head 802 in FIG. 40 are similar to those described above with respect to FIGS. 36-37. It is understood that the receiver 860 and the aperture 851 may also be considered to be connection members, as defined herein.

Figure 41:
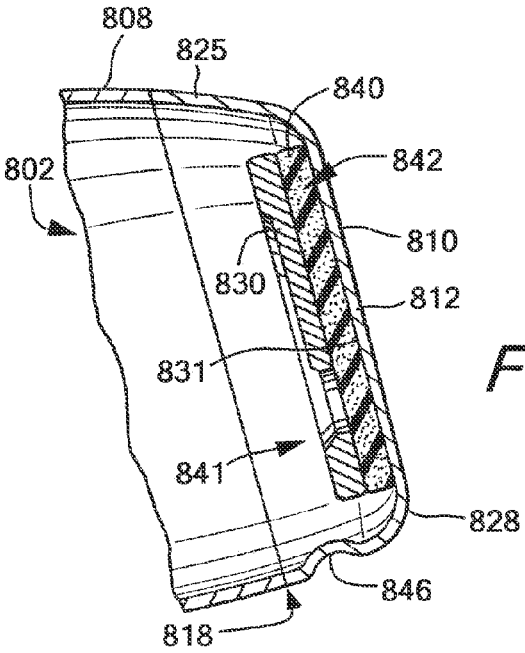
FIG. 41 is a partial cross-section view of another embodiment of a ball striking device according to aspects of the present invention, in the form of a golf driver.

FIG. 41 illustrates another embodiment of a wood-type ball striking head 802 as described above with respect to the embodiment in FIGS. 36-37. In the embodiment of FIG. 41, the weight member 830 is connected to the rear surface 831 of the face member 828 by the resilient member 840, as similarly described above and shown in FIGS. 1-3. As described above, adhesive or other bonding material may be used to connect the resilient member 840 to the face member 828 and/or the weight member 830. Mechanical joining techniques or other joining techniques may additionally or alternately be used to connect the resilient member 840 to the weight member 830 and/or to the face member 828. Additionally, the head 802 in this embodiment includes a channel 846 across the sole 818, as described above with respect to the head 102 as shown in FIG. 4. It is understood that a channel 846 such as depicted in FIG. 41 may be used in connection with any other embodiment described herein, including the embodiments in FIGS. 36-40. In other respects, the components, features, structures, and functioning of the head 802 in FIG. 41 are similar to those described above with respect to FIGS. 36-37.

It is understood that any of the embodiments of ball striking devices 100, et seq., heads 102, et seq., face members 128, et seq., weight members 130, et seq., and other components described herein may include any of the features described herein with respect to other embodiments described herein, including structural features, functional features, and/or properties, unless otherwise noted. It is understood that the specific sizes, shapes, orientations, and locations of various components of the ball striking devices 100, et seq., and heads 102, et seq., described herein are simply examples, and that any of these features or properties may be altered in other embodiments. In particular, any of the connecting members or structures shown and described herein may be used in connection with any embodiment shown herein, to connect the face member 128, et seq., and the weight member 130, et seq.

Heads 102, et seq., incorporating the features disclosed herein may be used as a ball striking device or a part thereof. For example, a golf club 100 as shown in FIG. 1 may be manufactured by attaching a shaft or handle 104 to a head that is provided, such as the head 102 as described above. As another example, a golf club 100 as shown in FIG. 1 may be manufactured by attaching a weight member 130 to a face member that is provided, such as the face member 128 as described above. "Providing" the head, as used herein, refers broadly to making an article available or accessible for future actions to be performed on the article, and does not connote that the party providing the article has manufactured, produced, or supplied the article or that the party providing the article has ownership or control of the article. In other embodiments, different types of ball striking devices can be manufactured according to the principles described herein. In one embodiment, a set of golf clubs can be manufactured, where at least one of the clubs has a head according to one or more embodiments described herein. Such a set may include at least one wood-type club, at least one iron-type club, and/or at least one putter. For example, a set of iron-type golf clubs can be provided, with each club having a different loft angle, and each club having a head 702 as described above and shown in FIGS. 26-35. The set of clubs may further include one or more wood-type clubs, which may have different loft angles, with each club having a head 802 as described above and shown in FIGS. 36-41. The set of clubs may further include one or more putters, with each club having a head 102, 202, 302, 402, 502 as described above and shown in FIGS. 1-25. The various clubs in the set may have weight members 130, et seq., that may be slightly different in shape, size, location, orientation, etc., based on the loft angle of the club. The various clubs may also have an added weight amount or weight distribution (including CG location) that may be different based on characteristics such as the type and loft angle of the club.

Different weight members 130, et seq., and different locations, orientations, and connections thereof, may produce different energy and/or momentum transfer upon impacts on the striking surface 110, et seq., including off-center impacts. Additionally, different weight members 130, et seq., and different locations, orientations, and connections thereof, may produce different effects depending on the location of the ball impact on the face 112, et seq. Accordingly, one or more clubs can be customized for a particular user by providing a club with a head as described above, with a weight member 130, et seq., that is configured in at least one of its shape, size, location, orientation, etc., based on a hitting characteristic of the user, such as a typical hitting pattern or swing speed. Customization may also include adding or adjusting weighting according to the characteristics of the weight member 130, et seq., and the hitting characteristic(s) of the user. Still further embodiments and variations are possible, including further techniques for customization.

The ball striking devices described herein may be used by a user to strike a ball or other object, such as by swinging or otherwise moving the head 102, et seq., to strike the ball on the striking surface 110, et seq., of the face 112, et seq. During the striking action, the face 112, et seq., impacts the ball, and one or more weight members 130, et seq., may transfer energy and/or momentum to the face 112, et seq., during the impact, in any manner described above. In one embodiment, the weight member(s) 130, et seq., may transfer incrementally greater energy and/or momentum for impacts that are farther from the desired impact point (e.g. the CG). As described below, the devices described herein, when used in this or a comparable method, may assist the user in achieving more consistent accuracy and distance of ball travel, as compared to other ball striking devices.

The various embodiments of ball striking heads with weight members described herein can provide energy and/or momentum transfer upon impacts on the striking face, which can assist in keeping the striking face more square with the ball, particularly on off-center impacts, which can in turn provide more accurate ball direction. Additionally, the energy and/or momentum transfer to the face member can reduce or minimize energy loss on off-center impacts, creating more consistent ball speed and distance. The energy and/or momentum transfer may be incremental based on the distance of the impact away from the desired or optimal impact point. Further, the resilient member may achieve some energy absorption or damping on center impacts (e.g. aligned with the centerpoint and/or the CG of the face), reducing ball speed and distance to create more consistent ball speed and distance for impacts at any location on the face. As a result of the reduced energy loss on off-center hits, reduced twisting of the face on off-center hits, and/or reduced energy transfer on center hits that can be achieved by the heads as described above, greater consistency in both lateral dispersion and distance dispersion can be achieved as compared to typical ball striking heads of the same type, with impacts at various locations on the face. The ball striking heads described herein can also provide dissipation of impact energy through the resilient material, which can reduce vibration of the club head and may improve feel for the user. Still further benefits can be recognized and appreciated by those skilled in the art.

Certain benefits and advantages can be provided by ball striking devices according to the present invention. Dispersion testing was performed using five different ball striking devices in the form of golf putters, including two commercial mallet-type putters, two commercial blade-type putters, and a prototype similar to the head 502 as shown in FIG. 20A. The dispersion testing generally included hitting a number of balls with each putter, utilizing a mechanical swinging mechanism at a consistent swing speed, with the impacts occurring at different locations on the face. The impact locations were center, heel, toe, and high-center. The final locations of the balls struck by the different putters were recorded, and the total area/volume ($C_v$) of an ellipse encircling all of the resulting ball positions (excluding extreme outliers) was calculated. For Mallet #1, the $C_v$ was calculated to be 63.2; for Mallet #2, the $C_v$ was calculated to be 61.1; for Blade #1, the $C_v$ was calculated to be 57.8; for Blade #2, the $C_v$ was calculated to be 50.1; and for the Prototype, the $C_v$ was calculated to be 35.7. As shown by these figures, the Prototype exhibited far more consistent accuracy and distance for impacts at several different face locations, as compared to existing putters that do not utilize the features described herein. Other examples and embodiments described above utilize principles and functionality that are similar to the tested Prototype, and similar results are expected for other embodiments described herein.

While the invention has been described with respect to specific examples including presently preferred modes of carrying out the invention, those skilled in the art will appreciate that there are numerous variations and permutations of the above described systems and methods. Thus, the spirit and scope of the invention should be construed broadly as set forth in the appended claims.

What is claimed is:

1. A ball striking device comprising:

a face member including a face having a striking surface configured for striking a ball and a rear side opposite the striking surface of the face;

a weight member joined to the rear side of the face member;

a first connection member connecting the rear side of the face member and the weight member at a connection point, the first connection member forming a joint at the connection point; and a resilient member positioned between the weight member and the face member, the resilient member engaging the rear surface of the face member and the weight member to space the weight member from the face member, wherein the weight member has at least a first surface that is engaged by the resilient member and at least a second surface that is exposed and not engaged by the resilient member, wherein the resilient member is compressible to permit the weight member to transfer momentum to the face member through the resilient member upon an impact of the ball on the striking surface, and wherein the joint is configured to permit the weight member to transfer momentum to the face member through the resilient member, wherein the joint is configured such that a portion of the weight member aligned with the joint does not deflect toward or away from the face during the impact, and a heel portion and a toe portion of the weight member can deflect toward or away from the face during the impact.

2. The ball striking device of claim 1, wherein the weight member is configured such that momentum is transferred from the weight member to the face member through the resilient member during an off-center impact of the ball on the striking surface, and the amount of momentum transferred to the face member increases incrementally with a lateral distance of a location of the impact away from a center of gravity of the face member.

3. The ball striking device of claim 1, wherein the face member comprises a sole member extending rearwardly from the face, the sole member having a sole surface configured to confront a playing surface and a top surface opposite the sole surface and forming part of the rear side of the face member, wherein the weight member is at least partially positioned above the top surface.

4. The ball striking device of claim 3, wherein the weight member has a bottom surface that is spaced from and in confronting relation to the top surface of the sole member, and wherein the resilient member engages the top surface of the sole member and the bottom surface of the weight member and spaces the weight member from the top surface.

5. The ball striking device of claim 3, further comprising a low-friction material connected to one of the bottom surface of the weight member and the top surface of the sole member and positioned between the bottom surface of the weight member and the top surface of the sole member.

6. The ball striking device of claim 1, wherein the first connection member is a pin or a fastener extending through an aperture in at least one of the face member and the weight member to define the joint.

7. The ball striking device of claim 1, wherein the first connection member is connected to the face member, further comprising a second connection member connected to the weight member, wherein the first and second connection members are connected to form the joint.

8. The ball striking device of claim 1, further comprising a hosel configured for connection of a shaft, the hosel being connected to the face member.

9. A golf club comprising the ball striking device of claim 1 and a shaft connected to the device and configured for gripping by a user.

10. A ball striking device comprising:

a face member including a face having a striking surface configured for striking a ball and a rear surface opposite the striking surface;

a weight member positioned behind the rear surface of the face member; and a resilient member positioned between the weight member and the face member, the resilient member being connected to the rear surface of the face member to connect the weight member to the face member, wherein the resilient member is compressible to permit the weight member to transfer momentum to the face member through the resilient member upon an impact of the ball on the striking surface, and wherein the face member comprises a sole member extending rearwardly from the face, the sole member having a sole surface configured to confront a playing surface and a top surface opposite the sole surface, and wherein the weight member is at least partially positioned above the top surface of the sole member, such that a top surface and a rear surface of the weight member are exposed.

11. The ball striking device of claim 10, wherein the weight member is configured such that momentum is transferred from the weight member to the face member through the resilient member during an off-center impact of the ball on the striking surface, and the amount of momentum transferred to the face member increases incrementally with a lateral distance of a location of the impact away from a center of gravity of the face member.

12. The ball striking device of claim 10, wherein the striking surface has a heel side and a toe side positioned on opposed sides of a center of gravity of the face member, and the weight member has a heel edge and a toe edge positioned on opposed sides of a center of gravity of the weight member, wherein the heel edge of the weight member is configured to transfer momentum to the face member upon an impact of the ball centered on the heel side of the striking surface, and wherein the toe edge of the weight member is configured to transfer momentum to the face member upon an impact of the ball centered on the toe side of the striking surface.

13. The ball striking device of claim 12, wherein the face member has a heel edge and a toe edge positioned on opposed sides of the center of gravity of the face member and a width defined between the heel and toe edges thereof, and the weight member has a width defined between the heel and toe edges thereof, and wherein the width of the face member is approximately equal to the width of the weight member.

14. The ball striking device of claim 10, wherein the weight member has a bottom surface that is spaced from and in confronting relation to the top surface of the sole member, and wherein the resilient member is connected to the top surface of the sole member and is positioned between the top surface of the sole member and the bottom surface of the weight member.

15. The ball striking device of claim 10, wherein spaces are defined between the weight member and the rear surface of the face member on opposed sides of a center of gravity of the face member, and wherein the resilient member is positioned within the spaces on both sides of the center of gravity of the face member.

16. The ball striking device of claim 15, wherein the face member has a heel edge and a toe edge positioned on opposed sides of a center of gravity of the face member, and the weight member has a heel edge and a toe edge positioned on opposed sides of a center of gravity of the weight member, wherein the resilient member is positioned at least between the heel edges of the face member and the weight member and between the toe edges of the face member and the weight member.

17. The ball striking device of claim 10, further comprising a low-friction material connected to one of the bottom surface of the weight member and the top surface of the sole member and positioned between the bottom surface of the weight member and the top surface of the sole member.

18. The ball striking device of claim 10, further comprising a first connection member connected to at least one of the face member and the weight member, wherein the first connection member forms a joint between the face member and the weight member that permits the weight member to transfer momentum to the face member, and wherein the joint is configured such that a portion of the weight member aligned with the joint does not deflect toward or away from the face during the impact, and a heel portion and a toe portion of the weight member can deflect toward or away from the face during the impact.

19. The ball striking device of claim 10, wherein the face member has a cavity on the rear surface thereof, and the weight member is at least partially received within the cavity.

20. The ball striking device of claim 19, wherein the face member has a width defined between the heel and toe edges of the face member that is greater than a width of the weight member defined between the heel and toe edges of the weight member, such that the heel and toe edges of the face member extend laterally beyond the heel and toe edges of the weight member.

21. The ball striking device of claim 10, further comprising a hosel configured for connection of a shaft, the hosel being connected to the face member.

22. A golf club comprising the ball striking device of claim 10 and a shaft connected to the device and configured for gripping by a user.

23. The ball striking device of claim 10, wherein spaces are defined between the weight member and the rear surface of the face member on opposed sides of a center of gravity of the face member, and wherein the resilient member is positioned within the spaces on both sides of the center of gravity of the face member, and wherein additional spaces are defined between the weight member and the top surface of the sole member.

24. The ball striking device of claim 23, wherein the resilient member is further positioned within the additional spaces on both sides of the center of gravity of the face member, and wherein the resilient member fills the spaces between the weight member and the rear surface of the face member completely, and the resilient member fills the additional spaces between the weight member and the top surface of the sole member completely.

25. The ball striking device of claim 24, wherein the striking surface has a heel side and a toe side positioned on opposed sides of a center of gravity of the face member, and the weight member has a heel edge and a toe edge positioned on opposed sides of a center of gravity of the weight member, wherein the heel edge of the weight member is configured to transfer momentum to the face member upon an impact of the ball centered on the heel side of the striking surface, and wherein the toe edge of the weight member is configured to transfer momentum to the face member upon an impact of the ball centered on the toe side of the striking surface.

26. The ball striking device of claim 23, further comprising a low-friction material connected to one of the bottom surface of the weight member and the top surface of the sole member and positioned between the bottom surface of the weight member and the top surface of the sole member.

27. A ball striking device comprising:

a face member including a face having a striking surface configured for striking a ball and a rear side opposite the striking surface;

a resilient member connected to the rear side of the face member; and a weight member that is connected to the resilient member and influences a center of gravity of the ball striking device, the weight member being suspended with respect to the face member by the resilient member, such that only the resilient member connects the weight member to the face member, wherein the weight member has at least a first surface that is engaged by the resilient member and at least a second surface that is exposed and not engaged by the resilient member, wherein the weight member is configured such that energy is transferred between the weight member and the face member through the resilient member during an off-center impact of the ball on the striking surface, wherein the striking surface has a heel side and a toe side positioned on opposed sides of a center of gravity of the face member, and the weight member has a heel edge and a toe edge positioned on opposed sides of a center of gravity of the weight member, wherein the heel edge of the weight member is configured to transfer momentum to the face member upon an impact of the ball centered on the heel side of the striking surface, and wherein the toe edge of the weight member is configured to transfer momentum to the face member upon an impact of the ball centered on the toe side of the striking surface, wherein the rear side of the face member comprises a rear surface opposite the striking surface and a sole member extending rearwardly from the rear surface, the sole member having a sole surface configured to confront a playing surface and a top surface opposite the sole surface, wherein the weight member has a bottom surface that is spaced from and in confronting relation to the top surface of the sole member, and wherein the resilient member is connected to the top surface of the sole member and is positioned between the top surface of the sole member and the bottom surface of the weight member and suspends the bottom surface of the weight member with respect to the top surface of the sole member, and wherein the face member has a heel edge and a toe edge positioned on opposed sides of the center of gravity of the face member and a width defied between the heel and toe edges thereof, and the weight member has a width defined between the heel and toe edges thereof, and wherein the width of the face member is approximately equal to the width of the weight member.

28. The ball striking device of claim 27, wherein the weight member has a cross-sectional area that is greater at the heel and toe edges thereof than at the center of gravity thereof.

29. The ball striking device of claim 27, wherein spaces are defined between the weight member and the face member, and the resilient member completely fills all the spaces between the weight member and the face member.

30. The ball striking device of claim 27, wherein the resilient member is positioned at least between the heel edges of the face member and the weight member and between the toe edges of the face member and the weight member.

31. The ball striking device of claim 27, further comprising a hosel configured for connection of a shaft, the hosel being connected to the face member.

32. A golf club comprising the ball striking device of claim 27 and a shaft connected to the device and configured for gripping by a user.

33. A golf club head comprising:

a face member including a face having a striking surface configured for striking a ball and a rear surface opposite the striking surface, the face member having a heel edge and a toe edge and the striking surface having a heel side and a toe side positioned on opposed sides of a center of gravity of the face member;

a hosel connected to the face member, the hosel configured for connection of a shaft;

a weight member connected to the face member and having a front surface confronting the rear surface of the face member, the weight member having a heel edge and a toe edge positioned on opposed sides of a center of gravity of the weight member; and a resilient member connected to the rear surface of the face member and the front surface of the weight member to connect the weight member to the face member, such that only the resilient member connects the weight member to the face member, wherein spaces are defined between the front surface of the weight member and the rear surface of the face member on opposed sides of the center of gravity of the face member, and wherein the resilient member is positioned within the spaces on both sides of the center of gravity of the face member to space the weight member from the face member, wherein the weight member has an exposed top surface and an exposed back surface that are not engaged by the resilient member, and wherein the resilient member is compressible to permit the weight member to transfer momentum to the face member through the resilient member, and wherein the weight member is configured such that the heel edge of the weight member is configured to transfer momentum to the face member upon an impact of the ball centered on a heel side of the striking surface, and the toe edge of the weight member is configured to transfer momentum to the face member upon an impact of the ball centered on a toe side of the striking surface, and wherein the face member further comprises a sole member extending rearwardly from the face, the sole member having a sole surface configured to confront a playing surface and a top surface opposite the sole surface, and wherein the weight member has a bottom surface that is spaced from and in confronting relation to the top surface of the sole member, and wherein the resilient member is connected to the top surface of the sole member and the bottom surface of the weight member and is positioned between the top surface of the sole member and the bottom surface of the weight member to space the bottom surface of the weight member from the top surface of the sole member.

34. A golf club comprising the head of claim 33 and a shaft connected to the head and configured for gripping by a user.

35. A golf club head comprising:

a face member including a face having a striking surface configured for striking a ball, a rear surface opposite the striking surface, and a sole member extending rearward from the face and having a sole surface configured to confront a playing surface and a top surface opposite the sole surface, the face member having a heel edge and a toe edge, and the striking surface having a heel side and a toe side positioned on opposed sides of a center of gravity of the face member;

a hosel connected to the face member, the hosel configured for connection of a shaft;

a weight member connected to the face member and having a front surface confronting the rear surface of the face member and a bottom surface confronting the top surface of the sole member, the weight member having a heel edge and a toe edge positioned on opposed sides of a center of gravity of the weight member; and a resilient member connected to the top surface of the sole member and the top surface of the weight member to connect the weight member to the face member, such that only the resilient member connects the weight member to the face member, wherein spaces are defined between the bottom surface of the weight member and the top surface of the sole member on opposed sides of the center of gravity of the face member, and wherein the resilient member is positioned within the spaces on both sides of the center of gravity of the face member to space the weight member from the face member, wherein the weight member has an exposed top surface and an exposed back surface that are not engaged by the resilient member, and wherein the resilient member is compressible to permit the weight member to transfer momentum to the face member through the resilient member, and wherein the weight member is configured such that the heel edge of the weight member is configured to transfer momentum to the face member upon an impact of the ball centered on a heel side of the striking surface, and the toe edge of the weight member is configured to transfer momentum to the face member upon an impact of the ball centered on a toe side of the striking surface.

36. The golf club head of claim 35, further comprising a connection member connecting a rear side of the face member and the weight member at a connection point, the connection member forming a joint at the connection point, wherein the joint is configured to permit the weight member to transfer momentum to the face member through the resilient member.

37. A golf club comprising the head of claim 35 and a shaft connected to the head and configured for gripping by a user.

38. A golf club head comprising:

a face member including a face having a striking surface configured for striking a ball and a rear surface opposite the striking surface, the face member having a heel edge and a toe edge positioned on opposed sides of a center of gravity of the face member and a width defined between the heel and toe edges of the face member, the face member further having a cavity defined on the rear surface of the face member;

a hosel connected to the face member, the hosel configured for connection of a shaft;

a weight member connected to the rear surface of the face member and being at least partially received in the cavity, the weight member having a front surface confronting the rear surface of the face member, a heel edge and a toe edge positioned on opposed sides of a center of gravity of the weight member, and a width defined between the heel and toe edges of the weight member, wherein the width of the weight member is smaller than the width of the face member such that the heel and toe edges of the face member extend laterally beyond the heel and toe edges of the weight member; and a resilient member connected to the rear surface of the face member and the front surface of the weight member to connect the weight member to the face member, such that only the resilient member connects the weight member to the face member, wherein spaces are defined between the front surface of the weight member and the rear surface of the face member on opposed sides of the center of gravity of the face member, and wherein the resilient member is positioned within the spaces on both sides of the center of gravity of the face member to space the weight member from the face member, wherein the resilient member is compressible to permit the weight member to transfer momentum to the face member through the resilient member, and wherein the weight member is configured such that the heel edge of the weight member is configured to transfer momentum to the face member upon an impact of the ball centered on a heel side of the striking surface, and the toe edge of the weight member is configured to transfer momentum to the face member upon an impact of the ball centered on a toe side of the striking surface, and wherein the weight member further has a top edge and a bottom edge positioned on opposed sides of the center of gravity of the weight member, and wherein the weight member is further configured such that the top edge of the weight member is configured to transfer momentum to the face member upon an impact of the ball centered on a top side of the striking surface, and the bottom edge of the weight member configured to transfer momentum to the face member upon an impact of the ball centered on a bottom side of the striking surface.

39. A golf club comprising the head of claim 38 and a shaft connected to the head and configured for gripping by a user.

40. A ball striking device comprising:

a face member including a face having a striking surface configured for striking a ball and a rear side opposite the striking surface of the face;

a weight member joined to the rear side of the face member;

a first connection member connecting the rear side of the face member and the weight member at a connection point, the first connection member forming a joint at the connection point; and a resilient member positioned between the weight member and the face member, the resilient member engaging the rear surface of the face member and the weight member to space the weight member from the face member, wherein the weight member has at least a first surface that is engaged by the resilient member and at least a second surface that is exposed and not engaged by the resilient member, wherein the resilient member is compressible to permit the weight member to transfer momentum to the face member through the resilient member upon an impact of the ball on the striking surface, wherein the joint is configured to permit the weight member to transfer momentum to the face member through the resilient member, wherein the face member comprises a sole member extending rearwardly from the face, the sole member having a sole surface configured to confront a playing surface and a top surface opposite the sole surface and forming part of the rear side of the face member, wherein the weight member is at least partially positioned above the top surface, and wherein the ball striking device further comprises a low-friction material connected to one of the bottom surface of the weight member and the top surface of the sole member and positioned between the bottom surface of the weight member and the top surface of the sole member.

41. A ball striking device comprising:

a face member including a face having a striking surface configured for striking a ball and a rear side opposite the striking surface of the face;

a weight member joined to the rear side of the face member;

a first connection member connecting the rear side of the face member and the weight member at a connection point, the first connection member forming a joint at the connection point; and a resilient member positioned between the weight member and the face member, the resilient member engaging the rear surface of the face member and the weight member to space the weight member from the face member, wherein the weight member has at least a first surface that is engaged by the resilient member and at least a second surface that is exposed and not engaged by the resilient member, wherein the resilient member is compressible to permit the weight member to transfer momentum to the face member through the resilient member upon an impact of the ball on the striking surface, wherein the joint is configured to permit the weight member to transfer momentum to the face member through the resilient member, and wherein the first connection member is connected to the face member, further comprising a second connection member connected to the weight member, wherein the first and second connection members are connected to form the joint.

42. The ball striking device of claim 41, wherein one of the first and second connection members comprises a pin and another of the first and second connection members comprises a receiver, wherein the pin is received in the receiver to connect the face member and the weight member and to define the joint.

43. A ball striking device comprising:

a face member including a face having a striking surface configured for striking a ball and a rear surface opposite the striking surface;

a weight member positioned behind the rear surface of the face member; and a resilient member positioned between the weight member and the face member, the resilient member being connected to the rear surface of the face member to connect the weight member to the face member, wherein the resilient member is compressible to permit the weight member to transfer momentum to the face member through the resilient member upon an impact of the ball on the striking surface, wherein the face member comprises a sole member extending rearwardly from the face, the sole member having a sole surface configured to confront a playing surface and a top surface opposite the sole surface, and wherein the weight member is at least partially positioned above the top surface, wherein the striking surface has a heel side and a toe side positioned on opposed sides of a center of gravity of the face member, and the weight member has a heel edge and a toe edge positioned on opposed sides of a center of gravity of the weight member, wherein the heel edge of the weight member is configured to transfer momentum to the face member upon an impact of the ball centered on the heel side of the striking surface, and wherein the toe edge of the weight member is configured to transfer momentum to the face member upon an impact of the ball centered on the toe side of the striking surface, and wherein the face member has a heel edge and a toe edge positioned on opposed sides of the center of gravity of the face member and a width defined between the heel and toe edges thereof, and the weight member has a width defined between the heel and toe edges thereof, and wherein the width of the face member is approximately equal to the width of the weight member.

44. The ball striking device of claim 43, wherein the weight member has a cross-sectional area that is greater at the heel and toe edges thereof than at the center of gravity thereof.

45. A ball striking device comprising:

a face member including a face having a striking surface configured for striking a ball and a rear surface opposite the striking surface;

a weight member positioned behind the rear surface of the face member; and a resilient member positioned between the weight member and the face member, the resilient member being connected to the rear surface of the face member to connect the weight member to the face member, wherein the resilient member is compressible to permit the weight member to transfer momentum to the face member through the resilient member upon an impact of the ball on the striking surface, and wherein the face member comprises a sole member extending rearwardly from the face, the sole member having a sole surface configured to confront a playing surface and a top surface opposite the sole surface, and wherein the weight member is at least partially positioned above the top surface; and a low-friction material connected to one of the bottom surface of the weight member and the top surface of the sole member and positioned between the bottom surface of the weight member and the top surface of the sole member.

* * * * *